US007670744B2

(12) United States Patent
Yuasa et al.

(10) Patent No.: US 7,670,744 B2
(45) Date of Patent: Mar. 2, 2010

(54) TONER, METHOD FOR PRODUCING TONER, TWO COMPONENT DEVELOPER, AND IMAGE FORMING APPARATUS

(75) Inventors: Yasuhito Yuasa, Katano (JP); Hidekazu Arase, Kobe (JP)

(73) Assignee: Panasonic Corporation, Osaka (JP)

( * ) Notice: Subject to any disclaimer, the term of this patent is extended or adjusted under 35 U.S.C. 154(b) by 0 days.

(21) Appl. No.: 12/148,844

(22) Filed: Apr. 23, 2008

(65) Prior Publication Data

US 2008/0206665 A1 Aug. 28, 2008

Related U.S. Application Data

(62) Division of application No. 11/071,723, filed on Mar. 2, 2005, now abandoned.

(30) Foreign Application Priority Data

Mar. 4, 2004 (JP) ..... 2004-060945

(51) Int. Cl.
*G03G 9/08* (2006.01)

(52) U.S. Cl. ..... 430/137.14

(58) Field of Classification Search ..... 430/137.14
See application file for complete search history.

(56) References Cited

U.S. PATENT DOCUMENTS 4,980,257 A * 12/1990 Anno et al. ..... 430/110.2
5,567,561 A 10/1996 Yoshikawa et al.
5,998,078 A 12/1999 Suwabe et al.
6,180,307 B1 * 1/2001 Kmiecik-Lawrynowicz ..... 430/110.2
6,303,256 B1 10/2001 Kerner et al.

(Continued)

FOREIGN PATENT DOCUMENTS

EP 0453907 * 10/1991

(Continued)

*Primary Examiner*—Mark F Huff
*Assistant Examiner*—Peter L Vajda
(74) *Attorney, Agent, or Firm*—Hamre, Schumann, Mueller & Larson, P.C.

(57) ABSTRACT

First toner of the present invention includes colored particles and an external additive. The colored particles are produced by heating and aggregating a mixture that includes a resin particle dispersion in which first resin particles are dispersed and a pigment particle dispersion in which pigment particles are dispersed, so that at least part of the first resin particles is melted. The colored particles have a finely roughened surface. Second toner of the present invention includes aggregated particles including at least first resin particles and pigment particles, and colored particles having a finely roughed surface formed by fusing at least part of wax and at least part of second resin particles on the surface of the aggregated particles. Third toner of the present invention includes aggregated particles including at least first resin particles and pigment particles, and colored particles having a finely roughened surface formed by fusing at least part of third resin particles and at least part of fourth resin particles on the surface of the aggregated particles. When the aggregated particles are formed in an aqueous medium, the pH is controlled in the specified range. The toner can achieve oilless fixing that prevents offset without using oil while maintaining high OHP transmittance. Therefore, it is possible to eliminate the spent of toner components on a carrier and to make the life longer. Moreover, thinning or scattering during transfer can be suppressed, thus ensuring high transfer efficiency.

8 Claims, 23 Drawing Sheets

U.S. PATENT DOCUMENTS

| | | | | |
|---|---|---|---|---|
| 6,544,707 | B2 | 4/2003 | Nakamura et al. | |
| 6,627,373 | B1 * | 9/2003 | Patel et al. | 430/137.14 |
| 6,828,073 | B2 | 12/2004 | Matsummura et al. | |
| 2002/0182527 | A1 * | 12/2002 | Kim et al. | 430/110.3 |
| 2002/0192587 | A1 * | 12/2002 | Matsumura et al. | 430/110.4 |
| 2003/0027074 | A1 * | 2/2003 | Emoto et al. | 430/124 |
| 2004/0191660 | A1 * | 9/2004 | Otsuka et al. | 430/108.23 |
| 2004/0253529 | A1 | 12/2004 | Baba et al. | |
| 2005/0048389 | A1 | 3/2005 | Cheng et al. | |

FOREIGN PATENT DOCUMENTS

| | | | |
|---|---|---|---|
| JP | 10-198070 | A | 7/1998 |
| JP | 2801507 | B2 | 7/1998 |
| JP | 10-301332 | A | 11/1998 |
| JP | 2002-23429 | A | 1/2002 |
| JP | 2003-202699 | A | 7/2003 |
| JP | 2003-167390 | | 6/2006 |

* cited by examiner

TONER, METHOD FOR PRODUCING TONER, TWO COMPONENT DEVELOPER, AND IMAGE FORMING APPARATUS

This application is a division of U.S. Ser. No. 11/071,723, filed Mar. 2, 2005 which application is incorporated herein by reference.

BACKGROUND OF THE INVENTION

1. Field of the Invention

The present invention relates to toner used, e.g., in copiers, laser printers, plain paper facsimiles, color PPC, color laser printers, color facsimiles or multifunctional devices, a method for producing the toner, a two-component developer, and an image forming apparatus.

2. Description of the Related Art

In recent years, electrophotographic apparatuses, which commonly were used in offices, have been used increasingly for personal purposes, and there is a growing demand for technologies that can achieve, e.g., a small size, a high speed, high image quality, or high reliability for those apparatuses. Under such circumstances, a cleanerless process, a tandem color process, and oilless fixing are required along with better maintenance property and less ozone emission. The cleanerless process allows residual toner in transfer to be recycled for development without cleaning. The tandem color process enables high-speed output of color images. The oilless fixing can provide clear color images with high glossiness, transmittance, and offset resistance, even if no fixing oil is used to prevent offset during fixing. These functions should be performed simultaneously, and therefore improvements in the toner characteristics as well as the processes are important factors.

For color printers, a color process employing a four-pass system has been put to practical use. In this color process, an image support (referred to as a photoconductive member in the following) is charged by corona discharge with a charger, and then is exposed to light signals for latent images of colors to form electrostatic latent images. The electrostatic latent images are developed by a first color of toner, e.g., yellow toner, to form visible images. Thereafter, a transfer member charged with a polarity reverse to that of the charged yellow toner is contacted with the photoconductive member so that the yellow toner images formed on the photoconductive member are transferred thereto. The photoconductive member is cleaned by removing residual toner that has not been transferred, and the development and transfer of the first color toner ends with discharging the photoconductive member. Thereafter, the same operations as those for the yellow toner are repeated for toners for other colors such as magenta and cyan. The toner images of the colors are superimposed on the transfer member so as to form color images. Then, the superimposed toner images are transferred to paper charged with a polarity reverse to that of the toner. On the other hand, a tandem color process employing the following configuration also has been proposed. A plurality of image forming stations, each of which includes a charger, a photoconductive member, and a developing unit, are arranged in a row. A first transfer process is performed by successively transferring each color of toner to an endless transfer member in contact with the photoconductive members, so that multilayer transfer color toner images are formed on the transfer member. Then, a second transfer process is performed such that the multilayer toner images formed on the transfer member are transferred collectively to a transfer medium such as paper, an overhead projector (OHP) sheet, or the like. Another tandem color process also has been proposed, in which toner continuously is transferred directly to the transfer medium without using the transfer member.

In a fixing process for color images, each color of toner is melted and then mixed so as to increase the transmittance. A melt failure of the toner may cause light scattering on the surface or the inside of the toner images, and the original color of the toner pigment is damaged. Moreover, light does not reach the lower layer of the superimposed images, resulting in poor color reproduction. Therefore, it is essential for the toner to have a complete melt property and transmittance high enough not to reduce the original color. In particular, the requirement for light transmittance as an OHP sheet is increasing with an increase in opportunities to give a presentation by using color data.

When color images are formed, toner may adhere to the surface of a fixing roller and cause offset. Therefore, a large amount of oil or the like should be applied to the fixing roller, which makes the handling or configuration of equipment more complicated. Thus, oilless fixing (no oil is used for fixing) is required to provide compact, maintenance-free, and low-cost equipment. To achieve the oilless fixing, e.g., toner in which a release agent (wax) is added to a binder resin with sharp melt property is being put to practical use.

However, such toner is very prone to a transfer failure or a variation in toner images during transfer because of its strong cohesiveness. Therefore, it is difficult to ensure compatibility between transfer and fixing. In the case of two-component development, spent (i.e., a low-melting component of the toner adheres to the carrier surface) is likely to occur by heat generated by mechanical collision or friction between the particles or between the particles and the developing unit. This decreases the charging ability of the carrier and interferes with a longer life of the developer.

Japanese patent No. 2801507 discloses a carrier for positively charged toner that is obtained by introducing a fluorine-substituted alkyl group into a silicone resin of the coating layer. JP 2002-23429 A discloses a coating carrier that includes conductive carbon and a cross-linked fluorine modified silicone resin. This coating carrier is considered to have high development ability in a high-speed process and maintain the development ability for a long time. While taking advantage of superior charging characteristics of the silicone resin, the conventional technique uses the fluorine-substituted alkyl group to obtain properties such as slidability, releasability, and repellency, to increase resistance to wearing, peeling, or cracking, and further to prevent spent. However, the resistance to wearing, peeling, or cracking is not sufficient. Moreover, when the negatively charged toner is used, the amount of charge is excessively small, although the positively charged toner may have an appropriate amount of charge. Therefore, the reversely charged toner (positively charged toner) is generated significantly, which leads to fog or toner scattering. Thus, the toner is not suitable for practical use.

Various configurations of toner also have been proposed. It is well-known that toner for electrostatic charge image development used in an electrophotographic method generally includes a resin component (binder resin), a coloring component including a pigment or dye, a plasticizer, a charge control agent, and an additive, if necessary, such as a release agent. As the resin component, natural or synthetic resin is used alone or in combination.

After the additive is pre-mixed in an appropriate ratio, the resulting mixture is heated and kneaded by thermal melting and then is pulverized by an air stream collision board system, and fine powder is classified so as to produce a toner base. In this case, the toner base also may be produced by a chemical polymerization method. Subsequently, an external additive such as hydrophobic silica is added to the toner base, thereby completing the toner. The single component development typically uses toner only, and the two component development uses a developer including toner and a carrier of magnetic particles.

Even with pulverization and classification of the conventional kneading and pulverizing processes, the actual particle size can be reduced to only about 8 μm in view of the economic and performance conditions. At present, various methods are considered to produce toner having a smaller particle size. In addition, a method for achieving the oilless fixing also is considered. For example, a release agent (wax) may be added to a resin with a low softening point during melting and kneading. However, there is a limit to the amount of wax to be added, and increasing the amount of wax can cause problems such as a decrease in toner flowability, thinning during transfer, or a fusion of toner to the photoconductive member.

Therefore, various ways of polymerization different from the kneading and pulverizing processes have been studied as a method for producing toner. For example, toner may be produced by suspension polymerization. However, the particle size distribution is no better than that of the kneading and pulverizing processes, and in many cases further classification is necessary. Moreover, since the toner is almost spherical in shape, the cleaning property is extremely poor when the toner remains on the photoconductive member or the like, and thus the reliability of image quality is reduced.

Toner may be produced by emulsion polymerization including the following steps: preparing an aggregated particle dispersion by forming aggregated particles in a dispersion of at least resin particles; forming adhesive particles by mixing a resin particle dispersion in which resin fine particles are dispersed with the aggregated particle dispersion so that the resin fine particles adhere to the aggregated particles; and heating and fusing the adhesive particles together.

JP 10(1998)-198070 discloses a method for producing toner for electrostatic charge image development. The method includes the following: preparing a resin particle dispersion by dispersing resin particles in a disperser having a polarity; preparing a coloring agent particle dispersion by dispersing coloring agent particles in a disperser having a polarity; and preparing a liquid mixture by mixing at least the resin particle dispersion and the coloring agent particle dispersion. According to this method, the polarities of the dispersers in the liquid mixture are the same, so that reliable toner with excellent charge and color development properties can be produced in a simple and easy manner.

JP 10(1998)-301332 discloses a method for producing toner with excellent fixing property, color development property, transparency, and color mixing property. According to this method, a release agent includes at least one kind of ester that contains at least one selected from higher alcohol having a carbon number of 12 to 30 and higher fatty acid having a carbon number of 12 to 30, and resin particles include at least two kinds of resin particles with different molecular weights.

As the release agent, e.g., low molecular-weight polyolefins such as polyethylene, polypropylene, and polybutene, silicones, fatty acid amides such as oleamide, erucamide, amide ricinoleate, and amide stearate, vegetable waxes such as carnauba wax, rice wax, candelilla wax, Japan wax, and jojoba oil, animal waxes such as beeswax, mineral/petroleum waxes such as montan wax, ozocerite, ceresin, paraffin wax, microcrystalline wax, and Fischer-Tropsch wax, and modified waxes thereof are disclosed.

However, when the dispersibility of the release agent added is lowered, the toner images melted during fixing are prone to a dull color. This also decreases the pigment dispersibility, and thus the color development property of the toner becomes insufficient. In the subsequent process, when resin fine particles further adhere to the surface of an aggregate, the adhesion of the resin fine particles is unstable due to low dispersibility of the release agent or the like. Moreover, the release agent that once was aggregated with the resin particles is liberated into an aqueous medium. Depending on the polarity or the thermal properties such as a melting point, the release agent may have a considerable effect on aggregation. Further, a specified wax is added in a large amount to achieve the oilless fixing. Therefore, it is difficult to aggregate the wax with the resin particles that differ from the wax in melting point, softening point, and viscoelasticity and to fuse them together uniformly by heating. In particular, the use of a release agent having a predetermined acid value and a functional group may achieve the oilless fixing, reduce fog during development, and improve the transfer efficiency. However, such a release agent prevents uniform mixing and aggregation of the resin particles with pigment particles in an aqueous medium during manufacture. Thus, there is a tendency to increase the presence of release agent or pigment suspended in the aqueous medium.

SUMMARY OF THE INVENTION

Therefore, with the foregoing in mind, it is an object of the present invention to provide toner that can have a smaller particle size and a sharp particle size distribution without performing a classification process. It is another object of the present invention to provide toner that can achieve not only oilless fixing (no-oil is applied to a fixing roller) by using a release agent such as wax, but also low-temperature fixability, high-temperature offset resistance, and storage stability. It is yet another object of the present invention to provide a two-component developer that can have a long life and high durability to withstand deterioration caused by spent, even if it is combined with toner including a release agent such as wax. It is still another object of the present invention to provide an image forming apparatus that can prevent thinning or scattering during transfer and exhibit high transfer efficiency.

First toner of the present invention includes colored particles and an external additive. The colored particles are produced by heating and aggregating a mixture that includes a resin particle dispersion in which first resin particles are dispersed and a pigment particle dispersion in which pigment particles are dispersed, so that at least part of the first resin particles is melted. The colored particles have a finely roughened surface.

Second toner of the present invention includes aggregated particles including at least first resin particles and pigment particles, and colored particles having a finely roughened surface formed by fusing at least part of wax and at least part of second resin particles on the surface of the aggregated particles.

Third toner of the present invention includes aggregated particles including at least first resin particles and pigment particles, and colored particles having a finely roughened surface formed by fusing at least part of resin A particles and at least part of resin B particles on the surface of the aggregated particles.

A first method for producing toner of the present invention allows toner to be produced in an aqueous medium by heating and aggregating a mixture that includes at least a first resin particle dispersion in which first resin particles are dispersed and a pigment particle dispersion in which pigment particles are dispersed. The method includes the steps of: A. adjusting the pH of the mixture of at least the first resin particle dispersion and the pigment particle dispersion in the range of 9.5 to 12.2; B. adding a water-soluble inorganic salt to the mixture; C. heat-treating the mixture so that at least the first resin particles and the pigment particles are aggregated to form aggregated particles, and at least part of the aggregated particles is melted; D. adjusting the pH of the mixture at the time of forming the aggregated particles in the range of 7.0 to 9.5; E. adding a second resin particle dispersion in which second resin particles are dispersed and a wax particle dispersion in which wax is dispersed to an aggregated particle dispersion in which the aggregated particles are dispersed and adjusting the pH of the resultant mixture in the range of 5.2 to 8.8; F. heat-treating the mixture at temperatures not less than a glass transition point of the second resin particles for 0.5 to 2 hours; G. adjusting the pH of the mixture in the range of 3.2 to 6.8; and H. fusing the second resin particles and the wax with the aggregated particles by further heat-treating the mixture at temperatures not less than the glass transition point of the second resin particles for 0.5 to 5 hours. The colored particles produced have a finely roughened surface.

A second method for producing toner of the present invention allows toner to be produced in an aqueous medium by heating and aggregating a mixture that includes at least a first resin particle dispersion in which first resin particles are dispersed and a pigment particle dispersion in which pigment particles are dispersed. The method includes the steps of: A. adjusting the pH of the mixture of at least the first resin particle dispersion and the pigment particle dispersion in the range of 9.5 to 12.2; B. adding a water-soluble inorganic salt to the mixture; C. heat-treating the mixture so that at least the first resin particles and the pigment particles are aggregated to form aggregated particles, and at least part of the aggregated particles is melted; D. adjusting the pH of the mixture at the time of forming the aggregated particles in the range of 7.0 to 9.5; E. adding a resin A particle dispersion in which resin A particles are dispersed and a resin B particle dispersion in which resin B particles are dispersed to an aggregated particle dispersion in which the aggregated particles are dispersed and adjusting the pH of the resultant mixture in the range of 5.2 to 8.8; F. heat-treating the mixture at temperatures not less than a glass transition point of the resin A particles for 0.5 to 2 hours; G. adjusting the pH of the mixture in the range of 3.2 to 68; and H. fusing the resin A particles and the resin B particles with the aggregated particles by further heat-treating the mixture at temperatures not less than the glass transition point of the resin A particles for 0.5 to 5 hours. The colored particles produced have a finely roughened surface.

A two-component developer of the present invention includes a toner material and a carrier. The toner material includes the toner of the present invention as a toner base, and 1 to 6 parts by weight of inorganic fine powder having an average particle size of 6 nm to 200 nm is added to 100 parts by weight of the toner base. The carrier includes magnetic particles as a core material, and at least the surface of the core material is coated with a fluorine modified silicone resin containing an aminosilane coupling agent.

A first image forming apparatus of the present invention includes a plurality of toner image forming stations, each of which includes an image support member, a charging member for forming an electrostatic latent image on the image support member, and a toner support member, and an endless transfer member. The apparatus has a transfer system including a primary transfer process and a secondary transfer process. In the primary transfer process, an electrostatic latent image formed on the image support member is made visible by development with the toner or the two-component developer of the present invention, and a toner image obtained by the development of the electrostatic latent image is transferred to the transfer member that is in contact with the image support member. The primary transfer process is performed continuously in sequence so that a multilayer toner image is formed on the transfer member. The secondary transfer process is performed by collectively transferring the multilayer transfer image formed on the transfer member to a transfer medium. The transfer system satisfies the relationship expressed by $$d1/v \leqq 0.65(\text{sec})$$

where d1 (mm) is a distance between a first primary transfer position and a second primary transfer position, or between the second primary transfer position and a third primary transfer position, or between the third primary transfer position and a fourth primary transfer position, and v (mm/s) is a circumferential velocity of the image support member.

A second image forming apparatus of the present invention includes a plurality of toner image forming stations, each of which includes an image support member, a charging member for forming an electrostatic latent image on the image support member, and a toner support member. The apparatus has a transfer system including a transfer process in which an electrostatic latent image formed on each of the image support members is made visible by development with the toner or the two-component developer of the present invention, and toner images obtained by the development of the electrostatic latent images are transferred successively to a transfer medium. The transfer system satisfies the relationship expressed by $$d1/v \leqq 0.65(\text{sec})$$

where d1 (mm) is a distance between a first transfer position and a second transfer position, or between the second transfer position and a third transfer position, or between the third transfer position and a fourth transfer position, and v (mm/s) is a circumferential velocity of the image support member.

The present invention can reduce the presence of wax or pigment particles that are not aggregated and thus are suspended in the aqueous medium. Therefore, the toner of the present invention can have a smaller particle size and a uniform, narrow, and sharp particle size distribution without performing a classification process. The oilless fixing can be achieved with high-temperature offset resistance and low-temperature fixability. The present invention provides a two-component developer that can have high durability to withstand deterioration caused by spent, even if it is combined with toner including a release agent such as wax.

In a tandem color process in which a plurality of image forming stations, each including a charger and a developing unit, are arranged in a row, and each color of toner is transferred successively to a transfer member, the configuration of the present invention can prevent reverse transfer or thinning during transfer and achieve high transfer efficiency.

DESCRIPTION OF THE PREFERRED EMBODIMENTS

Figure 1:
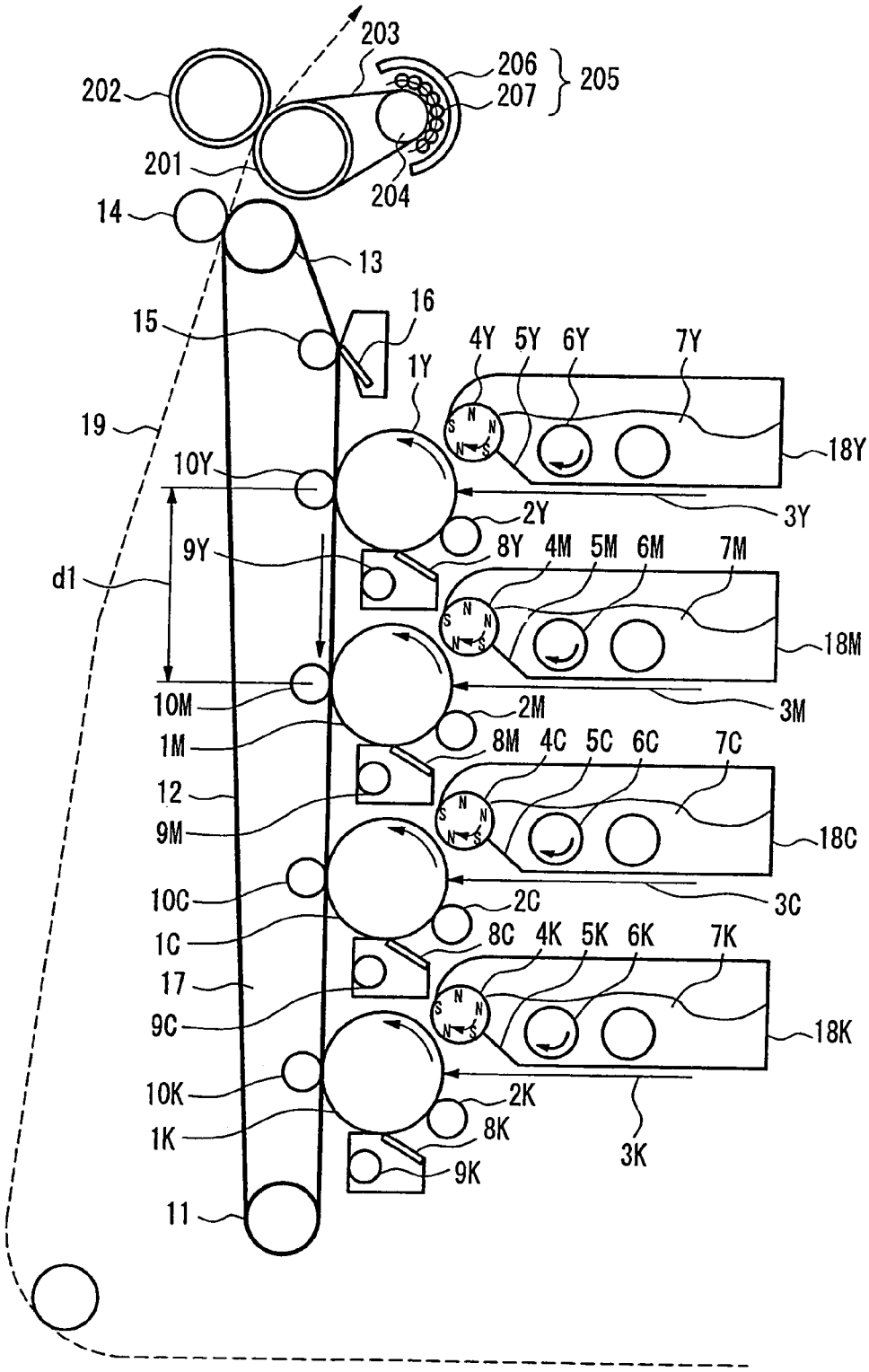
FIG. 1 is a cross-sectional view showing the configuration of an image forming apparatus used in an example of the present invention.

The present inventors conducted a detailed study of providing i) toner for electrostatic charge image development that has a smaller particle size and a sharp particle size distribution and can achieve not only the oilless fixing but also superior glossiness, transmittance, charging characteristics, environmental dependence, and cleaning and transfer properties; ii) a two-component developer using the toner; and iii) an image forming apparatus that can form color images with high quality and reliability without causing toner scattering, fog, or the like.

(1) Polymerization Process

A resin particle dispersion is prepared by forming resin particles of a homopolymer or copolymer (vinyl resin) of vinyl monomers by emulsion or seed polymerization of the vinyl monomers in an ionic surfactant and dispersing the resin particles in the ionic surfactant. Any known dispersing devices such as a high-speed rotating emulsifier, a high-pressure emulsifier, a colloid-type emulsifier, a ball mill using a medium, a sand mill, and a Dyno mill can be used. When the resin particles are made of resin other than the homopolymer or copolymer of the vinyl monomers, a resin particle dispersion may be prepared in the following manner. If the resin dissolves in an oil solvent that has relatively low water solubility, a solution is obtained by mixing the resin with the oil solvent. The solution is blended with an ionic surfactant or polyelectrolyte, and then is dispersed in water to produce a fine particle dispersion by using a dispersing device such as a homogenizer. Subsequently, the oil solvent is evaporated by heating or under reduced pressure. Thus, the resin particles made of resin other than the vinyl resin are dispersed in the ionic surfactant.

Examples of a polymerization initiator include an azo- or diazo-based initiator such as 2,2'-azobis-(2,4-dimethylvaleronitrile), 2,2'-azobisisobutyronitrile, 1,1'-azobis(cyclohexane-1-carbonitrile), 2,2'-azobis-4-methoxy-2,4-dimethylvaleronitrile, or azobisisobutyronitrile, persulfate such as potassium persulfate or ammonium persulfate, an azo compound such as 4,4'-azobis-4-cyanovaleric acid and its salt or 2,2'-azobis(2-amidinopropane) and its salt, and a peroxide compound.

A pigment particle dispersion is prepared by adding pigment particles to water that includes a polar surfactant and dispersing the pigment particles using any of the above dispersing devices.

For the toner of this embodiment, a first resin particle dispersion in which first resin particles are dispersed and a pigment particle dispersion in which pigment particles are dispersed are mixed in an aqueous medium, and the mixture is heated so that at least part of the resin particles is melted to form aggregated particles. It is preferable that a resin particle dispersion in which resin particles are dispersed or a wax particle dispersion in which wax is dispersed is added to the aggregated particle dispersion thus produced, and the resultant mixture is heat-treated at temperatures not less than a glass transition point of the resin particles for 0.5 to 5 hours so that the resin particles or the wax are fused with the aggregated particles to form fused particles (also referred to as colored particles).

The fused particles (colored particles) have a finely roughened surface. Therefore, it is possible to improve the cleaning property that contributes to the removal of residual toner from a photoconductive member or transfer member. Moreover, it is also possible to increase the chargeability, so that high charging characteristics can be maintained stably without adding a charge control agent.

The fused particles (colored particles) having a finely roughened surface are close to spherical in shape. Therefore, it is possible to improve not only the cleaning property but also the transfer performance by achieving high transfer efficiency and reducing thinning in letters or reverse transfer.

FIGS. 7A and 7B, 8A and 8B, 9A and 9B, 10A and 10B, 11A and 11B, 12A and 12B, 13A and 13B, 14A and 14B, and 15A and 15B are SEM cross-sectional images of toner bases of the colored particles. No pretreatment (e.g., metal sputtering) is performed for any sample to avoid a change in the particle surfaces caused by heat during SEM observation. The SEM used in this embodiment is JSM-6700F manufactured by Japan Electron Optics Laboratory Co., Ltd. (accelerating voltage: 1 kV, sample tilt: 0 degree, and magnification: 5000× for the upper figure A; 10000× for the lower figure B).

The toner bases of this embodiment are shown in FIGS. 9A and 9B, 10A and 10B, 11A and 11B, 12A and 12B, or 13A and 13B. The toner bases are substantially spherical in shape and have a finely roughened surface. The fine surface roughness and the substantially spherical shape of the toner bases are effective to achieve the transfer performance, the charging performance, and the cleaning performance simultaneously.

As comparative examples, the toner bases shown in FIGS. 14A and 14B or 15A and 15B have a finely roughened surface, but almost no definite shape. The toner bases shown in FIGS. 7A and 7B or 8A and 8B are much closer to a spherical shape, and there is hardly any fine roughness in the surface.

In this embodiment, it is preferable that a surface roughness index of the colored particles ranges from 50% to 95%. The surface roughness index within this range can improve the cleaning property, the transfer property, and the charging property simultaneously. When it is more than 95%, the cleaning property is decreased. When it is less than 50%, the amount of charge is excessively large, and the image density and the flowability are likely to be reduced.

The following is an explanation of the surface roughness index. FIGS. 16A and 16B, 17A and 17B, 18A and 18B, 19A and 19B, 20A and 20B, 21A and 21B, and 22A and 22B show binary pictures of the SEM observation images in FIGS. 7A and 7B, 8A and 8B, 9A and 9B, 10A and 10B, 11A and 11B, 12A and 12B, and 13A and 13B, respectively. The binarization is performed using threshold values at the boundaries of 255 levels with 128 as a reference. The magnification is 5000× for the upper figure A and 10000× for the lower figure B.

FIGS. 18A and 18B, 19A and 19B, 20A and 20B, 21A and 21B, or 22A and 22B indicate binary patterns of black and white that correspond to the surface roughness of each of the toner bases (colored particles) of this embodiment. As the surface roughness increases, a white region where the surface is roughened increases, while the proportion of black is likely to decrease. The proportion of black is 88.1 in FIG. 18B, 76.9 in FIG. 19B, 66.9 in FIG. 20B, 59.0 in FIG. 21B, and 65.4 in FIG. 22B.

The surface roughness is hardly observed in the comparative examples of FIGS. 16A and 16B and 17A and 17B. Therefore, a white region where the surface is roughened decreases and the proportion of black is likely to increase. The proportion of black is 95.4 in FIG. 16B and 98.4 in FIG. 17B. The surface roughness index of the colored particles, which is obtained by binarizing the SEM observation image and quantifying it as the proportion of black, well reproduces the state of roughness in the surfaces of the colored particles.

In this embodiment, the SEM observation image taken at a magnification of 10000× is binarized and quantified as the proportion of black, thereby providing a surface roughness index of the colored particles. The binarization is performed using threshold values at the boundaries of 255 levels with 128 as a reference. In this case, the intensity of light around the toner particles is likely to be greater at the boundary between the particles due to SEM observation. Therefore, a different phenomenon from the intended surface roughness may be detected. Thus, the proportion of black is evaluated within 90% of the particle diameter, and 20 particles are selected to take the average of those proportions.

The above characteristics can be achieved with favorable reproducibility by satisfying the relationship expressed by $$100 \leqq KC \leqq 130 \text{ and}$$

$$1.1 \leqq BTs/BTk \leqq 6.0,$$

preferably $$100 \leqq KC \leqq 125 \text{ and}$$

$$2.1 \leqq BTs/BTk \leqq 4.5, \text{ and}$$

more preferably $$100 \leqq KC \leqq 120 \text{ and}$$

$$2.5 \leqq BTs/BTk \leqq 4.0$$

where KC is a shape factor of the colored particles having a finely roughened surface, BTs is a BET specific surface area by nitrogen adsorption, and BTk is a specific surface area calculated from the particle size of the colored particles.

The colored particles with a shape factor of not more than 130 have a shape close to spherical, and thus can improve the transfer performance. By determining the specific surface area ratio (BTs/BTk), the roughness of the surfaces of the colored particles can be quantified. Therefore, it is possible to evaluate whether fine roughness is formed evenly. When the specific surface area ratio is less than 1.1, fine roughness is not formed sufficiently, and the cleaning property and the charge retention property are reduced. When the specific surface area ratio is not less than 2.1, the chargeability can be stabilized to improve the charge rising property. This is very effective to prevent fog in the case where new toner is supplied after consumption of the existing toner. When the specific surface area ratio is more than 6, the surface is too coarse or the shape is not definite, and the transfer performance becomes poor.

The shape factor (KC) is determined by $$KC(\text{shape factor})=d^2/(4\pi\cdot A)\times 100$$

where d is a circumference of the toner base, and A is a cross-sectional area of the toner base. In this case, using Real Surface View Microscope (VE-7800) manufactured by KEYENCE CORPORATION, the toner base (colored particles) is magnified by 1000 times, and about 100 particles are taken to measure the circumference and the cross-sectional area.

The specific surface area (BTs) is measured by using Flow-Sorb II 2300 manufactured by Shimadzu Corporation.

The specific surface area (BTk) is calculated by $6/(\rho\cdot r)$, where ρ is the absolute specific gravity of the toner base, and r is a volume-average particle size of the toner base.

The particle size distribution is measured, e.g., by using Coulter Counter TA-II (manufactured by Coulter Electronics, Inc.). An interface (manufactured by Nikkaki Bios Co., Ltd.) for outputting a number distribution and a volume distribution and a personal computer are connected to the Coulter Counter TA-II. An electrolytic solution (about 50 ml) is prepared by including a surfactant (sodium lauryl sulfate) so as to have a concentration of 1 mass %. About 2 mg of measuring toner is added to the electrolytic solution. This electrolytic solution in which the sample is suspended is dispersed for about 3 minutes with an ultrasonic dispersing device, and then is measured using the 70 μm aperture of the Coulter Counter TA-II. In the 70 μm aperture system, the measurement range of the particle size distribution is 1.26 μm to 50.8 μm. However, the region smaller than 2.0 μm is not suitable for practical use because the measurement accuracy or reproducibility is low under the influence of external noise or the like. Therefore, the measurement range is set from 2.0 μm to 44.02 μm.

In this case, 256 channels are used, and the total count is 50000. The specific surface area (BTk) is calculated for each of the 256 channels, and the average of the calculated values is determined.

With a first preferred configuration of the toner of this embodiment, a first resin particle dispersion in which first resin particles are dispersed and a pigment particle dispersion in which pigment particles are dispersed are mixed in an aqueous medium, and the mixture is heated to form aggregated particles.

A resin A particle dispersion in which resin A particles are dispersed and a resin B particle dispersion in which resin B particles are dispersed may be added to an aggregated particle dispersion in which the aggregated particles are dispersed. Then, the resultant mixture may be heated at temperatures not less than a glass transition point (Tg) of the resin A particles so that the resins particles and the resin B particles are fused on the surfaces of the aggregated particles. Thus, the surfaces of the obtained colored particles (also referred to as a toner base) can be finely roughened, thereby achieving the above effect.

The surface roughness is affected by the mixing ratio of the resin A particles to the resin particles. As the content of the resin A particles increases, the surface roughness is likely to disappear. As the content of the resin B particles increases, the resin particles may remain without being fused on the surfaces of the aggregated particles, and thus the number of particles suspended in the aqueous medium is likely to be greater. Therefore, the mixing ratio of the resin A particles to the resin B particles is preferably in the range of 9:1 to 5:5, and more preferably in the range of 2:1 to 1:1.

The resin A particles preferably have a glass transition point (Tg) of 400° C. to 60° C., a softening point (Tm) of 110° C. to 130° C., and a melting start temperature (Tfb) of 80° C. to 110° C., and more preferably a glass transition point (Tg) of 43° C. to 55° C., a softening point (Tm) of 110° C. to 130° C., and a melting start temperature (Tfb) of 80° C. to 100° C. Moreover, based on the measurement by gel permeation chromatography (GPC) using THF as an eluent, it is preferable that the number-average molecular weight (Mn) is 3000 to 10000, the weight-average molecular weight (Mw) is 10000 to 100000, the Z average molecular weight (Mz) is 30000 to 500000, the ratio Mw/Mn of the weight-average molecular weight (Mw) to the number-average molecular weight (Mn) is 2 to 15, and the ratio Mz/Mn of the Z average molecular weight (Mz) to the number-average molecular weight (Mn) is 5 to 50. It is further preferable that the number-average molecular weight (Mn) is 3000 to 7000, the weight-average molecular weight (Mw) is 10000 to 70000, the Z average molecular weight (Mz) is 30000 to 300000, the Mw/Mn ratio is 2.5 to 10, and the Mz/Mn ratio is 9 to 40.

When the glass transition point of the resin A particles is lower than 40° C., the softening point is lower than 110° C., or the melting start temperature is lower than 80° C., the heat resistance and the high-temperature offset resistance are reduced, and the surface roughness cannot be formed easily. When the glass transition point of the resin A particles is higher than 60° C., the softening point is higher than 130° C., or the melting start temperature is higher than 110° C., the low-temperature fixability is degraded, and the resin particles may remain without being fused on the surfaces of the aggregated particles, so that the number of particles suspended in the aqueous medium is likely to be greater.

When the number-average molecular weight of the resin A particles is less than 3000, the weight-average molecular weight is less than 10000, the Z average molecular weight is less than 30000, the Mw/Mn ratio is less than 2, or the Mz/Mn ratio is less than 5, the high-temperature offset resistance is reduced, and the surface roughness cannot be formed easily. When the number-average molecular weight of the resin A particles is more than 10000, the weight-average molecular weight is more than 100000, the Z average molecular weight is more than 500000, the Mw/Mn ratio is more than 15, or the Mz/Mn ratio is more than 50, the low-temperature fixability is degraded, and the resin particles may remain without being fused on the surfaces of the aggregated particles, so that the number of particles suspended in the aqueous medium is likely to be greater.

The resin B particles preferably have a glass transition point (Tg) of 60° to 80° C., a softening point (Tm) of 140° C. to 200° C., and a melting start temperature (Tfb) of 125° C. to 180° C., and more preferably a glass transition point (Tg) of 65° C. to 80° C., a softening point (Tm) of 150° C. to 195° C., and a melting start temperature (Tfb) of 130° C. to 170° C. Moreover, based on the measurement by gel permeation chromatography (GPC) using THF as an eluent, it is preferable that the number-average molecular weight (Mn) is 5000 to 50000, the weight-average molecular weight (Mw) is 50000 to 300000, the Z average molecular weight (Mz) is 200000 to 800000, the ratio Mw/Mn of the weight-average molecular weight (Mw) to the number-average molecular weight (Mn) is 4 to 10, and the ratio Mz/Mn of the Z average molecular weight (Mz) to the number-average molecular weight (Mn) is 10 to 50. It is further preferable that the number-average molecular weight (Mn) is 6000 to 45000, the weight-average molecular weight (Mw) is 50000 to 300000, the Z average molecular weight (Mz) is 250000 to 600000, the Mw/Mn ratio is 4 to 7.5, and the Mz/Mn ratio is 12 to 45.

When Tg of the resin B particles is lower than 60° C., Tm is lower than 140° C., or Tfb is lower than 125° C., the heat resistance is reduced, and the surface roughness cannot be formed easily. When Tg of the resin particles is higher than 80° C., Tm is higher than 200° C., or Tfb is higher than 180° C., the low-temperature fixability is degraded, and the resin particles may remain without being fused on the surfaces of the aggregated particles, so that the number of particles suspended in the aqueous medium is likely to be greater.

When Mn of the resin B particles is less than 5000, Mw is less than 50000, Mz is less than 200000, the Mw/Mn ratio is less than 4, or the Mz/Mn ratio is less than 10, the high-temperature offset resistance is reduced, and the surface roughness cannot be formed easily. When Mn of the resin B particles is more than 50000, Mw is more than 300000, Mz is more than 800000, the Mw/Mn ratio is more than 10, or the Mz/Mn ratio is more than 50, the low-temperature fixability is degraded, and the resin particles may remain without being fused on the surfaces of the aggregated particles, so that the number of particles suspended in the aqueous medium is likely to be greater.

In this case, it is preferable that the melting start temperature of the resin B particles is at least 15° C. (more preferably at least 20° C., and further preferably at least 30° C.) higher than that of the resin A particles. Such a difference in meltability allows fine roughness to be formed in the surface of the toner base.

It is preferable that the weight-average molecular weight of the resin B particles is at least 10% (more preferably at least 15%, and further preferably at least 20%) larger than that of the resin A particles. This molecular weight difference causes a difference in viscoelasticity that allows fine roughness to be formed in the surface of the toner base.

It is preferable that the weight ratio of the sum of the resin A and resin B particles to the whole resin of the toner is in the range of 10 to 50 wt %.

With a second preferred configuration of the toner of this embodiment, a first resin particle dispersion in which first resin particles are dispersed and a pigment particle dispersion in which pigment particles are dispersed are mixed in an aqueous medium, and the mixture is heated to form aggregated particles.

A fifth resin particle dispersion in which fifth resin particles are dispersed may be added to an aggregated particle dispersion in which the aggregated particles are dispersed. Then, the resultant mixture may be heated at temperatures not less than a glass transition point (Tg) of the fifth resin particles so that the fifth resin particles are fused on the surfaces of the aggregated particles. Thus, the surfaces of the obtained colored particles can be finely roughened, thereby achieving the above effect.

For the fifth resin particles, it is preferable that the molecular weight has its peak or shoulder at least in the range of 5000 to 30000 and 80000 to 400000. The low molecular-weight components of the fifth resin particles start to adhere to the surfaces of the aggregated particles prior to others. Therefore, it is possible to avoid secondary aggregation of the aggregated particles and to promote the fusion of the resin particles. Since the high molecular-weight components of the fifth resin particles are to be melted late, the surfaces of the colored particles can be made rough.

The fifth resin particles preferably have a glass transition point (Tg) of 60° C. to 80° C., a softening point (Tm) of 140° C. to 200° C., and a melting start temperature (Tfb) of 125° C. to 180° C., and more preferably a glass transition point (Tg) of 65° C. to 80° C., a softening point (Tm) of 150° C. to 195° C., and a melting start temperature (Tfb) of 130° C. to 170° C. Moreover, based on the measurement by gel permeation chromatography (GPC) using THF as an eluent, it is preferable that the number-average molecular weight (Mn) is 5000 to 50000, the weight-average molecular weight (Mw) is 50000 to 300000, the Z average molecular weight (Mz) is 200000 to 800000, the ratio Mw/Mn of the weight-average molecular weight (Mw) to the number-average molecular weight (Mn) is 10 to 30, and the ratio Mz/Mn of the Z average molecular weight (Mz) to the number-average molecular weight (Mn) is 30 to 100. It is further preferable that the number-average molecular weight (Mn) is 6000 to 45000, the weight-average molecular weight (Mw) is 50000 to 200000, the Z average molecular weight (Mz) is 250000 to 600000, the Mw/Mn ratio is 10 to 20, and the Mz/Mn ratio is 40 to 80.

When Tg of the fifth resin particles is lower than 60° C., Tm is lower than 140° C., or Tfb is lower than 125° C., the heat resistance is reduced, and the surface roughness cannot be formed easily. When Tg of the fifth resin particles is higher than 80° C., Tm is higher than 200° C., or Tfb is higher than 180° C., the low-temperature fixability is degraded, and the resin particles may remain without being fused on the surfaces of the aggregated particles, so that the number of particles suspended in the aqueous medium is likely to be greater.

When Mn of the fifth resin particles is less than 5000, Mw is less than 50000, Mz is less than 200000, the Mw/Mz ratio is less than 10, or the Mz/Mn ratio is less than 30, the high-temperature offset resistance is reduced, and the surface roughness cannot be formed easily. When Mn of the fifth resin particles is more than 50000, Mw is more than 300000, Mz is more than 800000, the Mw/Mn ratio is more than 30, or the Mz/Mn ratio is more than 100, the low-temperature fixability is degraded, and the resin particles may remain without being fused on the surfaces of the aggregated particles, so that the number of particles suspended in the aqueous medium is likely to be greater.

It is preferable that the weight ratio of the fifth resin particles to the whole resin of the toner is in the range of 10 to 50 wt %. A larger amount of the fifth resin particles tends to decrease the low-temperature fixability, while a smaller amount of the fifth resin particles tends to suppress the formation of roughness.

With a third preferred configuration of the toner of this embodiment, a first resin particle dispersion in which first resin particles are dispersed and a pigment particle dispersion in which pigment particles are dispersed are mixed in an aqueous medium, and the mixture is heated to form aggregated particles.

A second resin particle dispersion in which second resin particles are dispersed and a wax particle dispersion in which wax is dispersed may be added to an aggregated particle dispersion in which the aggregated particles are dispersed. Then, the resultant mixture may be heated at temperatures not less than a glass transition point (Tg) of the second resin particles so that the second resin particles and the wax are fused on the surfaces of the aggregated particles. Thus, the surfaces of the obtained colored particles can be finely roughened, thereby achieving the above effect.

In this case, it is preferable that the melting point of the wax is at least 15° C. (more preferably at least 20° C., and further preferably at least 30° C.) higher than the glass transition point (Tg) of the second resin particles. Such a difference in meltability allows fine roughness to be formed in the surface of the toner base.

The surface roughness is affected by the mixing ratio of the second resin particles to the wax. As the content of the second resin particles increases, the surface roughness is likely to disappear. As the content of the wax increases, the particles may remain without being fused on the surfaces of the aggregated particles, and thus the number of particles suspended in the aqueous medium is likely to be greater. Therefore, the mixing ratio of the second resin particles to the wax is preferably in the range of 9:1 to 5:5, and more preferably in the range of 2:1 to 1:1.

Either of the configurations of the resin A and resin B particles can be applied preferably to the second resin particles. When the configuration of the resin B particles is used, the temperature at which the fused particles are formed may be set at least 10° C. higher than that for the resin A particles, or the heat time may be set at least two times longer than that for the resin A particles. In this manner, the surfaces of the colored particles can be made rough while suppressing the particles that are not fused on the surfaces of the aggregated particles and are suspended in the aqueous medium.

The above configurations can prevent the occurrence of offset without applying oil (release agent) to the fixing roller and achieve oilless color fixing with higher glossiness. Compared to a configuration in which the aggregated particles (also referred to as core particles) contain wax, the offset resistance and the releasability (separatability) of paper from the fixing roller can be improved further even when using a resin composition that has a low softening point and is melted easily to fix the toner at lower temperatures.

The aggregated particles may be produced by: mixing in an aqueous medium a first resin particle dispersion in which first resin particles are dispersed and a pigment particle dispersion in which pigment particles are dispersed, and if necessary, a wax dispersion in which wax is dispersed; adjusting the pH of the aqueous medium under certain conditions; and heating the mixture at temperatures not less than a glass transition point (Tg) of the first resin particles in the presence of an inorganic salt for aggregation.

Specifically, it is preferable that at least the first resin particle dispersion and the pigment particle dispersion, and if necessary, the wax dispersion, are mixed in the aqueous medium to form a mixed dispersion having a pH of not more than 6.0. For example, when potassium persulfate has been used in the emulsion polymerization of the resin, the residue may be decomposed by heat applied during aggregation and decrease the pH of the mixed dispersion. Therefore, a heat treatment should be performed preferably at temperatures not less than a predetermined temperature after the emulsion polymerization.

When the mixed dispersion is prepared with a pH of more than 6.0, the pH fluctuation (pH decrease) is increased while the aggregated particles are formed by heating the mixed dispersion, and the aggregated particles become coarser.

The emulsion polymerization of the resin preferably is performed at 70° C. to 80° C. for 1 to 4 hours. Thereafter, it is preferable that the temperature is raised to 80° C. to 90° C., and further heat treatment is performed for 1 to 5 hours. This can reduce the residual component of the polymerization initiator, which in turn suppresses a sharp decrease in pH of the mixed dispersion due to decomposition of the initiator during the aggregation reaction. Consequently, it is possible to prevent the aggregated particles from being coarser, thus providing a toner base with a small particle size and a narrow particle size distribution.

Subsequently, it is preferable that the pH of the mixed dispersion is adjusted in the range of 9.5 to 12.2, e.g., by the addition of 1N NaOH.

After the pH adjustment, a water-soluble inorganic salt is added to the mixed dispersion, and then is heat-treated at temperatures not less than the glass transition point (Tg) of the first resin particles while stirring, so that at least the first resin particles and the pigment particles are aggregated to form the aggregated particles having a predetermined volume-average particle size of 3 to 6 μm. When the liquid in which the aggregated particles with this volume-average particle size are formed has a pH of 7.0 to 9.5, the liberation of the wax can be reduced, the particle size distribution can be narrow, and the aggregated particles are likely to be formed in the mixing and dispersing state of the resin particles and the wax. The pH may be adjusted, e.g., according to the amount of NaOH to be added, the type or amount of aggregating agent, the pH values of the emulsion-polymerized resin dispersion, the pigment particle dispersion, and the wax dispersion, a heating temperature, or time.

When the pH of the mixed dispersion is less than 9.5 before the addition of the water-soluble inorganic salt and heating, the aggregated particles to be produced become coarser, and the particle size distribution is likely to be broader. When the pH is more than 12.2, the liberated resin particles and pigment particles are increased because aggregation does not proceed easily.

When the pH of the liquid is less than 7.0 at the time of forming the aggregated particles, the aggregated particles become coarser. When the pH is more than 9.5, the liberated resin particles and pigment particles are increased due to poor aggregation.

Moreover, it is preferable that the pH of the mixture obtained by adding the second resin particle dispersion and the wax particle dispersion to the aggregated particle dispersion is adjusted in the range of 5.2 to 8.8, the mixture is then heat-treated at temperatures not less than the glass transition point of the second resin particles for 0.5 to 2 hours, the pH of the mixture is adjusted in the range of 3.2 to 6.8, and the mixture is further heat-treated at temperatures not less than the glass transition point of the second resin particles for 0.5 to 5 hours so that the second resin particles and the wax are fused with the aggregated particles. Thus, fine roughness can be formed in the surfaces of the obtained colored particles.

The purpose of these processes is as follows. Since the wax has a polarity and sharp melt property, it starts to adhere to the surfaces of the aggregated particles prior to others and is melted by adjusting the pH of the aqueous medium. The glass transition point (Tg) of the second resin particles is 30° C. to 70° C. However, unlike the wax, the resin particles do not start to melt sharply, but gradually on the surface, even if the temperature of the aqueous medium is not less than Tg of the resin particles. Therefore, the second resin particles are fused with the aggregated particles so as to cover the surface of the wax that already has been fused on the surfaces of the aggregated particles. This may facilitate the formation of fine roughness in the surfaces of the colored particles.

By adjusting the pH in the range of 5.2 to 8.8 and performing the heat treatment at temperatures not less than the glass transition point of the second resin particles for 0.5 to 2 hours, the wax adheres to the surfaces of the aggregated particles prior to others, and then the second resin particles uniformly adhere to the surface of the molten wax.

Subsequently, the pH is adjusted in the range of 3.2 to 6.8, and further heat treatment is performed at temperatures not less than the glass transition point of the second resin particles. Thus, it is possible to avoid secondary aggregation, to suppress liberation of the wax particles, and to provide the colored particles with a narrow particle size distribution by fusing the second resin particles and the wax with the aggregated particles.

When the pH after adding the second resin particle dispersion and the wax particle dispersion is less than 5.2, the second resin particles and the wax particles cannot adhere to the aggregated particles easily, and the liberated resin particles are increased. When the pH is more than 8.8, secondary aggregation of the aggregated particles is likely to occur, and another aggregation only between the second resin particles and the wax particles also is likely to occur.

When the pH after the heat treatment for 0.5 to 2 hours is less than 3.2, the resin particles that once adhered may be liberated. When the pH is more than 6.8, secondary aggregation of the aggregated particles is likely to occur.

It is preferable that a difference in volume-average particle size between the aggregated particles and the particles resulting from the fusion of the second resin particles and the wax particles with the aggregated particles is in the range of 0.5 to 2 μm. When the difference is less than 0.5 μm, the adhesion of the second resin particles and the wax particles becomes poor, and the second resin particles themselves lack strength due to the influence of moisture. When the difference is more than 2 μm, the fixability and the glossiness are reduced.

Moreover, it is also preferable that the pH of the mixture obtained by adding the resin A particle dispersion and the resin B particle dispersion to the aggregated particle dispersion is adjusted in the range of 5.2 to 8.8, the mixture is then heat-treated at temperatures not less than the glass transition point of the third resin particles for 0.5 to 2 hours, the pH of the mixture is adjusted in the range of 3.2 to 6.8, and the mixture is further heat-treated at temperatures not less than the glass transition point of the resin A particles for 0.5 to 5 hours so that the resin A particles and the resin B particles are fused with the aggregated particles. Thus, fine roughness can be formed in the surfaces of the obtained colored particles.

Alternatively, after the aggregated particles are formed by the heat treatment as described above, the fifth resin particle dispersion may be added to the aggregated particle dispersion while maintaining the temperature.

When the fifth resin particle dispersion is added to the high-temperature aggregated particle dispersion, the low molecular-weight components of the fifth resin particles start to adhere to the surfaces of the aggregated particles prior to others. Therefore, it is possible to avoid secondary aggregation of the aggregated particles and to promote the fusion of the resin particles. Since the high molecular-weight components of the fifth resin particles are to be melted late, the surfaces of the colored particles can be made rough.

After forming the colored particles, cleaning, liquid-solid separation, and drying processes may be performed as desired to provide toner. The cleaning process preferably involves sufficient substitution cleaning with ion-exchanged water in view of improving the charging characteristics. The liquid-solid separation process is not particularly limited, and any known filtration methods such as suction filtration and pressure filtration can be used preferably in view of productivity. The drying process is not particularly limited, and any known drying methods such as flash-jet drying, flow drying, and vibration-type flow drying can be used preferably in view of productivity.

As the water-soluble inorganic salt, e.g., an alkali metal salt and an alkaline-earth metal salt may be used. Examples of the alkali metal include lithium, potassium, and sodium. Examples of the alkaline-earth metal include magnesium, calcium, strontium, and barium. Among these, potassium, sodium, magnesium, calcium, and barium are preferred. As the counter ions (the anions constituting a salt) of the above alkali metals or alkaline-earth metals, e.g., a chloride ion, a bromide ion, an iodide ion, carbonate ion, or sulfate ion may be used.

Examples of the organic solvent with infinite solubility in water include methanol, ethanol, 1-propanol, 2-propanol, ethylene glycol, glycerin, and acetone. Among these, alcohols having a carbon number of not more than 3 such as methanol, ethanol, 1-propanol, and 2-propanol are preferred, and 2-propanol is particularly preferred.

As the disperser having a polarity, e.g., an aqueous medium including a polar surfactant may be used. Examples of the aqueous medium include water such as distilled water or ion-exchanged water, and alcohols. They can be used individually or in combinations of two or more. The content of the polar surfactant in the disperser having a polarity cannot be defined generally and may be selected appropriately depending on the purposes.

As the polar surfactant, e.g., a sulfate-based, sulfonate-based, phosphate-based, or soap-based anionic surfactant and an amine salt-type or quaternary ammonium salt-type cationic surfactant may be used.

Specific examples of the anionic surfactant include sodium dodecyl benzene sulfonate, sodium dodecyl sulfate, sodium alkyl naphthalene sulfonate, and sodium dialkyl sulfosuccinate. Specific examples of the cationic surfactant include lauryl amine hydrochloride, stearic acid amine hydrochloride, alkyl benzene dimethyl ammonium chloride, alkyl trimethyl ammonium chloride, and distearyl ammonium chloride. They can be used individually or in combinations of two or more.

In the present invention, these polar surfactants can be used together with a nonpolar surfactant. As the nonpolar surfactant, e.g., a polyethylene glycol-based, alkylphenol ethylene oxide adduct-based, or polyhydric alcohol-based nonionic surfactant may be used.

The wax having a low melting point should be contained uniformly in the resin so as not to be liberated or suspended during mixing and aggregation. This may be affected by the particle size distribution, composition, and melt property of the wax.

For the resin particles including a styrene-acryl copolymer, ester wax is more suitable than vinyl wax such as polypropylene or polyethylene. The ester wax does not undergo liberation or suspension during mixing and aggregation and can be contained uniformly in the resin while gathering at substantially one place. Therefore, the influence of the liberated wax can be removed. Moreover, it is possible to suppress the spent of toner on a carrier or the filming of toner on OPC or a transfer belt and to prevent reverse transfer or thinning during transfer effectively.

The wax particle dispersion may be prepared in such a manner that wax is mixed in an aqueous medium (e.g., ion-exchanged water) including a polar surfactant, and then is heated, melted, and dispersed.

In this case, the wax is emulsified and dispersed so that the particle size is 20 to 200 nm for 16% diameter (PR16), 40 to 300 nm for 50% diameter (PR50), not more than 400 nm for 84% diameter (PR84), and PR84/PR16 is 1.2 to 2.0 in the integrated distribution of a volumetric particle size measured by integrating the particle size in the order of increasing diameter. It is preferable that the particles having a diameter not greater than 200 nm is 65 vol % or more, and the particles having a diameter greater than 500 nm is 10 vol % or less.

Preferably, the particle size may be 20 to 100 nm for 16% diameter (PR16), 40 to 160 nm for 50% diameter (PR50), not more than 260 nm for 84% diameter (PR84), and PR84/PR16 is 1.2 to 1.8 in the integrated distribution of a volumetric particle size measured by integrating the particle size in the order of increasing diameter. It is preferable that the particles having a diameter not greater than 150 nm is 65 vol % or more, and the particles having a diameter greater than 400 nm is 10 vol % or less.

More preferably, the particle size may be 20 to 60 nm for 16% diameter (PR16), 40 to 120 nm for 50% diameter (PR50), not more than 220 nm for 84% diameter (PR84), and PR84/PR16 is 1.2 to 1.8 in the integrated distribution of a volumetric particle size measured by integrating the particle size in the order of increasing diameter. It is preferable that the particles having a diameter not greater than 130 nm is 65 vol % or more, and the particles having a diameter greater than 300 nm is 10 vol % or less.

When the resin particle dispersion, the pigment particle dispersion, and the wax particle dispersion are mixed together to form aggregated particles, the wax with a particle size of 40 to 300 nm for 50% diameter (PR 50) can be finely dispersed and easily incorporated into the resin particles. Therefore, it is possible to prevent aggregation of the wax with each other, to achieve uniform dispersion, and to eliminate the suspended particles in the aqueous medium.

When the particle size is more than 200 nm for PR16, more than 300 nm for PR50, and more than 400 nm for PR84, PR84/PR16 is more than 2.0, the particles having a diameter not greater than 200 nm is less than 65 vol %, and the particles having a diameter greater than 500 nm is more than 10 vol %, the wax particles are not incorporated into the resin particles easily and thus are prone to aggregation by themselves. Therefore, a large number of particles that are not incorporated into the resin particles are likely to be suspended in the aqueous medium. Moreover, the amount of wax that is exposed on the surfaces of the aggregated particles and liberated therefrom is increased while further resin particles are fused. This may increase the filming on a photoconductive member or the spent on a carrier, reduce the handling property of toner in a developing unit, and cause a developing memory.

When the particle size is less than 20 nm for PR16 and less than 40 nm for PR50, and PR84/PR16 is less than 1.2, it is difficult to maintain the dispersion state, and reaggregation of the wax occurs during the time it is allowed to stand, so that the standing stability of the particle size distribution is degraded. Moreover, the load and heat generation are increased while the particles are dispersed, thus reducing productivity.

When the particle size for 50% diameter (PR50) of the wax dispersed in the wax particle dispersion is smaller than that of the resin particles to be formed into the molten aggregated particles, the wax easily can be incorporated into the resin particles. Therefore, it is possible to prevent aggregation of the wax with each other, to achieve uniform dispersion, and to eliminate the suspended particles in the aqueous medium. This makes it easier to provide the mixing and dispersing state of the resin particles and the wax in the aqueous medium to form the molten aggregated particles. It is more preferable that the particle size for 50% diameter (PR50) of the wax is at least 20% smaller than that of the resin particles.

The wax particles can be dispersed finely in the following manner. A wax melt in which the wax is melted at a concentration of not more than 40 wt % is emulsified and dispersed into a medium that includes a disperser and is maintained at temperatures not less than the melting point of the wax by using the effect of a strong shearing force generated when a rotating body rotates at high speed relative to a fixed body with a predetermined gap between them.

Figure 3:
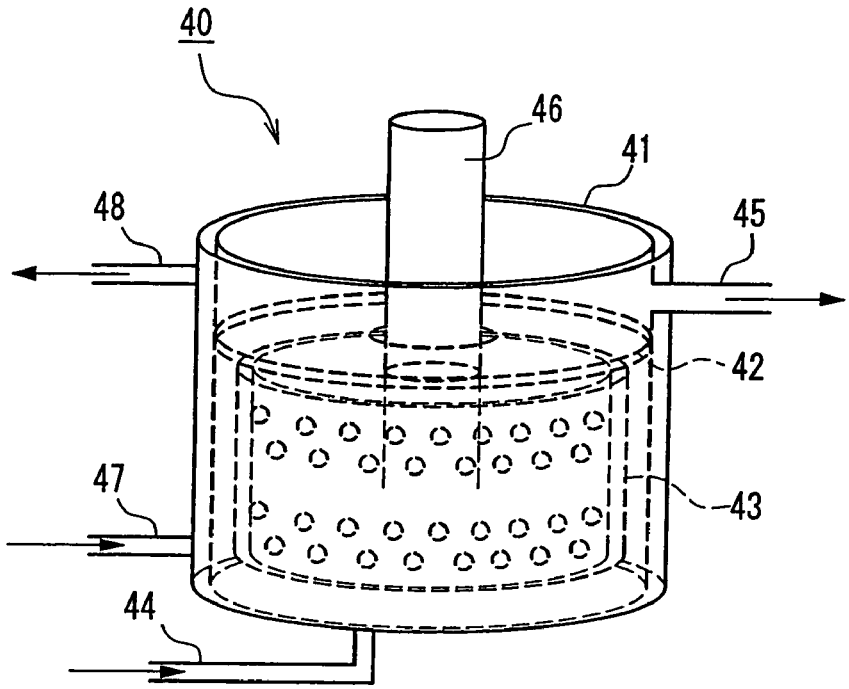
FIG. 3 is a schematic diagram of a stirring/dispersing device used in an example of the present invention.
Figure 4:
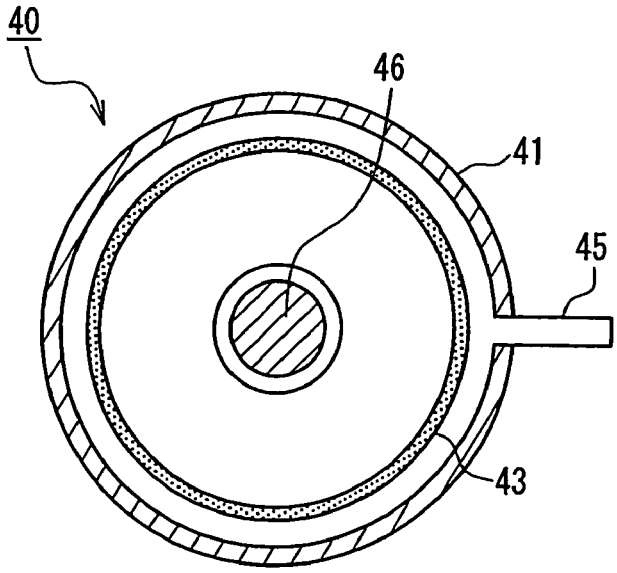
FIG. 4 is a top view of the stirring/dispersing device in FIG. 3.

As shown in FIGS. 3 and 4, e.g., a rotating body may be placed in a tank having a certain capacity so that there is a gap of about 0.1 mm to 10 mm between the side of the rotating body and the tank wall. The rotating body rotates at a high speed of not less than 30 m/s, preferably not less than 40 m/s, and more preferably not less than 50 m/s and exerts a strong shearing force on the liquid, thereby producing emulsified dispersions with a fine particle size. A 30-second to 5-minute treatment may be enough to obtain the fine dispersions.

Figure 5:
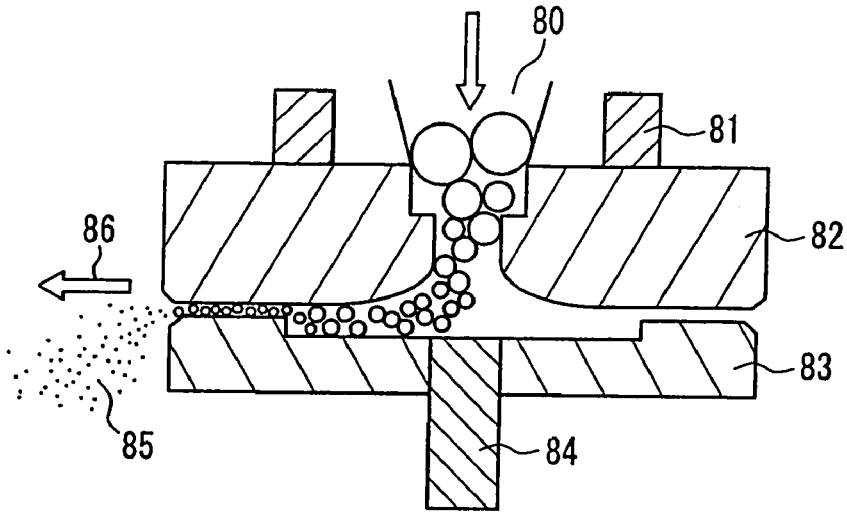
FIG. 5 is a schematic diagram of a stirring/dispersing device used in an example of the present invention.
Figure 6:
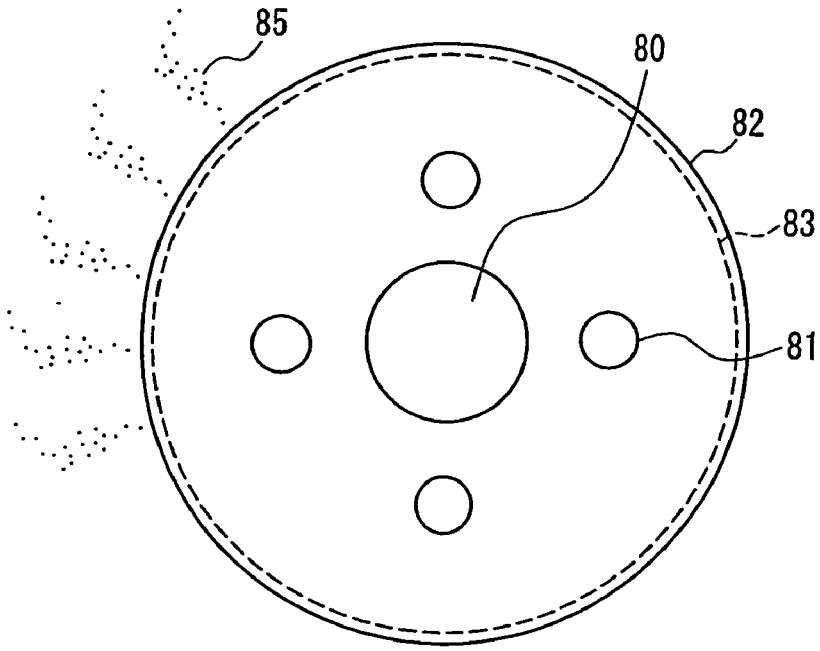
FIG. 6 is a top view of the stirring/dispersing device in FIG. 5.

As shown in FIGS. 5 and 6, e.g., a rotating body may rotate at a speed of not less than 30 m/s, preferably not less than 40 m/s, and more preferably not less than 50 m/s relative to a fixed body, while a gap of about 1 to 100 μm is kept between them. This configuration also can provide the effect of a strong shearing force, thus producing finer dispersions.

In this manner, it is possible to form a narrower and sharper particle size distribution of the fine particles than using a high-pressure dispersing device such as a high-pressure homogenizer. It is also possible to maintain a stable dispersion state without causing any reaggregation of the fine particles of the dispersions even when left standing for a long time. Thus, the standing stability of the particle size distribution can be improved.

When the wax has a high melting point, it may be heated under high pressure to form a melt. Alternatively, the wax may be dissolved in an oil solvent. This solution is blended with a surfactant or polyelectrolyte and dispersed in water to make a fine particle dispersion by using either of the dispersing devices as shown in FIGS. 3 and 4 and FIGS. 5 and 6, and then the oil solvent is evaporated by heating or under reduced pressure.

The particle size can be measured, e.g., by using a laser diffraction particle size analyzer LA920 (manufactured by Horiba, Ltd.) or SALD2100 (manufactured by Shimadzu Corporation).

(2) Wax

In the toner of this embodiment, when the second resin particle dispersion and the wax particle dispersion are mixed with the aggregated particle dispersion, and the resultant mixture is heat-treated so that the second resin particles and the wax are fused with the aggregated particles to form fused particles, the wax preferably has an iodine value of not more than 25 and a saponification value of 30 to 300. The use of this wax can prevent offset without requiring oil and achieve the oilless fixing along with low-temperature fixability, high glossiness, and high transmittance. Moreover, repulsion caused by the charging action of toner during multilayer transfer can be relieved, and thus a reduction in transfer efficiency, thinning in letters during transfer, or reverse transfer can be suppressed. By combining the wax with a carrier, which will be described later, it is possible to suppress the occurrence of spent on the carrier. Accordingly, the life of a developer can be made longer. Further, the handling property of toner in a developing unit can be improved, so that the image uniformity can be improved in both the front and back of the development. The generation of a developing memory also can be reduced.

When the iodine value is more than 25, suspended solids are increased in the aqueous medium, and uniform adhesion to the surfaces of the aggregated particles is lowered. The suspended solids remaining in toner may lead to filming on a photoconductive member or the like. This makes it difficult to relieve repulsion caused by the charging action of toner during multilayer transfer in the primary transfer process. Moreover, the environmental dependence is large, and a change in chargeability of the material is increased to impair the image stability over a long period of continuous use. Further, a developing memory can be generated easily. When the saponification value is less than 30, the presence of unsaponifiable matter and hydrocarbon is increased, resulting in filming on a photoconductive member or degradation of the chargeability of toner during continuous use. When the saponification value is more than 300, suspended solids are increased in the aqueous medium, and uniform adhesion to the surfaces of the aggregated particles is lowered. Thus, it is difficult to relieve repulsion caused by the charging action of toner during multilayer transfer. Moreover, fog or toner scattering may be increased.

The wax preferably has a heating loss of not more than 8 wt % at 220° C. When the heating loss is more than 8 wt %, the glass transition point of toner is reduced, and the storage stability of the toner is degraded. Therefore, such wax adversely affects the development property and allows fog or filming on a photoconductive member to occur. Thus, the particle size distribution of the resultant toner becomes broader.

In the molecular weight characteristics based on gel permeation chromatography (GPC), it is preferable that the number-average molecular weight is 100 to 5000, the weight-average molecular weight is 200 to 10000, the ratio (weight-average molecular weight/number-average molecular weight) of the weight-average molecular weight to the number-average molecular weight is 1.01 to 8, the ratio (Z average molecular weight/number-average molecular weight) of the Z average molecular weight to the number-average molecular weight is 1.02 to 10, and there is at least one molecular weight maximum peak in the range of $5\times10^2$ to $1\times10^4$. It is more preferable that the number-average molecular weight is 500 to 4500, the weight-average molecular weight is 600 to 9000, the weight-average molecular weight/number-average molecular weight ratio is 1.01 to 7, and the Z average molecular weight/number-average molecular weight ratio is 1.02 to 9. It is further preferable that the number-average molecular weight is 700 to 4000, the weight-average molecular weight is 800 to 8000, the weight-average molecular weight/number-average molecular weight ratio is 1.01 to 6, and the Z average molecular weight/number-average molecular weight ratio is 1.02 to 8.

When the number-average molecular weight is less than 100, the weight-average molecular weight is less than 200, and the molecular weight maximum peak is in the range smaller than $5\times10^2$, the storage stability is degraded. Moreover, the handling property of toner in a developing unit is reduced to impair the uniformity of the toner concentration. Further, the filming of toner on a photoconductive member occurs. Thus, the particle size distribution of the resultant toner becomes broader.

When the number-average molecular weight is more than 5000, the weight-average molecular weight is more than 10000, the weight-average molecular weight/number-average molecular weight ratio is more than 8, the Z average molecular weight/number-average molecular weight ratio is more than 10, and the molecular weight maximum peak is in the range larger than $1\times10^4$, the releasing action is weakened, and the fixing functions such as fixability and offset resistance are degraded. Moreover, it is difficult to produce the emulsified and dispersed particles of wax having a smaller particle size.

An endothermic peak temperature (melting point Tm w) based on a DSC method is preferably 50° C. to 100° C., more preferably 55° C. to 95° C., and further preferably 65° C. to 85° C. When the endothermic peak temperature is lower than 50° C., the storage stability of toner is degraded. When the endothermic peak temperature is higher than 100° C., it is difficult to produce the emulsified and dispersed particles of wax having a smaller particle size. Thus, uniform adhesion to the surfaces of the aggregated particles is lowered.

Moreover, the material preferably has a volume increase ratio of 2 to 30% when the temperature changes by 10° C. at temperatures not less than the melting point. The rapid expansion in changing from solid to liquid strengthens the adhesion between toner particles when the toner is melted by heat for fixing, thus resulting in improved fixability, a better releasing property with respect to the fixing roller, and improved offset resistance.

The amount of wax added is preferably 2 to 90 parts by weight, more preferably 5 to 80 parts by weight, further preferably 10 to 50 parts by weight, and most preferably 15 to 20 parts by weight per 100 parts by weight of binder resin. When it is less than 2 parts by weight, the effect of improving the fixability cannot be displayed. When it is more than 90 parts by weight, the storage stability is a problem.

Preferred materials for the wax may be, e.g., meadowfoam oil, jojoba oil, Japan wax, beeswax, ozocerite, carnauba wax, candelilla wax, ceresin wax, rice wax, and derivatives thereof. They can be used individually or in combinations of two or more.

Preferred examples of the meadowfoam oil derivative include meadowfoam oil fatty acid, a metal salt of the meadowfoam oil fatty acid, meadowfoam oil fatty acid ester, hydrogenated meadowfoam oil, meadowfoam oil amide, homomeadowfoam oil amide, meadowfoam oil triester, a maleic acid derivative of epoxidized meadowfoam oil, an isocyanate polymer of meadowfoam oil fatty acid polyol ester, and halogenated modified meadowfoam oil. With these materials, it is possible to produce an emulsified dispersion having a small particle size and a uniform particle size distribution. Therefore, uniform adhesion to the surfaces of the aggregated particles can be achieved. Moreover, the above materials are effective to perform the oilless fixing, to increase the life of a developer, and to improve the transfer property. They can be used individually or in combinations of two or more.

The meadowfoam oil fatty acid obtained by saponifying meadowfoam oil preferably includes fatty acid having 4 to 30 carbon atoms. As a metal salt thereof, e.g., metal salts of sodium, potassium, calcium, magnesium, barium, zinc, lead, manganese, iron, nickel, cobalt, aluminum or the like can be used. With these materials, high-temperature offset resistance can be improved.

Preferred examples of the meadowfoam oil fatty acid ester include methyl, ethyl, butyl, and esters of glycerin, pentaerythritol, polypropylene glycol and trimethylol propane. In particular, e.g., meadowfoam oil fatty acid pentaerythritol monoester, meadowfoam oil fatty acid pentaerythritol triester, or meadowfoam oil fatty acid trimethylol propane ester is preferred. With these materials, cold offset resistance as well as high-temperature offset resistance can be improved.

Moreover, isocyanate polymer of meadowfoam oil fatty acid polyol ester, obtained by cross-linking a product from an esterification reaction between meadowfoam oil fatty acid and polyhydric alcohol such as glycerin, pentaerythritol and trimethylol propane with isocyanate such as tolylene diisocyanate (TDI), diphenylmethane-4,4'-diisocyanate (MDI) or the like, can be used preferably. This can reduce the spent on a carrier, thus making the life of a two-component developer even longer.

The hydrogenated meadowfoam oil can be obtained by adding hydrogen to meadowfoam oil to convert unsaturated bonds to saturated bonds. This can improve the offset resistance, glossiness, and transmittance.

The meadowfoam oil amide can be obtained in such a manner that meadowfoam oil is hydrolyzed and then esterified to produce fatty acid methyl ester, and the fatty acid methyl ester reacts with a mixture of concentrated ammonia water and ammonium chloride. Further, the melting point can be adjusted by adding hydrogen to this product. It is also possible to add hydrogen before hydrolysis. A product having a melting point of 75° C. to 120° C. may be obtained. The homomeadowfoam oil amide can be obtained by hydrolyzing meadowfoam oil, and reducing to alcohol that is converted to nitrile thereafter. This can improve the offset resistance, glossiness, and transmittance.

Preferred examples of the jojoba oil derivative include jojoba oil fatty acid, a metal salt of the jojoba oil fatty acid, jojoba oil fatty acid ester, hydrogenated jojoba oil, jojoba oil amide, homojojoba oil amide, jojoba oil triester, a maleic acid derivative of epoxidized jojoba oil, an isocyanate polymer of jojoba oil fatty acid polyol ester, and halogenated modified jojoba oil. With these materials, it is possible to produce an emulsified dispersion having a small particle size and a uniform particle size distribution. Therefore, uniform adhesion to the surfaces of the aggregated particles can be achieved. The resin particles and the wax can be mixed and dispersed uniformly. Moreover, the above materials are effective to perform the oilless fixing, to increase the life of a developer, and to improve the transfer property. They can be used individually or in combinations of two or more.

The jojoba oil fatty acid obtained by saponifying jojoba oil preferably includes fatty acid having 4 to 30 carbon atoms. As a metal salt thereof, e.g., metal salts of sodium, potassium, calcium, magnesium, barium, zinc, lead, manganese, iron, nickel, cobalt, aluminum or the like can be used. With these materials, high-temperature offset resistance can be improved.

Preferred examples of the jojoba oil fatty acid ester include methyl, ethyl, butyl, and esters of glycerin, pentaerythritol, polypropylene glycol and trimethylol propane. In particular, e.g., jojoba oil fatty acid pentaerythritol monoester, jojoba oil fatty acid pentaerythritol triester, or jojoba oil fatty acid trimethylol propane ester is preferred. With these materials, cold offset resistance as well as high-temperature offset resistance can be improved.

Moreover, isocyanate polymer of jojoba oil fatty acid polyol ester, obtained by cross-linking a product from an esterification reaction between jojoba oil fatty acid and polyhydric alcohol such as glycerin, pentaerythritol and trimethylol propane with isocyanate such as tolylene diisocyanate (TDI), diphenylmethane-4,4'-diisocyanate (MDI) or the like, can be used preferably. This can reduce the spent on a carrier, thus making the life of a two-component developer even longer.

The hydrogenated jojoba oil can be obtained by adding hydrogen to jojoba oil to convert unsaturated bonds to saturated bonds. This can improve the offset resistance, glossiness, and transmittance.

The jojoba oil amide can be obtained in such a manner that jojoba oil is hydrolyzed and then esterified to produce fatty acid methyl ester, and the fatty acid methyl ester reacts with a mixture of concentrated ammonia water and ammonium chloride. Further, the melting point can be adjusted by adding hydrogen to this product. It is also possible to add hydrogen before hydrolysis. A product having a melting point of 75° C. to 120° may be obtained. The homojojoba oil amide can be obtained by hydrolyzing jojoba oil, and reducing to alcohol that is converted to nitrile thereafter. This can improve the offset resistance, glossiness, and transmittance.

The saponification value is the milligrams of potassium hydroxide (KOH) required to saponify 1 g sample and corresponds to the sum of an acid value and an ester value. When the saponification value is measured, a sample is saponified with approximately 0.5N potassium hydroxide in an alcohol solution, and then excessive potassium hydroxide is titrated with 0.5N hydrochloric acid.

The iodine value may be determined in the following manner. The amount of halogen absorbed by a sample is measured while the halogen acts on the sample. Then, the amount of halogen absorbed is converted to iodine and expressed in grams per 100 g of the sample. The iodine value is grams of iodine absorbed by 100 g fat, and the degree of unsaturation of fatty acid in the sample increases with the iodine value. A chloroform or carbon tetrachloride solution is prepared as a sample, and an alcohol solution of iodine and mercuric chloride or a glacial acetic acid solution of iodine chloride is added to the sample. After the sample is allowed to stand, the iodine that remains without causing any reaction is titrated with a sodium thiosulfate standard solution, thus calculating the amount of iodine absorbed.

The heating loss may be measured in the following manner. A sample cell is weighed precisely to the first decimal place (W1 mg). Then, 10 to 15 mg of sample is placed in the sample cell and weighed precisely to the first decimal place (W2 mg). This sample cell is set in a differential thermal balance and measured with a weighing sensitivity of 5 mg. After measurement, the weight loss (W3 mg) of the sample at 220° C. is read to the first decimal place using a chart. When the measuring device is, e.g., TGD-3000 (manufactured by ULVAC-RICO, Inc.), the rate of temperature rise is 10° C./min, the maximum temperature is 220° C., and the retention time is 1 min, the heating loss (%) can be determined by $W3/(W2-W1)\times100$.

Thus, the transmittance in color images and the offset resistance can be improved. Moreover, it is possible to suppress the occurrence of spent on a carrier and to increase the life of a developer.

The wax used in the toner of this embodiment preferably has an acid value of 10 to 80 mgKOH/g and includes at least a long chain alkyl group having a carbon number of 4 to 30, an ester group, and a vinyl group.

It is preferable that this wax is obtained by the reaction between long chain alkyl alcohol having a carbon number of 4 to 30 and unsaturated polycarboxylic acid or its anhydride and unsaturated hydrocarbon wax.

The wax also may be obtained by the reaction between long chain alkylamine and unsaturated polycarboxylic acid or its anhydride and unsaturated hydrocarbon wax. Alternatively, the wax may be obtained by the reaction between long chain fluoroalkyl alcohol and unsaturated polycarboxylic acid or its anhydride and unsaturated hydrocarbon wax. In either case, the long chain alkyl group can promote the releasing action, the ester group can improve the dispersibility of the wax with the resin, and the vinyl group can enhance the durability and the offset resistance.

In the molecular weight distribution of this wax based on GPC, it is preferable that the weight-average molecular weight is 1000 to 6000, the Z average molecular weight is 1500 to 9000, the ratio (weight-average molecular weight/number-average molecular weight) of the weight-average molecular weight to the number-average molecular weight is 1.1 to 3.8, the ratio (Z average molecular weight/number-average molecular weight) of the Z average molecular weight to the number-average molecular weight is 1.5 to 6.5, there is at least one molecular weight maximum peak in the range of $1\times10^3$ to $3\times10^4$, the acid value is 10 to 80 mgKOH/g, the melting point is 50° C. to 120° C., and the penetration number is not more than 4 at 25° C. A penetration test is one of the methods for measuring the consistency of a material and is standardized under JIS (Japan Industrial Standard) K2207. For example, the consistency of a sample is determined by measuring the distance that a standard needle penetrates the sample perpendicularly under the conditions of 25° C., a full load of 100 g, and 5 sec. The penetration number is 1 for 1/10 mm. The flexibility of a material increases with increasing the penetration number.

It is more preferable that the weight-average molecular weight is 1000 to 5000, the Z average molecular weight is 1700 to 8000, the weight-average molecular weight/number-average molecular weight ratio is 1.1 to 2.8, the Z average molecular weight/number-average molecular weight ratio is 1.5 to 4.5, there is at least one molecular weight maximum peak in the range of $1\times10^3$ to $1\times10^4$, the acid value is 10 to 50 mgKOH/g, and the melting point is 60° C. to 110° C.

It is further preferable that the weight-average molecular weight is 1000 to 2500, the Z average molecular weight is 1900 to 3000, the weight-average molecular weight/number-average molecular weight ratio is 1.2 to 1.8, the Z average molecular weight/number-average molecular weight ratio is 1.7 to 2.5, there is at least one molecular weight maximum peak in the range of $1\times10^3$ to $3\times10^3$, the acid value is 35 to 50 mgKOH/g, and the melting point is 65° C. to 95° C.

The wax with the above molecular weight distributions can contribute to higher offset resistance, glossiness, and OHP transmittance in the oilless fixing. Moreover, the wax does not decrease the storage stability at high temperatures. When an image is formed by arranging three layers of color toner on a thin paper, the wax is particularly effective to improve the separatability of the paper from the fixing roller or belt.

Also, the wax can be produced in small particles that are emulsified and dispersed uniformly in a disperser having a polarity. Therefore, the wax can be mixed and aggregated uniformly with the resin particles and the pigment particles. This can eliminate the suspended solids, thereby suppressing a dull color. Moreover, uniform adhesion to the surfaces of the aggregated particles can be achieved. The use of this wax can prevent offset without requiring oil and achieve the oilless fixing along with low-temperature fixability, high glossiness, and high transmittance.

By combining the wax with a carrier, which will be described later, it is possible not only to achieve the oilless fixing but also to suppress the occurrence of spent on the carrier. Accordingly, the life of a developer can be made longer. While the uniformity of toner in a developing unit can be maintained, the generation of a developing memory also can be reduced. Further, the charge stability can be maintained during continuous use, which ensures compatibility between the fixability and the development stability.

When the carbon number of the long chain alkyl group of the wax is less than 4, the releasing action is weakened, so that the separatability and the high-temperature offset resistance are degraded. When the carbon number is more than 30, the mixing and aggregation of the wax with the resin particles become poor, resulting in low dispersibility. When the acid value is less than 10 mgKOH/g, the amount of charge of toner is reduced over a long period of use. When the acid value is more than 80 mgKOH/g, the moisture resistance is decreased to increase fog under high humidity. Moreover, it is difficult to reduce the particle size of the emulsified and dispersed particles of the wax. Thus, uniform adhesion to the surfaces of the aggregated particles is lowered.

When the melting point is less than 50° C., the storage stability of toner is degraded. When the melting point is more than 120° C., the releasing action is weakened, and the temperature range of offset resistance is narrowed. Moreover, it is difficult to reduce the particle size of the emulsified and dispersed particles of the wax.

When the penetration number is more than 4 at 25° C., the toughness is reduced to cause filming on a photoconductive member over a long period of use.

When the weight-average molecular weight is less than 1000, the Z average molecular weight is less than 1500, the weight-average molecular weight/number-average molecular weight ratio is less than 1.1, the Z average molecular weight/number-average molecular weight ratio is less than 1.5, and the molecular weight maximum peak is in the range smaller than $1\times10^3$, the storage stability of toner is degraded, thus causing filming on a photoconductive member or intermediate transfer member. Moreover, the handling property of toner in a developing unit is reduced to impair the uniformity of the toner concentration. Further, a developing memory can be generated easily. Thus, when emulsified and dispersed particles are produced under the strong shearing force of a high-speed rotating body, the particle size distribution becomes broader.

When the weight-average molecular weight is more than 6000, the Z average molecular weight is more than 9000, the weight-average molecular weight/number-average molecular weight ratio is more than 3.8, the Z average molecular weight/number-average molecular weight ratio is more than 6.5, and the molecular weight maximum peak is in the range larger than $3\times10^4$, the releasing action is weakened, and the fixing functions are degraded. Moreover, it is difficult to reduce the particle size of the emulsified and dispersed particles of the wax.

Examples of the alcohol include alcohols having a long alkyl chain such as octanol, dodecanol, stearyl alcohol, nonacosanol, and pentadecanoyl. Examples of the amines include N-methylhexylamine, nonylamine, stearylamine, and nonadecylamine. Examples of the fluoroalkyl alcohol include 1-methoxy-(perfluoro-2-methyl-1-propene), hexafluoro ace tone, and 3-perfluorooctyl-1,2-epoxypropane. Examples of the unsaturated polycarboxylic acid or its anhydride include maleic acid, maleic anhydride, itaconic acid, itaconic anhydride, citraconic acid, and citraconic anhydride. They can be used individually or in combinations of two or more. In particular, the maleic acid and the maleic anhydride are preferred. Examples of the unsaturated hydrocarbon wax include ethylene, propylene, and α-olefin.

The wax can be produced in the following manner. The unsaturated polycarboxylic acid or its anhydride is polymerized using alcohol or amine, and then is added to a synthetic hydrocarbon wax in the presence of dicumyl peroxide or tert-butylperoxy isopropyl monocarbonate.

Preferred materials for the wax used in the toner of this embodiment may be, e.g., a derivative of hydroxystearic acid, glycerin fatty acid ester, glycol fatty acid ester, or sorbitan fatty acid ester. They can be used individually or in combinations of two or more. The wax including these materials can be produced in small particles that are emulsified and dispersed uniformly. Therefore, uniform adhesion to the surfaces of the aggregated particles can be achieved. The use of this wax can prevent offset without requiring oil and achieve the oilless fixing along with low-temperature fixability, high glossiness, and high transmittance. Moreover, it is possible not only to achieve the oilless fixing but also to increase the life of a developer. While the uniformity of toner in a developing unit can be maintained, the generation of a developing memory also can be reduced.

Preferred examples of the derivative of hydroxystearic acid include methyl 12-hydroxystearate, butyl 12-hydroxystearate, propylene glycol mono 12-hydroxystearate, glycerin mono 12-hydroxystearate, and ethylene glycol mono 12-hydroxystearate. These materials have the effects of preventing filming and winding of paper in the oilless fixing.

Preferred examples of the glycerin fatty acid ester include glycerin stearate, glycerin distearate, glycerin tristearate, glycerin monopalmitate, glycerin dipalmitate, glycerin tripalmitate, glycerin behenate, glycerin dibehenate, glycerin tribehenate, glycerin monomyristate, glycerin dimyristate, and glycerin trimyristate. These materials have the effects of relieving cold offset at low temperatures in the oilless fixing and preventing a reduction in transfer property.

Preferred examples of the glycol fatty acid ester include propylene glycol fatty acid ester such as propylene glycol monopalmitate or propylene glycol monostearate and ethylene glycol fatty acid ester such as ethylene glycol monostearate or ethylene glycol monopalmitate. These materials have the effects of improving the oilless fixability and preventing the spent on a carrier while increasing the sliding property during development.

Preferred examples of the sorbitan fatty acid ester include sorbitan monopalmitate, sorbitan monostearate, sorbitan tripalmitate, and sorbitan tristearate. Moreover, stearic acid ester of pentaerythritol, mixed esters of adipic acid and stearic acid or oleic acid, and the like are preferred. They can be used individually or in combinations of two or more. These materials have the effects of preventing filming and winding of paper in the oilless fixing.

The wax used in the toner of this embodiment may include aliphatic amide wax. This wax can be produced in small particles that are emulsified and dispersed uniformly. Therefore, uniform adhesion to the surfaces of the aggregated particles can be achieved. The use of this wax can prevent offset without requiring oil and achieve the oilless fixing along with low-temperature fixability, high glossiness, and high transmittance. Moreover, it is possible not only to achieve the oilless fixing but also to increase the life of a developer. While the uniformity of toner in a developing unit can be maintained, the generation of a developing memory also can be reduced.

The wax also can enhance transmittance for color images. In particular, the smoothness of the surface of a fixed image can be increased, thus producing high-quality color images. Moreover, the wax can prevent winding of paper (copy paper) around the fixing roller during fixing, ensure compatibility between the transmittance and the offset resistance, and suppress thinning during transfer.

Examples of the aliphatic amide wax include saturated or mono-unsaturated aliphatic amide having a carbon number of 4 to 30 such as palmitic acid amide, palmitoleic acid amide, stearic acid amide, oleic acid amide, arachidic acid amide, eicosanoic acid amide, behenic acid amide, erucic acid amide, or lignoceric acid amide. The melting point is preferably 50° C. to 120° C., more preferably 70° C. to 100° C., and further preferably 75° C. to 95° C. When the melting point is less than 50° C., the storage stability of toner is degraded, and the filming on a photoconductive member is likely to occur. When the melting point is more than 120° C., it is difficult to reduce the particle size of the emulsified and dispersed particles of the wax. Thus, uniform adhesion to the surfaces of the aggregated particles is lowered. This may reduce the smoothness of the surface of a fixed image, resulting in poor transmittance.

The amount of wax added is preferably 2 to 90 parts by weight, more preferably 5 to 50 parts by weight, further preferably 10 to 30 parts by weight, and most preferably 15 to 20 parts by weight per 100 parts by weight of binder resin. When it is less than 2 parts by weight, the effect of improving the fixability cannot be displayed. When it is more than 90 parts by weight, the storage stability is a problem.

Moreover, the wax used in the toner of this embodiment also may include wax made of saturated or mono- and di-unsaturated alkylenebis fatty acid amide such as methylenebis stearic acid amide, ethylenebis stearic acid amide, propylenebis stearic acid amide, butylenebis stearic acid amide, methylenebis oleic acid amide, ethylenebis oleic acid amide, propylenebis oleic acid amide, butylenebis oleic acid amide, methylenebis lauric acid amide, ethylenebis lauric acid amide, propylenebis lauric acid amide, butylenebis lauric acid amide, methylenebis myristic acid amide, ethylenebis myristic acid amide, propylenebis myristic acid amide, butylenebis myristic acid amide, methylenebis palmitic acid amide, ethylenebis palmitic acid amide, propylenebis palmitic acid amide, butylenebis palmitic acid amide, methylenebis palmitoleic acid amide, ethylenebis palmitoleic acid amide, propylenebis palmitoleic acid amide, butylenebis palmitoleic acid amide, methylenebis arachidic acid amide, ethylenebis arachidic acid amide, propylenebis arachidic acid amide, butylenebis arachidic acid amide, methylenebis eicosanoic acid amide, ethylenebis eicosanoic acid amide, propylenebis eicosanoic acid amide, butylenebis eicosanoic acid amide, methylenebis behenic acid amide, ethylenebis behenic acid amide, propylenebis behenic acid amide, butylenebis behenic acid amide, methylenebis erucic acid amide, ethylenebis erucic acid amide, propylenebis erucic acid amide, and butylenebis erucic acid amide.

The melting point is preferably 50° C. to 120° C., more preferably 70° C. to 100° C., and further preferably 75° C. to 95° C. When the melting point is less than 50° C., the storage stability of toner is degraded, and the filming on a photoconductive member is likely to occur. When the melting point is more than 120° C., it is difficult to reduce the particle size of the emulsified and dispersed particles of the wax. Thus, uniform adhesion to the surfaces of the aggregated particles is lowered. This may reduce the smoothness of the surface of a fixed image, resulting in poor transmittance.

The amount of wax added is preferably 2 to 90 parts by weight, more preferably 5 to 50 parts by weight, further preferably 10 to 30 parts by weight, and most preferably 15 to 20 parts by weight per 100 parts by weight of binder resin. When it is less than 2 parts by weight, the effect of improving the fixability cannot be displayed. When it is more than 90 parts by weight, the storage stability is a problem.

(3) Resin

As the resin particles of the toner of this embodiment, e.g., a thermoplastic binder resin can be used. Specific examples of the thermoplastic binder resin include the following: styrenes such as styrene, parachloro styrene, and α-methyl styrene; acrylic monomers such as methyl acrylate, ethyl acrylate, n-propyl acrylate, lauryl acrylate, and 2-ethylhexyl acrylate; methacrylic monomers such as methyl methacrylate, ethyl methacrylate, n-propyl methacrylate, lauryl methacrylate, and 2-ethylhexyl methacrylate; ethylene-unsaturated acid monomers such as acrylic acid, methacrylic acid, and sodium styrenesulfonate; vinyl nitriles such as acrylonitrile and methacrylonitrile; vinyl ethers such as vinyl methylether and vinyl isobutylether; vinyl ketones such as vinyl methyl ketone, vinyl ethylketone, and vinyl isopropenylketone; and olefins such as ethylene, propylene, and butadiene, and a homopolymer, a copolymer, or a mixture of these substances (monomers). The specific examples further may include a non-vinyl condensed resin such an epoxy resin, a polyester resin, a polyurethane resin, a polyamide resin, a cellulose resin, or a polyether resin, a mixture of the non-vinyl condensed resin and any of the vinyl resins as described above, and a graft copolymer formed by polymerization of vinyl monomers in the presence of the non-vinyl condensed resin.

Among these resins, the vinyl resin is preferred particularly. The vinyl resin is advantageous in that a resin particle dispersion can be prepared easily, e.g., by emulsion polymerization or seed polymerization using an ionic surfactant. Examples of the vinyl monomer include a monomer to be used as a material for a vinyl polymer acid or a vinyl polymer base, such as acrylic acid, methacrylic acid, maleic acid, cinnamic acid, fumaric acid, vinyl sulfonic acid, ethylene imine, vinyl pyridine, or vinyl amine. In the present invention, the resin particles preferably contain the vinyl monomer as a monomer component. In the present invention, the vinyl polymer acid is more preferred among the vinyl monomers in view of ease of the vinyl resin formation reaction. Specifically, a dissociating vinyl monomer having a carboxyl group as a dissociation group such as acrylic acid, methacrylic acid, maleic acid, cinnamic acid, or fumaric acid is preferred particularly in view of controlling the polymerization degree or the glass transition point.

The content of resin particles in the resin particle dispersion is generally 5 to 50 wt %, and preferably 10 to 30 wt %. The molecular weights of the resin, wax, and toner can be measured by gel permeation chromatography (GPC) using several types of monodisperse polystyrene as a standard sample.

The measurement may be performed with HPLC 8120 series manufactured by TOSOH CORP., using TSK gel super HM-H H4000/H3000/H2000 (7.8 mm diameter, 150 mm×3) as a column and THF (tetrahydrofuran) as an eluent, at a flow rate of 0.6 mL/min, a sample concentration of 0.1%, an injection amount of 20 μL, RI as a detector, and at a temperature of 40° C. Prior to the measurement, the sample is dissolved in THF, and then is filtered through a 0.45 μm filter so that additives such as silica are removed to measure the resin component. The measurement requirement is that the molecular weight distribution of the subject sample is in the range where the logarithms and the count numbers of the molecular weights in the analytical curve obtained from the several types of monodisperse polystyrene standard samples form a straight line.

The wax obtained by the reaction between long chain alkyl alcohol having a carbon number of 4 to 30 and unsaturated polycarboxylic acid or its anhydride and unsaturated hydrocarbon wax can be measured with GPC-150C (manufactured by Waters Corporation), using Shodex HT-806M (8.0 mml.D.–30 cm×2) as a column and o-dichlorobenzene as an eluent, at a flow rate of 1.0 mL/min, a sample concentration of 0.3%, an injection amount of 200 μL, RI as a detector, and at a temperature of 130° C. Prior to the measurement, the sample is dissolved in a solvent, and then is filtered through a 0.5 μm sintered metal filter. The measurement requirement is that the molecular weight distribution of the subject sample is in the range where the logarithms and the count numbers of the molecular weights in the analytical curve obtained from the several types of monodisperse polystyrene standard samples form a straight line.

The softening point of the binder resin can be measured with a capillary rheometer flow tester (CFT-500, constant-pressure extrusion system, manufactured by Shimadzu Corporation). A load of about $9.8\times10^5$ N/m$^2$ is applied to a 1 cm$^3$ sample by a plunger while heating the sample at a temperature increase rate of 6° C./min, so that the sample is extruded from a die having a diameter of 1 mm and a length of 1 mm. Based on the relationship between the piston stroke of the plunger and the temperature increase characteristics, when the temperature at which the piston stroke starts to rise is a flow start temperature (Tfb), one-half the difference between the minimum value of a curve and the flow end point is determined. Then, the resultant value and the minimum value of the curve are added to define a point, and the temperature of this point is identified as a melting point (softening point Tm) according to a ½ method.

The glass transition point of the resin can be measured with a differential scanning calorimeter (DSC-50 manufactured by Shimadzu Corporation). The temperature of a sample is raised to 100° C., retained for 3 minutes, and reduced to room temperature at 10° C./min. Subsequently, the temperature is raised at 10° C./min, and a thermal history of the sample is measured. In the thermal history, an intersection point of an extension line of the base line lower than a glass transition point and a tangent that shows the maximum inclination between the rising point and the highest point of a peak is determined. The temperature of this intersection point is identified as a glass transition point.

The melting point of the wax at an endothermic peak based on a DSC method can be measured with a differential scanning calorimeter (DSC-50 manufactured by Shimadzu Corporation). The temperature of a sample is raised to 200° C. at 5° C./min, retained for 5 minutes, and reduced to 10° C. rapidly. Subsequently, the sample is allowed to stand for 15 minutes, and the temperature is raised at 5° C./min. Then, the melting point is determined from the endothermic (melt) peak. The amount of the sample placed in a cell is 10 mg±2 mg.

(4) Charge Control Agent

The charge control agent may be, e.g., an acrylic/sulfonic acid polymer, and preferably a vinyl copolymer of a styrene monomer and an acrylic acid monomer having a sulfonic group as a polar group. In particular, an acrylamide-2-methylpropane sulfonic acid copolymer can provide favorable characteristics. By combining the charge control agent with a carrier, which will be described later, the handling property of toner in a developing unit can be improved, thus improving the uniformity of the toner concentration. The generation of a developing memory also can be reduced. Preferred materials may include, e.g., a metal salt of a salicylic acid derivative. Such a material can suppress image variations caused by the charging action during fixing. This feature is attributed to the effect of the charge polarity of the functional group having an acid value of the wax and the metal salt. Moreover, it is possible to prevent a decrease in charge amount during continuous use. The charge control agent may be melted with resin monomers (e.g., styrene monomers are appropriate) in emulsion polymerization. Therefore, when the monomers are polymerized, a resin particle dispersion including the charge control agent can be produced. The amount of charge control agent added is preferably 0.1 to 5 parts by weight, more preferably 0.1 to 2 parts by weight, and further preferably 0.5 to 1.5 parts by weight per 100 parts by weight of resin. When it is less than 0.1 parts by weight, the charge effect is lost. When it is more than 5 parts by weight, uniform dispersion cannot be achieved, and color images are prone to a dull color.

(5) Pigment

The pigment used in this embodiment may include, e.g., carbon black, iron black, graphite, nigrosin, a metal complex of azo dyes, acetoacetic acid aryl amide monoazo yellow pigments such as C. I. Pigment Yellow 1, 3, 74, 97, and 98, acetoacetic acid aryl amide diazo yellow pigments such as C. I. Pigment Yellow 12, 13, 14, and 17, C. I. Solvent Yellow 19, 77, and 79, or C. I. Disperse Yellow 164. In particular, benzimidazolone pigments of C. I. Pigment Yellow 93, 180, and 185 are preferred.

The pigment further may include at least one selected from red pigments such as C. I. Pigment Red 48, 49:1, 53:1, 57, 57:1, 81, 122, and 5, red dyes such as C. I. Solvent Red 49, 52, 58, and 8, and blue pigments of phthalocyanine and its derivative such as C. I. Pigment Blue 15:3. The amount of pigment added is preferably 3 to 8 parts by weight per 100 parts by weight of binder resin.

The median diameter of the pigment particle is generally not more than 1 μm, and preferably 0.01 to 1 μm. When the median diameter is more than 1 μm, toner for electrostatic charge image development to be obtained as a final product can have a broader particle size distribution. Moreover, liberated particles are generated and tend to reduce the performance or reliability. When the median diameter is within the above range, these disadvantages are eliminated, and the uneven distribution of toner is decreased. Therefore, the dispersion of the pigment particles in toner can be improved, resulting in a smaller variation in performance and reliability. The median diameter can be measured, e.g., by a laser diffraction particle size analyzer (LA 920 manufactured by Horiba, Ltd.).

(6) External Additive

In this embodiment, inorganic fine powder is mixed as an external additive. Examples of the inorganic fine powder include metal oxide fine powder such as silica, alumina, titanium oxide, zirconia, magnesia, ferrite, or magnetite, titanate such as barium titanate, calcium titanate, or strontium titanate, zirconate such as barium zirconate, calcium zirconate, or strontium zirconate, and a mixture of these substances. The inorganic fine powder can be made hydrophobic as needed.

A preferred silicone oil material that is used to treat the inorganic fine powder is expressed by Formula (a).

Formula (a):

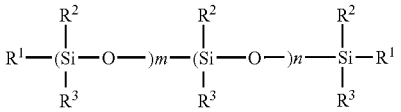

(where $R^2$ is an alkyl group having a carbon number of 1 to 3, $R^3$ is an alkyl group having a carbon number of 1 to 3, a halogen modified alkyl group, a phenyl group, or a substituted phenyl group, $R^1$ is an alkyl group having a carbon number of 1 to 3 or an alkoxy group having a carbon number of 1 to 3, and m and m are integers of 1 to 100).

Examples of the silicone oil material include dimethyl silicone oil, methyl hydrogen silicone oil, methyl phenyl silicone oil, cyclic dimethyl silicone oil, epoxy modified silicone oil, carboxyl modified silicone oil, carbinol modified silicone oil, methacrylic modified silicone oil, mercapto modified silicone oil, polyether modified silicone oil, methyl styryl modified silicone oil, alkyl modified silicone oil, fluorine modified silicone oil, amino modified silicone oil, and chlorophenyl modified silicone oil. The inorganic fine powder that is treated with at least one of the above silicone oil materials is used preferably. For example, products by Toray-Dow Corning Co., Ltd., SH200, SH510, SF230, SH203, BY16-823, BY16-855B, and the like are preferred. The treatment may be performed by mixing the inorganic fine powder with the silicone oil material using a mixer (e.g., a Henshel mixer). Moreover, the silicone oil material may be spayed to the inorganic fine powder. Alternatively, the silicone oil material may be dissolved or dispersed in a solvent, and mixed with the inorganic fine powder, followed by removal of the solvent. The amount of silicone oil material is preferably 1 to 20 parts by weight per 100 parts by weight of inorganic fine powder.

Examples of a silane coupling agent include dimethyl dichlorosilane, trimethyl chlorosilane, allyldimethyl chlorosilane, hexamethyl disilazane, allylphenyl dichlorosilane, benzyl methyl chlorosilane, vinyl triethoxysilane, γ-methacryl oxypropyl trimethoxysilane, vinyl triacetoxysilane, divinyl chlorosilane, and dimethyl vinyl chlorosilane. The silane coupling agent may be treated by a dry treatment in which the inorganic fine powder is fluidized by agitation or the like, and an evaporated silane coupling agent is reacted with the fluidized powder, or a wet treatment in which a silane coupling agent dispersed in a solvent is added dropwise to the inorganic fine powder.

It is also preferable that the silicone oil material is treated after a silane coupling treatment.

The inorganic fine powder having positive chargeability may be treated with aminosilane, amino modified silicone oil expressed by Formula (b), or epoxy modified silicone oil.

Formula (b):

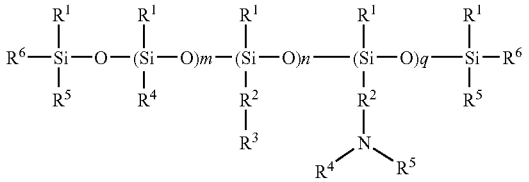

(where $R^1$ and $R^6$ are hydrogen, an alkyl group having a carbon number of 1 to 3, an alkoxy group, or an aryl group, $R^2$ is an alkylene group having a carbon number of 1 to 3 or a phenylene group, $R^3$ is an organic group including a nitrogen heterocyclic ring, $R^4$ and $R^5$ are hydrogen, an alkyl group having a carbon number of 1 to 3, or an aryl group, m is positive numbers of not less than 1, n and q are positive integers including 0, and n+1 is positive numbers of not less than 1).

To enhance a hydrophobic treatment, hexamethyldisilazane, dimethyldichlorosilane, or other silicone oil also can be used along with the above materials. For example, at least one selected from dimethyl silicone oil, methylphenyl silicone oil, and alkyl modified silicone oil is preferred to treat the inorganic fine powder.

Fatty acid ester, fatty acid amide, and a fatty acid metal salt also can be used to treat the surface of the inorganic fine powder, and silica or titanium oxide fine powder whose surface is treated with at lease one of these materials is more preferred.

Examples of the fatty acid and the fatty acid metal salt include caprylic acid, capric acid, undecylic acid, lauric acid, myristic acid, palmitic acid, stearic acid, behenic acid, montanic acid, lacceric acid, oleic acid, erucic acid, sorbic acid, and linoleic acid. In particular, fatty acid having a carbon number of 14 to 20 is preferred.

Preferred metals of the fatty acid metal salt may be, e.g., aluminum, zinc, calcium, magnesium, lithium, sodium, lead, or barium. Among these metals, aluminum, zinc, and sodium are more preferred. Further, mono- and di-fatty acid aluminum such as aluminum distearate ($Al(OH)(C_{17}H_{35}COO)_2$) or aluminum monostearate ($Al(OH)_2(C_{17}H_{35}COO)$) are particularly preferred. By containing a hydroxy group, they can prevent overcharge and suppress a transfer failure. Moreover, it is also possible to improve the treatment of the inorganic fine powder such as silica.

Preferred examples of the fatty acid amide include saturated or mono-unsaturated aliphatic amide having a carbon number of 16 to 24 such as palmitic acid amide, palmitoleic acid amide, stearic acid amide, oleic acid amide, arachidic acid amide, eicosanoic acid amide, behenic acid amide, erucic acid amide, or lignoceric acid amide.

Preferred examples of the fatty acid ester include the following: esters composed of higher alcohol having a carbon number of 16 to 24 and higher fatty acid having a carbon number of 16 to 24 such as stearic acid stearyl, palmitic acid palmityl, behenic acid behenyl, or montanic acid stearyl; esters composed of higher fatty acid having a carbon number of 16 to 24 and lower monoalcohol such as stearic acid butyl, behenic acid isobutyl, montanic acid propyl, or 2-ethylhexyl oleate; fatty acid pentaerythritol monoester; fatty acid pentaerythritol triester; and fatty acid trimethylol propane ester.

Moreover, polyol fatty acid ester such as a derivative of hydroxystearic acid, glycerin fatty acid ester, glycol fatty acid ester, or sorbitan fatty acid ester is preferred. They can be used individually or in combinations of two or more.

It is preferable that the surface of the inorganic fine powder is treated with a coupling agent and/or silicone oil, followed by fatty acid or the like. This surface treatment is more uniform than that simply using fatty acid of hydrophilic inorganic fine powder, and thus can have the effect of improving the chargeability and flowability of toner. Even if the surface of the inorganic fine powder is treated with the coupling agent and/or silicone oil together with the fatty acid or the like, the above effect can be obtained as well.

The external additive may be prepared in the following manner. The fatty acid or the like is dissolved in a hydrocarbon organic solvent such as toluene, xylene, or hexane. Then, the solution and the inorganic fine powder of silica, titanium oxide, or alumina are wet-blended by a dispersing device so that the fatty acid or the like adhere to the surface of the inorganic fine powder. After this surface treatment, the solvent is removed, and the resultant inorganic fine powder is dried.

It is preferable that the mixing ratio of polysiloxane to the fatty acid or the like is 1:2 to 20:1. When the content of fatty acid or the like is larger than a ratio of 1:2, the amount of charge of the external additive is increased to reduce the image density. For two-component development, charge-up is likely to occur. When the content of fatty acid or the like is smaller than a ratio of 20:1, the effect of suppressing reverse transfer or thinning during transfer is decreased.

In this case, the ignition loss of the external additive whose surface is treated with the fatty acid or the like is preferably 1.5 to 25 wt %, more preferably 5 to 25 wt %, and further preferably 8 to 20 wt %. When the ignition loss is less than 1.5 wt %, the treatment agent does not function sufficiently, so that the effect of improving the charging and transfer properties cannot be displayed. When the ignition loss is more than 25 wt %, the treatment agent remains unused and adversely affects the development property or durability.

Controlling the ignition loss in the above range can improve the handling property of toner with a small particle size, and therefore high image quality and high transfer performance can be achieved in the development and transfer processes. Thus, an electrostatic latent image can be developed more faithfully and transferred without reducing a transfer ratio of the toner particles. In the case of tandem transfer, it is also possible to prevent retransfer and to suppress thinning. Moreover, high image density can be achieved even with a small amount of development. By combining the external additive with a carrier, which will be described later, higher resistance to spent can be obtained, and the handling property of toner in a developing unit can be improved, thus improving the uniformity of the toner concentration. The generation of a developing memory also can be reduced.

It is preferable that 1 to 6 parts by weight of external additive having an average particle size of 6 nm to 200 nm is added to 100 parts by weight of toner base particles. When the average particle size is less than 6 nm, suspended silica particles are generated, and the filming on a photoconductive member is likely to occur. Therefore, it is difficult to avoid the occurrence of reverse transfer. When the average particle size is more than 200 nm, the flowability of toner is decreased. When the amount of external additive added is less than 1 part by weight, the flowability of toner is decreased, and it is difficult to avoid the occurrence of reverse transfer. When the amount of external additive added is more than 6 parts by weight, suspended silica particles are generated, and the filming on a photoconductive member is likely to occur, thus degrading the high-temperature offset resistance.

Moreover, it is preferable that at least two external additives, e.g., 0.5 to 2.5 parts by weight of external additive having an average particle size of 6 nm to 20 min and 0.5 to 3.5 parts by weight of external additive having an average particle size of 20 nm to 200 nm are added to 100 parts by weight of toner base particles. The external additives with separated functions are mixed with the toner base produced by a wet method, so that more margins can be ensured for the handling property of toner in development, and reverse transfer, thinning, and scattering during transfer. It is also possible to prevent spent on a carrier. In this case, the ignition loss of the inorganic fine powder having an average particle size of 6 nm to 20 nm is preferably 1.5 to 25 wt %, and the ignition loss of the inorganic fine powder having an average particle size of 20 nm to 200 nm is preferably 0.5 to 23 wt %.

By specifying the ignition loss of the external additive, more margins can be ensured for reverse transfer, thinning, and scattering during transfer. Moreover, higher resistance to spent can be obtained, and the handling property of toner in a developing unit can be improved, thus improving the uniformity of the toner concentration. The generation of a developing memory also can be reduced.

When the ignition loss of the external additive having an average particle size of 6 nm to 20 nm is less than 1.5 wt %, the margins of reverse transfer and thinning during transfer become narrow. When the ignition loss is more than 25 wt %, the surface treatment is not uniform, resulting in charge variations. The ignition loss is preferably 1.5 to 20 wt %, and more preferably 5 to 19 wt %.

When the ignition loss of the external additive having an average particle size of 20 nm to 200 nm is less than 0.5 wt %, the margins of reverse transfer and thinning during transfer become narrow. When the ignition loss is more than 23 wt %, the surface treatment is not uniform, resulting in charge variations. The ignition loss is preferably 1.5 to 18 wt %, and more preferably 5 to 16 wt %.

It is also preferable that at least three external additives, e.g., 0.5 to 2 parts by weight of external additive having an average particle size of 6 nm to 20 nm and an ignition loss of 0.5 to 20 wt %, 0.5 to 3.5 parts by weight of external additive having an average particle size of 20 nm to 100 nm and an ignition loss of 1.5 to 25 wt %, and 0.5 to 2.5 parts by weight of external additive having an average particle size of 100 nm to 200 nm and an ignition loss of 0.1 to 10 wt % are added to 100 parts by weight of toner base particles. These external additives can provide separated functions by specifying the average particle size and the ignition loss. Accordingly, they are effective to improve the charging property and the charge retention property, to suppress reverse transfer and thinning during transfer, and to remove substances attached to the carrier surface.

It is also preferable that 0.2 to 1.5 parts by weight of positively charged inorganic fine powder having an average particle size of 6 nm to 200 nm and an ignition loss of 0.5 to 25 wt % further is added to 100 parts by weight of toner base particles.

The addition of the positively charged inorganic fine powder can suppress the overcharge of toner over a long period of continuous use and increase the life of a developer. Therefore, the scattering of toner during transfer caused by overcharge also can be reduced. Moreover, it is possible to prevent spent on a carrier. When the amount of positively charged inorganic fine powder added is less than 0.2 parts by weight, these effects are not likely to be obtained. When it is more than 1.5 parts by weight, fog is increased significantly during development. The ignition loss is preferably 1.5 to 20 wt %, and more preferably 5 to 19 wt %.

A drying loss (%) can be determined in the following manner. A container is dried, allowed to stand and cool, and weighed precisely beforehand. Then, a sample (about 1 g) is put in the container, weighed precisely, and dried for 2 hours with a hot-air dryer at 105° C.±1° C. After cooling for 30 minutes in a desiccator, the weight is measured, and the drying loss is calculated by Drying loss(%)=[weight loss (g) by drying/sample amount(g)]×100.

An ignition loss can be determined in the following manner. A magnetic crucible is dried, allowed to stand and cool, and weighed precisely beforehand. Then, a sample (about 1 g) is put in the crucible, weighed precisely, and ignited for 2 hours in an electric furnace at 500° C. After cooling for 1 hour in a desiccator, the weight is measured, and the ignition loss is calculated by Ignition loss(%)=[weight loss (g) by ignition/sample amount(g)]×100

The amount of moisture absorption of the surfaced-treated inorganic fine powder may be not more than 1 wt %, preferably not more than 0.5 wt %, more preferably not more than 0.1 wt %, and further preferably not more than 0.05 wt %. When it is more than 1 wt %, the chargeability is degraded, and the filming on a photoconductive member occurs. The amount of moisture absorption can be measured by using a continuous vapor absorption measuring device (BELSORP 18 manufactured by BEL JAPAN, INC.).

The degree of hydrophobicity can be determined in the following manner. A sample (0.2 g) is weighed in a 250 ml beaker containing 50 ml of distilled water. Then, methanol is added dropwise from a buret until the whole inorganic fine powder is wet while continuing the stirring slowly with a magnetic stirrer. Based on the amount a (ml) of methanol required to wet the inorganic fine powder completely, the degree of hydrophobicity is calculated by Degree of hydrophobicity(%)=$(a/(50+a))\times 100$ (7) Powder Physical Characteristics of Toner In this embodiment, it is preferable that toner base particles including a binder resin, a colorant, and wax have a volume-average particle size of 3 to 7 μm, the content of the toner base particles having a particle size of 2.52 to 4 μm in a number distribution is 10 to 75 percent by number, the toner base particles having a particle size of 4 to 6.06 μm in a volume distribution is 30 to 75 percent by volume, the toner base particles having a particle size of not less than 8 μm in the volume distribution is not more than 5 percent by volume, P46/V46 is in the range of 0.5 to 1.5 where V46 is the volume percentage of the toner base particles having a particle size of 4 to 6.06 μm in the volume distribution and P46 is the number percentage of the toner base particles having a particle size of 4 to 6.06 μm in the number distribution, the coefficient of variation in the volume-average particle size is 10 to 25%, and the coefficient of variation in the number particle size distribution is 10 to 28%.

More preferably, the toner base particles have a volume-average particle size of 3 to 6.5 μm, the content of the toner base particles having a particle size of 2.52 to 4 μm in the number distribution is 20 to 75 percent by number, the toner base particles having a particle size of 4 to 6.06 μm in the volume distribution is 35 to 75 percent by volume, the toner base particles having a particle size of not less than 8 μm in the volume distribution is not more than 3 percent by volume, P46/V46 is in the range of 0.5 to 1.3 where V46 is the volume percentage of the toner base particles having a particle size of 4 to 6.06 μm in the volume distribution and P46 is the number percentage of the toner base particles having a particle size of 4 to 6.06 μm in the number distribution, the coefficient of variation in the volume-average particle size is 10 to 20%, and the coefficient of variation in the number particle size distribution is 10 to 23%.

Further preferably, the toner base particles have a volume-average particle size of 3 to 5 μm, the content of the toner base particles having a particle size of 2.52 to 4 μm in the number distribution is 40 to 75 percent by number, the toner base particles having a particle size of 4 to 6.06 μm in the volume distribution is 45 to 75 percent by volume, the toner base particles having a particle size of not less than 8 μm in the volume distribution is not more than 3 percent by volume, P461V46 is in the range of 0.5 to 0.9 where V46 is the volume percentage of the toner base particles having a particle size of 4 to 6.06 μm in the volume distribution and P46 is the number percentage of the toner base particles having a particle size of 4 to 6.06 μm in the number distribution, the coefficient of variation in the volume-average particle size is 10 to 15%, and the coefficient of variation in the number particle size distribution is 10 to 18%.

The toner base particles with the above characteristics can provide high-resolution image quality, prevent reverse transfer and thinning during tandem transfer, and achieve the oilless fixing. The fine powder in toner affects the flowability of toner, the image quality, the storage stability, the filming on a photoconductive member, developing roller, or transfer member, the aging property, the transfer property, and particularly the multilayer transfer property in a tandem system. The fine powder also affects the offset resistance, glossiness, and transmittance in the oilless fixing. When the toner includes wax or the like to achieve the oilless fixing, the amount of fine powder may affect compatibility between the oilless fixing and the multilayer transfer property in the tandem system.

When the volume-average particle size is more than 7 μm, the image quality and the transfer property cannot be ensured together. When the volume-average particle size is less than 3 μm, the handling property of the toner particles in development is reduced.

When the content of the toner base particles having a particle size of 2.52 to 4 μm in the number distribution is less than 10 percent by number, the image quality and the transfer property cannot be ensured together. When it is more than 75 percent by number, the handling property of the toner particles in development is reduced. Moreover, the filming on a photoconductive member, developing roller, or transfer member is likely to occur. The adhesion of the fine powder to a heat roller is large, and thus tends to cause offset. In the tandem system, the agglomeration of toner is likely to be stronger, which easily leads to a transfer failure of the second color during multilayer transfer. Therefore, an appropriate range is required.

When the toner base particles having a particles size of 4 to 6.06 μm in the volume distribution is more than 75 percent by volume, the image quality and the transfer property cannot be ensured together. When it is less than 30 percent by volume, the image quality is degraded.

When the toner base particles having a particle size of not less than 8 μm in the volume distribution is more than 5 percent by volume, the image quality is degraded to cause a transfer failure.

When P46/V46 is less than 0.5, the amount of fine powder is increased excessively, so that the flowability and the transfer property are decreased, and fog becomes worse. When P46/V46 is more than 1.5, the presence of larger particles is increased, and the particle size distribution is broader. Thus, high image quality cannot be achieved.

The purpose of controlling P46/V46 is to provide an index for reducing the size of the toner particles and narrowing the particle size distribution.

The particle size distribution is measured, e.g., by using Coulter Counter TA-II (manufactured by Coulter Electronics, Inc.). An interface (manufactured by Nikkaki Bios Co., Ltd.) for outputting a number distribution and a volume distribution and a personal computer are connected to the Coulter Counter TA-II. An electrolytic solution (about 50 ml) is prepared by including a surfactant (sodium lauryl sulfate) so as to have a concentration of 1 mass %. About 2 mg of measuring toner is added to the electrolytic solution. This electrolytic solution in which the sample is suspended is dispersed for about 3 minutes with an ultrasonic dispersing device, and then is measured using the 70 μm aperture of the Coulter Counter TA-II. In the 70 μm aperture system, the measurement range of the particle size distribution is 1.26 μm to 50.8 μm. However, the region smaller than 2.0 μm is not suitable for practical use because the measurement accuracy or reproducibility is low under the influence of external noise or the like. Therefore, the measurement range is set from 2.0 μm to 44.02 μm.

A compression ratio calculated from a static bulk density and a dynamic bulk density can be used as an index of toner flowability. The toner flowability may be affected by the particle size distribution and particle shape of toner, the external additive, and the type or amount of wax. When the particle size distribution of toner is narrow, less fine powder is present, the toner shape is close to spherical, a large amount of external additive is added, and the external additive has a small particle size, the compression ratio is reduced, and the toner flowability is increased. The compression ratio is preferably 5 to 40%, and more preferably 10 to 30%. This can ensure compatibility between the oilless fixing and the multilayer transfer property in the tandem system. When the compression ratio is less than 5%, the fixability is degraded, and particularly the transmittance is likely to be lower. Moreover, toner scatting from the developing roller may be increased. When the compression ratio is more than 40%, the transfer property is decreased to cause a transfer failure such as thinning during tandem transfer.

(8) Carrier

A resin-coated carrier of this embodiment preferably includes a carrier core provided with a coating of fluorine modified silicone resin containing an aminosilane coupling agent. The carrier core may be, e.g., an iron powder carrier core, a ferrite carrier core, a magnetite carrier core, or a resin-dispersed carrier core in which a magnetic body is dispersed in the resin. An example of the ferrite carrier core is expressed generally by $$(MO)_x(Fe_2O_3)_Y$$

where M includes at least one selected from Cu, Zn, Fe, Mg, Mn, Ca, Li, Ti, Ni, Sn, Sr, Al, Ba, Co, and Mo, and X and Y are a molar ratio and satisfy X+Y=100.

The ferrite carrier core includes $Fe_2O_3$ as the main material and at least one oxide of M selected from Cu, Zn, Fe, Mg, Mn, Ca, Li, Ti, Ni, Sn, Sr, Al, Ba, Co, and Mo.

The ferrite carrier core may be produced in the following manner. First, the above materials such as each oxide are blended in an appropriate amount. The blend is placed in a wet ball mill, and then is pulverized and mixed for 10 hours. The resultant mixture is dried and kept at 950° C. for 4 hours. Moreover, the mixture is pulverized for 24 hours by the wet ball mill, to which, e.g., polyvinyl alcohol (a binder), an antifoaming agent, and a disperser are added, thus forming a slurry with a particle size of not more than 5 μm. The slurry is granulated and dried. The granulated substance is kept at 1300° C. for 6 hours while controlling the oxygen concentration. Subsequently, this substance was pulverized and further classified to achieve a desired particle size distribution.

The essential resin for the resin coating of the present invention is a fluorine modified silicone resin. The fluorine modified silicone resin is preferably a cross-linked fluorine modified silicone resin obtained by the reaction of an organosilicon compound containing a perfluoroalkyl group with polyorganosiloxane. It is preferable that 3 to 20 parts by weight of the organosilicon compound containing a perfluoroalkyl group is mixed with 100 parts by weight of the polyorganosiloxane.

The polyorganosiloxane preferably has at lease one repeating unit selected from Formulas (c) and (d).

Formula (c):

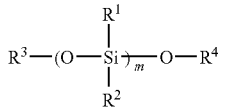

(where $R^1$ and $R^2$ are a hydrogen atom, a halogen atom, a hydroxy group, a methoxy group, an alkyl group having a carbon number of 1 to 4, or a phenyl group, $R^3$ and $R^4$ are an alkyl group having a carbon number of 1 to 4 or a phenyl group, and m represents a mean degree of polymerization and is positive integers (preferably in the range of 2 to 500, and more preferably in the range of 5 to 200)).

Formula (d):

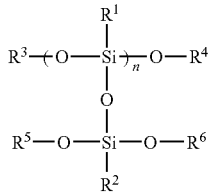

(where $R^1$ and $R^2$ are a hydrogen atom, a halogen atom, a hydroxy group, a methoxy group, an alkyl group having a carbon number of 1 to 4, or a phenyl group, $R^3$, $R^4$, $R^5$, and $R^6$ are an alkyl group having a carbon number of 1 to 4 or a phenyl group, and n represents a mean degree of polymerization and is positive integers (preferably in the range of 2 to 500, and more preferably in the range of 5 to 200)).

Examples of the organosilicon compound containing a perfluoroalkyl group include $CF_3CH_2CH_2Si(OCH_3)_3$, $C_4F_9CH_2CH_2Si(CH_3)(OCH_3)_2$, $C_8F_{17}CH_2CH_2Si(OCH_3)_3$, $C_8F_{17}CH_2CH_2Si(OC_2H_5)_3$, and $(CF_3)_2CF(CF_2)_8CH_2CH_2Si(OCH_3)_3$. In particular, a compound containing a trifluoropropyl group is preferred.

In this embodiment, the aminosilane coupling agent is included in the resin coating. As the aminosilane coupling agent, e.g., the following known materials can be used: γ-(2-aminoethyl)aminopropyltrimethoxysilane, γ-(2-aminoethyl)aminopropylmethyldimethoxysilane, and octadecylmethyl [3-(trimethoxysilyl)propyl]ammonium chloride (corresponding to SH6020, SZ6023, and AY43-021 manufactured by Toray-Dow Corning Co., Ltd.); KBM602, KBM603, KBE903, and KBM573 (manufactured by Shin-Etsu Chemical Co., Ltd.). In particular, the primary amine is preferred. The secondary or tertiary amine that is substituted with a methyl group, an ethyl group, or a phenyl group has weak polarity and is less effective for the charge rising property of toner. When the amino group is replaced by an aminomethyl group, an aminoethyl group, or an aminophenyl group, the end of the silane coupling agent can be the primary amine. However, the amino group in the straight-chain organic group extended from silane does not contribute to the charge rising property, and is affected by moisture under high humidity. Therefore, although the carrier may have charging ability for initial toner because the amino group is at the end, the charging ability is decreased during operation, resulting in a short life of the carrier.

By using the above aminosilane coupling agent with the fluorine modified silicone resin of this embodiment, the toner can be charged negatively while maintaining a sharp charge distribution. When toner is supplied, it shows a quick rise in charge, and thus the toner consumption can be reduced. Moreover, the aminosilane coupling agent has the effect comparable to that of a cross-linking agent. Therefore, it can increase the degree of cross-linking of the coating of fluorine modified silicone resin as a base resin. Further, the hardness of the resin coating is improved, so that abrasion or peeling can be reduced over a long period of use. Accordingly, higher resistance to spent can be obtained, and the electrification can be stabilized by suppressing a decrease in charging ability of the carrier, thus improving durability.

When wax having a low melting point is added to toner with the above configuration in an amount greater than a given value, the chargeability of the toner is rather unstable because the toner surface consists mainly of resin. Therefore, there may be some cases where the chargeability is weaker and the rise in charge is slower. This tends to cause fog, poor uniformity of a solid image, and skipping or thinning in letters during transfer. However, combining the toner with the carrier of this embodiment can overcome these problems and improve the handling property of the toner in a developing unit. Thus, the uniformity in concentration of an image can be improved in both the front and back of the development. Moreover, a so-called developing memory, i.e., a history that is left after taking a solid image, can be reduced.

The ratio of the aminosilane coupling agent to the resin is 5 to 40 wt %, and preferably 10 to 30 wt %. When the ratio is less than 5 wt %, no effect of the aminosilane coupling agent is observed. When the ratio is more than 40 wt %, the degree of cross-linking of the resin coating is excessively high, and a charge-up phenomenon is likely to occur. This may lead to image defects such as underdevelopment.

The resin coating also may include conductive fine powder to stabilize electrification and to prevent charge-up. Examples of the conductive fine powder include carbon black such as oil furnace black or acetylene black, a semiconductive oxide such as titanium oxide or zinc oxide, and powder of titanium oxide, zinc oxide, barium sulfate, aluminum borate, or potassium titanate coated with tin oxide, carbon black, or metal. The specific resistance is preferably not more than $10^{10}\Omega\cdot cm$. The content of the conductive fine powder is preferably 1 to 15 wt %. When the conductive fine powder is included to some extent in the resin coating, the hardness of the resin coating can be improved by a filler effect. However, when the content is more than 15 wt %, the conductive fine powder may interfere with the formation of the resin coating, thus resulting in lower adherence and hardness. An excessive amount of conductive fine powder in a full color developer may cause the color contamination of toner that is transferred and fixed on paper.

The carrier used in the present invention preferably has an average particle size of 20 to 70 μm. When the average particle size is less than 20 μm, the abundance ratio of fine particles in the carrier particle distribution is increased, and magnetization per carrier particle is reduced. Therefore, the carrier is likely to be developed on a photoconductive member. When the average particle size is more than 70 μm, the specific surface area of the carrier particles is smaller, and the toner retaining ability is decreased to cause toner scattering. For full color images including many solid portions, the reproduction of the solid portions is particularly worse.

A method for forming a coating on the carrier core is not particularly limited, and any known coating methods can be used, such as a dipping method of dipping core material powder in a solution for forming a coating layer, a spaying method of spaying a solution for forming a coating layer on the surface of a core material, a fluidized bed method of spraying a solution for forming a coating layer to a core material while the core material is floated by fluidizing air, or a kneader and coater method of mixing a core material and a solution for forming a coating layer in a kneader and coater, and removing a solvent. In addition to these wet coating methods, a dry coating method also can be used. The dry coating method includes, e.g., mixing resin powder and a core material at high speed, and fusing the resin powder on the surface of the core material by utilizing the frictional heat. In particular, the wet coating method is preferred for coating of the fluorine modified silicone resin containing an aminosilane coupling agent of the present invention.

A solvent of the solution for forming a coating layer is not particularly limited as long as it dissolves the coating resin, and can be selected in accordance with the coating resin to be used. Examples of the solvent include aromatic hydrocarbons such as toluene and xylene, ketones such as acetone and methyl ethyl ketone, and ethers such as tetrahydrofuran and dioxane.

The amount of coating resin is preferably 0.2 to 6.0 wt %, more preferably 0.5 to 5.0 wt %, further preferably 0.6 to 4.0 wt %, and most preferably 0.7 to 3 wt % with respect to the carrier core. When the amount of coating resin is less than 0.2 wt %, a uniform coating cannot be formed on the carrier surface. Therefore, the carrier is affected significantly by the characteristics of the carrier core and cannot provide a sufficient effect of the fluorine modified silicone resin containing an aminosilane coupling agent. When the amount of coating resin is more than 6.0 wt %, the coating is too thick, and granulation between the carrier particles occurs. Therefore, the carrier particles are not likely to be uniform.

It is preferable that a baking treatment is performed after coating the carrier core with the fluorine modified silicone resin containing an aminosilane coupling agent. A means for the baking treatment is not particularly limited, and either of external and internal heating systems may be used. For example, a fixed or fluidized electric furnace, a rotary kiln electric furnace, or a burner furnace can be used as well. Alternatively, baking may be performed with a microwave. The baking temperature should be high enough to provide the effect of fluorine silicone that can improve the spent resistance of the resin coating, e.g., preferably 200° C. to 350° C., and more preferably 220° C. to 280° C. The treatment time is preferably 1.5 to 2.5 hours. A lower temperature may degrade the hardness of the resin coating itself, while an excessively high temperature may cause a charge reduction.

(9) Two-Component Development

Both direct-current bias and alternating-current bias are applied between a photoconductive member and a developing roller.

In this case, it is preferable that the frequency is 1 to 10 kHz, the alternating-current bias is 1.0 to 2.5 kV (p-p), and the circumferential velocity ratio of the photoconductive member to the developing roller is 1:1.2 to 1:2.

More preferably, the frequency is 3.5 to 8 kHz, the alternating-current bias is 1.2 to 2.0 kV (p-p), and the circumferential velocity ratio of the photoconductive member to the developing roller is 1:1.5 to 1:1.8.

Further preferably, the frequency is 5.5 to 7 kHz, the alternating-current bias is 1.5 to 2.0 kV (p-p), and the circumferential velocity ratio of the photoconductive member to the developing roller is 1:1.6 to 1:1.8.

When the above development process configuration is used with toner or a two-component developer of this embodiment, it is possible to reproduce dots faithfully, to improve the development Y characteristics, and to ensure a high quality image and the oilless fixability. Moreover, charge-up can be suppressed under low humidity even with a high resistance carrier. Therefore, high image density can be obtained during continuous use.

Even if the toner surface consists mainly of resin, the adhesion between the toner and the carrier can be reduced by using the carrier composition of this embodiment with the alternating-current bias. Moreover, it is possible to maintain the image density, to reduce fog, and to reproduce dots faithfully.

When the frequency is less than 1 kHz, the dot reproducibility is decreased, resulting in poor reproduction of middle tones. When the frequency is more than 10 kHz, the toner cannot follow in the development region, and no effect is observed. In the two-component development using a high resistance carrier, the frequency within the above range is more effective for reciprocating action between the carrier and the toner than between the developing roller and the photoconductive member. Thus, the toner can be liberated slightly from the carrier. This may improve the dot reproducibility and the middle tone reproducibility, and provide high image density.

When the alternating-current bias is lower than 1.0 kV (p-p), the effect of suppressing charge-up cannot be obtained. When the alternating-current bias is more than 2.5 kV (p-p), fog is increased. When the circumferential velocity ratio is less than 1:1.2 (the developing roller gets slower), it is difficult to ensure the image density. When the circumferential velocity ratio is more than 1:2 (the developing roller gets faster), toner scatting is increased.

(10) Tandem Color Process

This embodiment employs the following transfer process for high-speed color image formation. A plurality of toner image forming stations, each of which includes a photoconductive member, a charging member, and a toner support member, are used. In a primary transfer process, an electrostatic latent image formed on the photoconductive member is made visible by development, and a toner image thus developed is transferred to an endless transfer member that is in contact with the photoconductive member. The primary transfer process is performed continuously in sequence so that a multilayer toner image is formed on the transfer member. Then, a secondary transfer process is performed by collectively transferring the multilayer toner image formed on the transfer member to a transfer medium such as paper or OHP sheet. The transfer process satisfies the relationship expressed by $$d1/v \leqq 0.65$$

where d1 (mm) is a distance between the first primary transfer position and the second primary transfer position, and v (mm/s) is a circumferential velocity of the photoconductive member. This configuration can reduce the machine size and improve the printing speed. To process 20 sheets (A4) per minute and to make the size small enough to be used for SOHO (small office/home office) purposes, a distance between the toner image forming stations should be as short as possible, while the processing speed should be enhanced. Thus, $d1/v \leqq 0.65$ is considered as the minimum requirement to achieve both small size and high printing speed.

However, when the distance between the toner image forming stations is too short, e.g., when a period of time from the primary transfer of the first color (yellow toner) to that of the second color (magenta toner) is extremely short, the charge of the transfer member or the charge of the transferred toner is hardly relieved. Therefore, when the magenta toner is transferred onto the yellow toner, it is repelled by the charging action of the yellow toner. This may lead to lower transfer efficiency and thinning in letters during transfer. When the third color (cyan) toner is transferred onto the yellow and the magenta toner, the cyan toner is scattered, and a transfer failure or thinning is caused considerably. Moreover, toner having a specified particle size is developed selectively with repeated use, and the individual toner particles differ significantly in flowability, so that frictional charge opportunities are different. Thus, the charge amount is varied to further reduce the transfer property.

In such a case, therefore, the toner or two-component developer of this embodiment can be used to stabilize the charge distribution and to suppress the overcharge and flowability variations of toner. Accordingly, it is possible to prevent lower transfer efficiency, thinning in letters during transfer, and reverse transfer without sacrificing the fixing property. The residual toner on the photoconductive member or the transfer member also can be cleaned well.

(11) Oilless Color Fixing

The toner of this embodiment can be used preferably in an electrographic apparatus having a fixing process with an oilless fixing configuration that applies no oil to any fixing means. As a heating means, electromagnetic induction heating is suitable in view of reducing a warm-up time and power consumption. The oilless fixing configuration includes a magnetic field generation means and a heating and pressing means. The heating and pressing means includes at least a rotational heating member and a rotational pressing member. There is a certain nip between the rotational heating member and the rotational pressing member. The rotational heating member includes at least a heat generation layer formed by electromagnetic induction and a release layer. A transfer medium such as copy paper to which toner has been transferred is allowed to pass between the rotational heating member and the rotational pressing member so as to fix the toner. This configuration is characterized by the warm-up time of the rotational heating member that has a very quick rising property as compared with a conventional configuration using a halogen lamp. Therefore, the copying operation starts before the temperature of the rotational pressing member is raised sufficiently. Thus, the toner is required to have the low-temperature fixability and a wide range of the offset resistance.

Another configuration in which a heating member is separated from a fixing member, and a fixing belt runs between the two members also may be used preferably. The fixing belt may be, e.g., a nickel electroformed belt having heat resistance and deformability or a heat-resistant polyimide belt. Silicone rubber, fluorocarbon rubber, or fluorocarbon resin may be used as a surface coating to improve the releasability.

In the conventional fixing process, release oil has been applied to prevent offset. The toner that exhibits releasability without using oil can eliminate the need for application of the release oil. However, if the release oil is not applied to the fixing means, it can be charged easily. Therefore, when an unfixed toner image is close to the heating member or the fixing member, the toner may be scattered due to the influence of charge. Such scattering is likely to occur particularly under low temperature and low humidity.

In contrast, the toner of this embodiment can achieve the low-temperature fixability and a wide range of the offset resistance without using oil. The toner also can provide high color transmittance. Thus, the use of the toner of this embodiment can suppress overcharge as well as scattering caused by the charging action of the heating member or the fixing member.

EXAMPLES

Carrier Producing Example 1

MnO (39.7 mol %), MgO (9.9 mol %), $Fe_2O_3$ (49.6 mol %), and SrO (0.8 mol %) were placed in a wet ball mill, and then were pulverized and mixed for 10 hours. The resultant mixture was dried, kept at 950° C. for 4 hours, and temporarily fired. This was pulverized for 24 hours by the wet ball mill, and then was granulated and dried by a spray dryer. The granulated substance was kept in an electric furnace at 1270° C. for 6 hours in an atmosphere of oxygen concentration of 2%, and fully fired. The fired substance was ground and further classified, thus producing a core material of ferrite particles that had an average particle size of 50 μm and a saturation magnetization of 65 emu/g in an applied magnetic field of 3000 oersted.

Next, 250 g of polyorganosiloxane expressed by Formula (d) in which $R^1$ and $R^2$ are methyl groups, i.e., $(CH_3)_2SiO_{2/2}$ unit is 15.4 mol % and Formula (e) in which $R^3$ is a methyl group, i.e., $CH_3SiO_{3/2}$ unit is 84.6 mol % was allowed to react with 21 g of $CF_3CH_2CH_2Si(OCH_3)_3$ to produce a fluorine modified silicone resin. Then, 100 g of the fluorine modified silicone resin (as represented in terms of solid content) and 10 g of aminosilane coupling agent (γ-aminopropyltriethoxysilane) were weighed and dissolved in 300 cc of toluene solvent.

Formula (d):

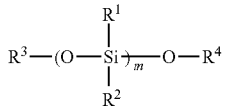

(where $R^1$, $R^2$, $R^3$, and $R^4$ are a methyl group, and m is a mean degree of polymerization of 100)

Formula (e):

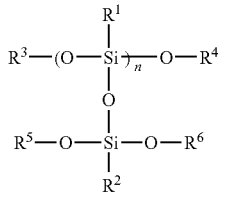

(where $R^1$, $R^2$, $R^3$, $R^4$, $R^5$, and $R^6$ are a methyl group, and n is a mean degree of polymerization of 80)

Using a dip and dry coater, a coating was applied to 10 kg of the ferrite particles by stirring the resin coating solution for 20 minutes, which was baked at 260° C. for 1 hour, thus providing a carrier A1.

Carrier Producing Example 2

A core material was produced in the same manner as the producing example 1 except that $CF_3CH_2CH_2Si(OCH_3)_3$ was changed to $C_8F_{17}CH_2CH_2Si(OCH_3)_3$, and a coating was applied, thus providing a carrier A2.

Carrier Producing Example 3

A core material was produced in the same manner as the producing example 1 except that a conductive carbon (manufactured by Ketjenblack International Corporation EC) was dispersed in an amount of 5 wt % per the resin solid content by using a pearl mill, and a coating was applied, thus providing a carrier A3.

Carrier Producing Example 4

A core material was produced in the same manner as the producing example 3 except that the amount of aminosilane coupling agent to be added was changed to 30 g, and a coating was applied, thus providing a carrier A4.

Carrier Producing Example 5

A core material was produced in the same manner as the producing example 3 except that the amount of aminosilane coupling agent to be added was changed to 50 g, and a coating was applied, thus providing a carrier b1.

Carrier Producing Example 6

As a coating resin, 100 g of straight silicone (SR-2411 manufactured by Dow Corning Toray Silicone Co., Ltd.) was weighed in terms of solid content and dissolved in 300 cc of toluene solvent.

Using a dip and dry coater, a coating was applied to 10 kg of the ferrite particles by stirring the resin coating solution for 20 minutes, which was baked at 210° C. for 1 hour, thus providing a carrier b2.

Carrier Producing Example 7

As a coating resin, 100 g of perfluorooctylethyl acrylate/methacrylate copolymer was weighed in terms of solid content and dissolved in 300 cc of toluene solvent.

Using a dip and dry coater, a coating was applied to 10 kg of the ferrite particles by stirring the resin coating solution for 20 minutes, which was baked at 200° C. for 1 hour, thus providing a carrier b3.

Carrier Producing Example 8

As a coating resin, 100 g of acrylic modified silicone resin (KR-9706 manufactured by Shin-Etsu Chemical Co., Ltd.) was weighed in terms of solid content and dissolved in 300 cc of toluene solvent.

Using a dip and dry coater, a coating was applied to 10 kg of the ferrite particles by stirring the resin coating solution for 20 minutes, which was baked at 210° C. for 1 hour, thus providing a carrier b4.

Example 1

Hereinafter, examples of the toner of the present invention will be described. However, the present invention is not limited to the following examples.

Toner Manufacturing Process

Figure 23:
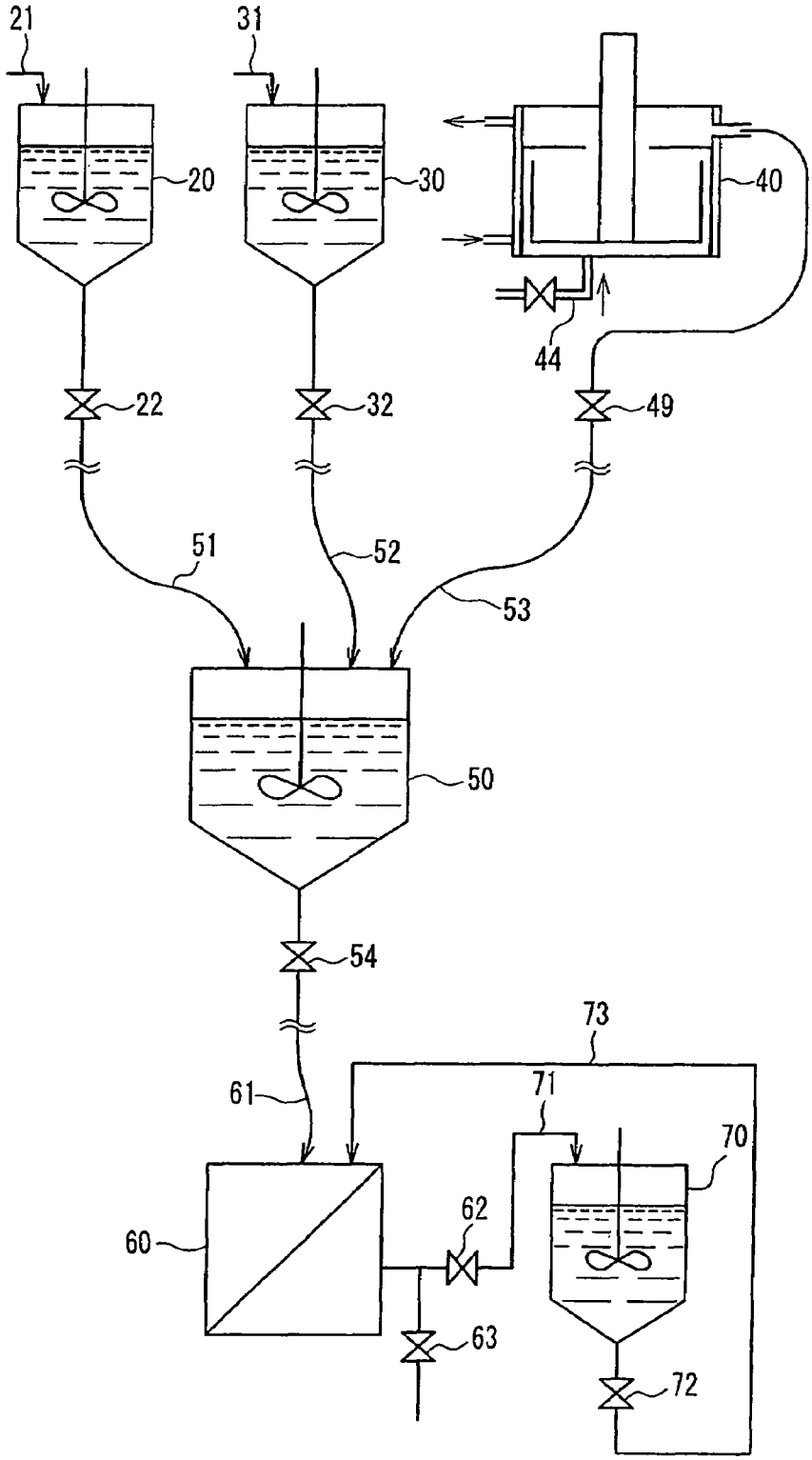
FIG. 23 is a flow chart schematically showing a manufacturing method in an example of the present invention.

An example of the manufacturing process of toner of the present invention will be described by referring to FIG. 23. Reference numeral 20 is an emulsion polymerization tank in which monomers, an anionic surfactant (emulsifier), a polymerization initiator, ion-exchanged water, and the like are supplied from a raw material supply line 21, and emulsion polymerization is performed. The resultant polymer is a resin particle dispersion with an average particle size of 0.1 to 0.2 μm. Reference numeral 30 is a pigment dispersion tank in which a pigment, an anionic surfactant, and ion-exchanged water are supplied from a raw material supply line 31 to produce a pigment particle dispersion with an average particle size of 0.1 to 0.2 μm. Reference numeral 40 is a wax dispersion tank (see FIGS. 3 and 4) in which wax, an anionic surfactant, and ion-exchanged water are supplied from a raw material supply line 44 to produce a wax particle dispersion with an average particle size of 0.2 to 0.5 μm. When the primary particles are produced in each of the tanks 20, 30, and 40, valves 22, 32, and 49 are opened to let the primary materials into an aggregation tank 50 through supply lines 51, 52, and 53, respectively. In the aggregation tank 50, a mixed particle dispersion is prepared. Then, NaOH and a magnesium sulfate aqueous solution are added to the mixed particle dispersion at a predetermined mixing ratio. The mixture is heated so that the resin is melted to form aggregated particles. Thereafter, the surfaces of the aggregated particles may be coated with second resin particles. The operating process of the aggregation tank 50 will be described below in FIGS. 24A and 24B.

Next, a valve 54 is opened to let the aggregated particle dispersion into a filtration separation tank 60 through a supply line 61. In the filtration separation tank 60, the aggregated particles are separated. Then, a valve 62 is opened to let the aggregated particles into a washing tank 70 through a supply line 71. After the aggregated particles are washed with water, a valve 72 is opened to let them into the filtration separation tank 60 through a supply line 73, thereby separating the aggregated particles from water. This operation is repeated several times, and then a valve 63 is opened to provide toner of the purified aggregated particles. Subsequently, the toner is dried to make a toner product.

In the above manufacturing process, a funnel glass filter No. 5A (7 μm) may be used as a filter of the filtration separation tank 60.

Figure 24A:
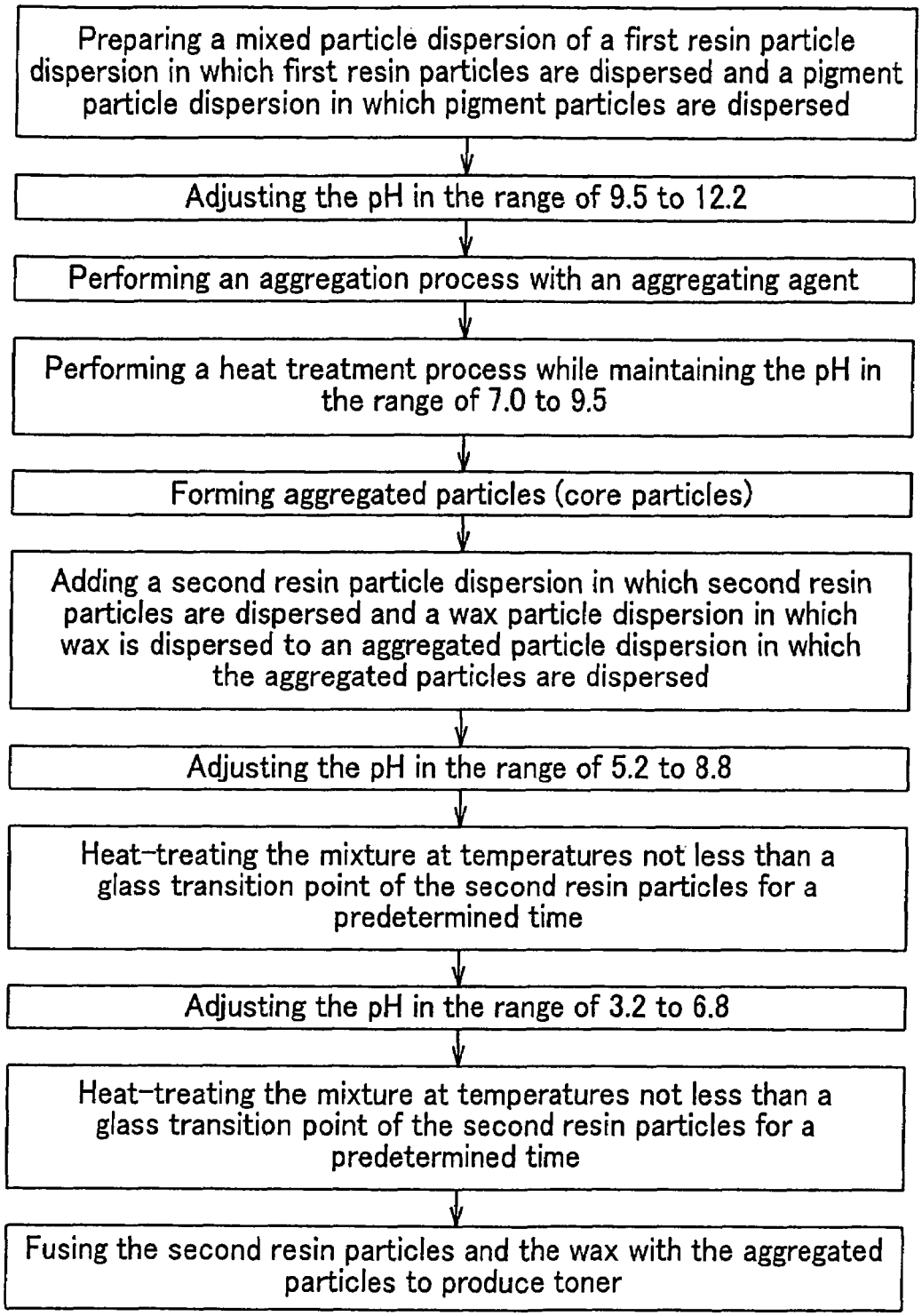
FIG. 24A is a flow chart showing an aggregation process operation in an example of the present invention.

FIG. 24 shows the operating process of the aggregation tank 50. In FIG. 24A, first, a mixed particle dispersion is prepared by mixing a first resin particle dispersion in which first resin particles are dispersed and a pigment particle dispersion in which pigment particles are dispersed. Then, the pH of the mixed particle dispersion is maintained in the range of 9.5 to 12.2, e.g., by the addition of alkali such as NaOH. This pH adjustment allows the subsequent aggregation to be performed efficiently. In the aggregation process, e.g., an aggregating agent such as $MgSO_4$ is used for an aggregation treatment.

Next, heat and melt treatments are performed in the heat treatment process, and the pH is maintained in the range of 7.0 to 9.5 on completion of the treatments, thus providing aggregated particles with a small particle size and a sharp particle size distribution.

A second resin particle dispersion in which second resin particles are dispersed and a wax particle dispersion in which wax is dispersed are added to an aggregated particle dispersion in which the aggregated particles are dispersed. The pH of this mixture is adjusted in the range of 5.2 to 8.8. Then, the mixture is heat-treated at temperatures not less than the glass transition point of the second resin particles for a predetermined time, and further the pH is adjusted in the range of 3.2 to 6.8. Subsequently, the mixture is heat-treated at temperatures not less than the glass transition point of the second resin particles for a predetermined time, so that the second resin particles and the wax are fused with the aggregated particles into toner particles.

Figure 24B:
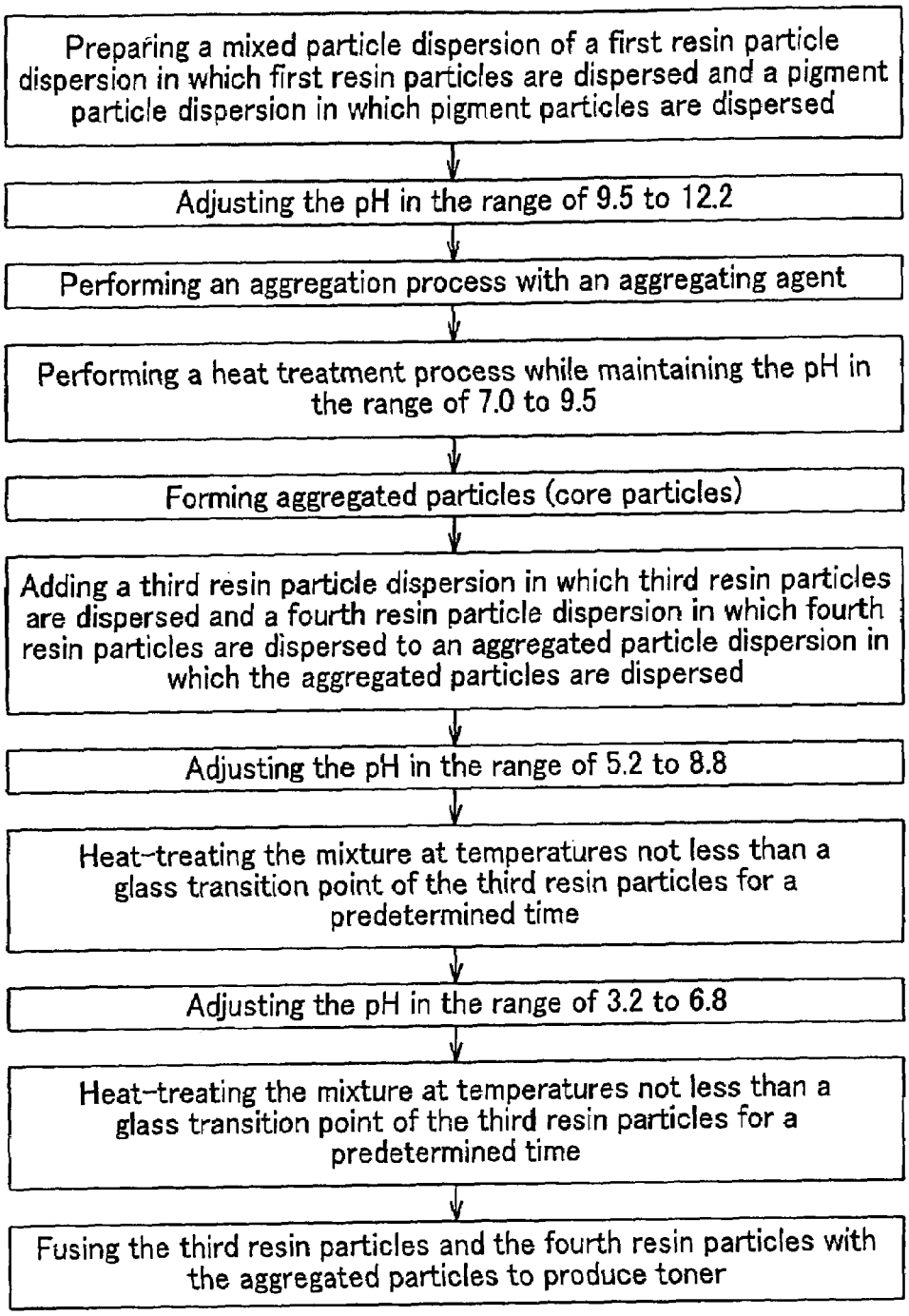
FIG. 24B is a flow chart showing an aggregation process operation in an example of the present invention.

In FIG. 24B, first, a mixed particle dispersion is prepared by mixing a first resin particle dispersion in which first resin particles are dispersed and a pigment particle dispersion in which pigment particles are dispersed. Then, the pH of the mixed particle dispersion is maintained in the range of 9.5 to 12.2, e.g., by the addition of alkali such as NaOH. This pH adjustment allows the subsequent aggregation to be performed efficiently. In the aggregation process, e.g., an aggregating agent such as $MgSO_4$ is used for an aggregation treatment.

Next, heat and melt treatments are performed in the heat treatment process, and the pH is maintained in the range of 7.0 to 9.5 on completion of the treatments, thus providing aggregated particles with a small particle size and a sharp particle size distribution.

A resin A particle dispersion in which resin A particles are dispersed and a resin B particle dispersion in which resin B particles are dispersed are added to an aggregated particle dispersion in which the aggregated particles are dispersed. The pH of this mixture is adjusted in the range of 5.2 to 8.8. Then, the mixture is heat-treated at temperatures not less than the glass transition point of the resin A particles for a predetermined time, and further the pH is adjusted in the range of 3.2 to 6.8. Subsequently, the mixture is heat-treated at temperatures not less than the glass transition point of the resin A particles for a predetermined time, so that the resin A particles and the resin B particles are fused with the aggregated particles into toner particles.

Resin Dispersion Production

Table 1 shows the characteristics of the resins used. In Table 1, Mn is a number-average molecular weight, Mw is a weight-average molecular weight, Mz is a Z average molecular weight, Mp is a peak value of the molecular weight, Tg (° C.) is a glass transition point, Tfb (° C.) is a melting start temperature, and Tm (° C.) is a softening point. In this example, styrene, n-butylacrylate, and acrylic acid are indicated with the mixing amount (g).

TABLE 1

| | Mn ($\times 10^4$) | Mw ($\times 10^4$) | Mz ($\times 10^4$) | Wm = Mw/Mn | Wz = Mz/Mn | Mp ($\times 10^4$) | Tg (° C.) | Tfb (° C.) | Tm (° C.) |
|---|---|---|---|---|---|---|---|---|---|
| RL1 | 0.39 | 1.09 | 3.78 | 2.79 | 9.69 | 0.81 | 43 | 81 | 115 |
| RL2 | 0.66 | 6.03 | 25.9 | 9.14 | 39.24 | 0.81 | 55 | 100 | 128 |
| RL3 | 0.26 | 1.83 | 9.62 | 7.04 | 37.00 | 0.27 | 45 | 82 | 109 |
| RH4 | 0.68 | 5.06 | 30 | 7.44 | 44.12 | 1 | 67 | 132 | 155 |
| RH5 | 2.11 | 8.69 | 26.3 | 4.12 | 12.46 | 5.7 | 76 | 154 | 179 |
| RH6 | 4.33 | 26.2 | 57.7 | 6.05 | 13.33 | 18.2 | 77 | 161 | 187 |
| RH7 | 4.1 | 24.2 | 57.5 | 5.90 | 14.02 | 15.4 | 76 | 168 | 193 |
| RH8 | 0.61 | 9.46 | 50.1 | 15.51 | 82.13 | | 67 | 160 | 174 |

(1) Preparation of Resin Particle Dispersion RL1

A monomer solution including 96 g of styrene, 24 g of n-butylacrylate, and 3.6 g of acrylic acid was dispersed in 200 g of ion-exchanged water with 3 g of anionic surfactant (NEOGEN RK manufactured by Dai-Ichi Kogyo Seiyaku Co., Ltd.), 6 g of dodecanthiol, and 1.2 g of carbon tetrabromide. Then, 1.2 g of potassium persulfate was added to the resultant solution, and emulsion polymerization was performed at 70° C. for 6 hours, followed by an aging treatment at 90° C. for 3 hours. This provided a resin particle dispersion RL1 in which the resin particles having Mn of 3900, Mw of 10900, Mz of 37800, Mp of 8100, Tm of 115° C., Tg of 43° C., and a median diameter of 0.12 μm were dispersed.

(2) Preparation of Resin Particle Dispersion RL2

A monomer solution including 204 g of styrene, 36 g of n-butylacrylate, and 3.6 g of acrylic acid was dispersed in 400 g of ion-exchanged water with 6 g of anionic surfactant (NEOGEN RK manufactured by Dai-Ichi Kogyo Seiyaku Co., Ltd.), 6 g of dodecanthiol, and 1.2 g of carbon tetrabromide. Then, 1.2 g of potassium persulfate was added to the resultant solution, and emulsion polymerization was performed at 70° C. for 5 hours, followed by an aging treatment at 90° C. for 5 hours. This provided a resin particle dispersion RL2 in which the resin particles having Mn of 6600, Mw of 60300, Mz of 259000, Mp of 8100, Tm of 128° C., Tg of 55° C., and a median diameter of 0.18 μm were dispersed.

(3) Preparation of Resin Particle Dispersion RL3

A monomer solution including 204 g of styrene, 36 g of n-butylacrylate, and 3.6 g of acrylic acid was dispersed in 400 g of ion-exchanged water with 6 g of anionic surfactant (NEOGEN RK manufactured by Dai-Ichi Kogyo Seiyaku Co., Ltd.), 12 g of dodecanthiol, and 2.4 g of carbon tetrabromide. Then, 1.2 g of potassium persulfate was added to the resultant solution, and emulsion polymerization was performed at 70° C. for 5 hours, followed by an aging treatment at 90° C. for 2 hours. This provided a resin particle dispersion RL3 in which the resin particles having Mn of 2600, Mw of 18300, Mz of 96200, Mp of 2700, Tm of 109° C., Tg of 45° C., and a median diameter of 0.18 μm were dispersed.

(4) Preparation of Resin Particle Dispersion RH4

A monomer solution including 216 g of styrene, 24 g of n-butylacrylate, and 3.6 g of acrylic acid was dispersed in 400 g of ion-exchanged water with 6 g of anionic surfactant (NEOGEN RK manufactured by Dai-Ichi Kogyo Seiyaku Co., Ltd.) and 6 g of dodecanthiol, while no carbon tetrabromide was used. Then, 2.4 g of potassium persulfate was added to the resultant solution, and emulsion polymerization was performed at 70° C. for 5 hours. This provided a resin particle dispersion RH4 in which the resin particles having Mn of 6800, Mw of 50600, Mz of 300000, Mp of 10000, Tm of 155° C., Tg of 67° C., and a median diameter of 0.12 μm were dispersed.

(5) Preparation of Resin Particle Dispersion RH5

A monomer solution including 204 g of styrene, 36 g of n-butylacrylate, and 3.6 g of acrylic acid was dispersed in 400 g of ion-exchanged water with 6 g of anionic surfactant (NEOGEN RK manufactured by Dai-Ichi Kogyo Seiyaku Co., Ltd.) and 1.2 g of dodecanthiol, while no carbon tetrabromide was used. Then, 1.2 g of potassium persulfate was added to the resultant solution, and emulsion polymerization was performed at 70° C. for 5 hours. This provided a resin particle dispersion RH5 in which the resin particles having Mn of 21100, Mw of 86900, Mz of 263000, Mp of 57300, Tm of 179° C., Tg of 76° C., and a median diameter of 0.12 μm were dispersed.

(6) Preparation of Resin Particle Dispersion RH6

A monomer solution including 102 g of styrene, 18 g of n-butylacrylate, and 1.8 g of acrylic acid was dispersed in 200 g of ion-exchanged water with 3 g of anionic surfactant (NEOGEN RK manufactured by Dai-Ichi Kogyo Seiyaku Co., Ltd.), while neither dodecanthiol nor carbon tetrabromide was used. Then, 1.2 g of potassium persulfate was added to the resultant solution, and emulsion polymerization was performed at 70° C. for 5 hours. This provided a resin particle dispersion RH6 in which the resin particles having Mn of 43300, Mw of 262000, Mz of 577000, Mp of 182000, Tm of 187° C., Tg of 77° C., and a median diameter of 0.12 μm were dispersed.

(7) Preparation of Resin Particle Dispersion RH7

A monomer solution including 102 g of styrene in which 4 g of salicylic acid aluminum metal complex (E88 manufactured by Orient Chemical Industries, Ltd.) was melted, 18 g of n-butylacrylate, and 1.8 g of acrylic acid was dispersed in 200 g of ion-exchanged water with 3 g of anionic surfactant (NEOGEN RK manufactured by Dai-Ichi Kogyo Seiyaku Co., Ltd.), while neither dodecanthiol nor carbon tetrabromide was used. Then, 1.2 g of potassium persulfate was added to the resultant solution, and emulsion polymerization was performed at 70° C. for 5 hours. This provided a resin particle dispersion RH7 in which the resin particles having Mn of 41000, Mw of 242000, Mz of 575000, Mp of 154000, Tm of 193° C., Tg of 76° C., and a median diameter of 0.22 μm were dispersed.

(8) Preparation of Resin Particle Dispersion RH8

The following is an explanation of producing the fifth resin particles. The composition of a monomer was a three-component system of styrene/butyl acrylate/acrylic acid. The monomer included 1.5 parts by weight of acrylic acid per 100 parts by weight of styrene and butyl acrylate in total. A nonionic surfactant and an anionic surfactant were combined as an emulsifier, and the amount of emulsifier was 4 parts by weight per 100 parts by weight of styrene and butyl acrylate in total. In this example, NONIPOL 400 (manufactured by Sanyo Chemical Industries, Ltd.) was used as the nonionic surfactant, and NEOGEN S20-F (manufactured by Dai-Ichi Kogyo Seiyaku Co., Ltd.) was used as the anionic surfactant. Moreover, dodecanthiol was used as a chain transfer agent for adjusting the molecular weight, potassium persulfate was used as a polymerization initiator, and ion-exchanged water was used as a reaction solvent.

In a 500 ml beaker were weighed 270 g of styrene, 30 g of butyl acrylate, 4.5 g of acrylic acid, and 7.5 g of dodecyl mercaptan, and then the mixture was stirred for 10 minutes with a magnetic stirrer to provide a monomer solution. In a 300 ml beaker were weighed 7.5 g of NONIPOL 400, 37.5 g (solid content 20%) of NEOGEN S20-F, and 97.5 g of ion-exchanged water, and then the mixture was stirred for 10 minutes with a magnetic stirrer so that the emulsifier was dissolved to provide an emulsifier aqueous solution.

In a 100 ml beaker were weighed 1.5 g of potassium persulfate and 75 g of ion-exchanged water, and then the mixture was stirred for 10 minutes with a magnetic stirrer so that the initiator was dissolved to provide an initiator aqueous solution. The emulsifier aqueous solution and the monomer solution were placed in a 2 L beaker and emulsified at 9500 $min^{-1}$ for 10 minutes by using a homogenizer (Ultratalax T25 manufactured by IKA CO., LTD.). After the emulsified liquid was cooled with ice water for 3 minutes, the initiator aqueous solution was added and stirred for 3 minutes with a magnetic stirrer. This was identified as a pre-emulsion (about 510 g). The temperature of the pre-emulsion was reduced to 20° C. or less with ice water.

In a 1 L four-neck flask equipped with an agitating rod made of polytetrafluoroethylene, a cooling tube, a dropping funnel, a thermometer, and a nitrogen gas introducing tube was placed 255 g of ion-exchanged water, and the temperature was raised to 75° C. in an atmosphere of nitrogen gas. When the temperature of the ion-exchanged water reached 73° C., one-tenth (51 g) of the pre-emulsion was added at a time. Although the temperature was made lower than 73° C., it was increased immediately. Therefore, when the temperature was 73° C. again, the remaining pre-emulsion was added drop by drop for 2 hours. During dropping, the temperature of the reaction liquid was maintained at 75±2° C. The molecular weight distribution had two peaks by controlling the dropping rate. Thus, the resin with a two-peak distribution was obtained without blending two types of resins. When the dropping rate (time) was not less than 4 hours, the molecular weight distribution had one peak, resulting in a monodisperse system.

Upon completion of the pre-emulsion dropping, the reaction liquid further was heated at 75° C. for 5 hours. Then, the temperature was raised to 85° C., and the reaction liquid was heated at 85±2° C. for 2 hours. After heating, the reaction liquid was cooled with ice water to room temperature. This provided a resin particle dispersion RH8 in which the resin particles having Mn of 6100, Mw of 94600, Mz of 501000, Mp of 10100 and 108500 (two peaks), Tm of 174° C., Tg of 67° C., and a median diameter of 0.13 μm were dispersed.

Example 2

Pigment dispersions were produced. Table 2 shows the pigments used.

TABLE 2

| MaterialNo. | Composition |
|---|---|
| PM1 | KETRED309 (Dainippon Ink and Chemicals, Inc.) |
| PC1 | KETBLUE111 (Dainippon Ink and Chemicals, Inc.) |
| PY1 | PY74 (Sanyo Color Works, Ltd.) |
| PB1 | MA100S (Mitsubishi Chemical Corporation |

(1) Preparation of Pigment Particle Dispersion PM1

20 g of magenta pigment (KETRED309 manufactured by Dainippon Ink and Chemicals, Inc.), 2 g of anionic surfactant (NEOGEN R manufactured by Dai-Ichi Kogyo Seiyaku Co., Ltd), and 78 g of ion-exchanged water were mixed and dispersed by using an ultrasonic dispersing device at an oscillation frequency of 30 kHz for 20 minutes. This provided a pigment particle dispersion PM1 in which the pigment particles having a median diameter of 0.12 μm were dispersed.

(2) Preparation of Pigment Particle Dispersion PC1

20 g of cyan pigment (KETBLUE111 manufactured by Dainippon Ink and Chemicals, Inc.), 2 g of anionic surfactant (NEOGEN R manufactured by Dai-Ichi Kogyo Seiyaku Co., Ltd), and 78 g of ion-exchanged water were mixed and dispersed by using an ultrasonic dispersing device at an oscillation frequency of 30 kHz for 20 minutes. This provided a pigment particle dispersion PC1 in which the pigment particles having a median diameter of 0.12 μm were dispersed.

(3) Preparation of Pigment Particle Dispersion PY1

20 g of yellow pigment (PY74 manufactured by Sanyo Color Works, LTD), 2 g of anionic surfactant (NEOGEN R manufactured by Dai-Ichi Kogyo Seiyaku Co., Ltd), and 78 g of ion-exchanged water were mixed and dispersed by using an ultrasonic dispersing device at an oscillation frequency of 30 kHz for 20 minutes. This provided a pigment particle dispersion PY1 in which the pigment particles having a median diameter of 0.12 μm were dispersed.

(4) Preparation of Pigment Particle Dispersion PB1

20 g of black pigment (MA100S manufactured by Mitsubishi Chemical Corporation), 2 g of anionic surfactant (NEOGEN R manufactured by Dai-Ichi Kogyo Seiyaku Co., Ltd), and 78 g of ion-exchanged water were mixed and dispersed by using an ultrasonic dispersing device at an oscillation frequency of 30 kHz for 20 minutes. This provided a pigment particle dispersion PB1 in which the pigment particles having a median diameter of 0.12 μm were dispersed.

Example 3

Wax dispersions were produced. Tables 3, 4, 5, and 6 show the characteristics of the waxes used.

TABLE 3

| Wax | Material | Melting point Tw (° C.) | Volume ratio Ct (%) | Heating loss Ck (wt %) | Iodine value | Saponification value |
|---|---|---|---|---|---|---|
| W-1 | Maximum hydrogenated jojoba oil | 68 | 18.5 | 2.8 | 2 | 95.7 |
| W-2 | Maximum hydrogenated meadowfoam oil | 71 | 3 | 2.5 | 2 | 90 |
| W-3 | Jojoba oil fatty acid pentaerythritol monoester | 120 | 3.5 | 3.4 | 2 | 120 |
| W-4 | Oleic amide | 78 | | 0.8 | | |
| W-5 | Ethylenebis erucic acid amid | 105 | | 1.2 | | |
| W-6 | Neopentyl polyol fatty acid ester | 110 | | 2.2 | 0.2 | 150 |
| W-7 | Pentaerythritol tetrastearate | 125 | | 0.9 | 0.1 | 180 |

TABLE 4

| | | Melting point Tw (° C.) | Acid value | Penetration number |
|---|---|---|---|---|
| W-8 | ethylene/maleic anhydride/nonacosanol/ tert-butylperoxy isopropyl monocarbonate: 100/20/8/4 parts by weight | 98 | 45 | 1 |
| W-9 | propylene/maleic anhydride/1-octanol/ dicumyl peroxide: 100/15/8/4 parts by weight | 120 | 58 | 1 |

TABLE 5

| | Mnr | Mwr | Mzr | Mwr/Mnr | Mzr/Mnr | Peak |
|---|---|---|---|---|---|---|
| W-1 | 1009 | 1072 | 1118 | 1.06 | 1.11 | $1.02 \times 10^3$ |
| W-2 | 1015 | 1078 | 1124 | 1.06 | 1.11 | $1.03 \times 10^3$ |
| W-3 | 1500 | 2048 | 3005 | 1.37 | 2.00 | $3.2 \times 10^3$ |
| W-4 | 1000 | 1050 | 1200 | 1.05 | 1.20 | $1.8 \times 10^3$ |
| W-5 | 1002 | 1100 | 1350 | 1.10 | 1.35 | $1.9 \times 10^3$ |
| W-6 | 1050 | 1205 | 1400 | 1.15 | 1.33 | $2.1 \times 10^3$ |
| W-7 | 1100 | 1980 | 3050 | 1.80 | 2.77 | $3.5 \times 10^3$ |
| W-8 | 1400 | 2030 | 2810 | 1.45 | 2.01 | $2.1 \times 10^3$ |
| W-9 | 1400 | 3250 | 5200 | 2.32 | 3.71 | $3.1 \times 10^3$ |

TABLE 6

| Dispersion | Wax used | 20-200 nm PR16 (nm) | 40-300 nm PR50 (nm) | 400 nm or less PR84 (nm) | 1.2-2.0 PR84/PR16 |
|---|---|---|---|---|---|
| WA1 | W-1 | 74 | 99.5 | 125 | 1.69 |
| WA2 | W-2 | 71 | 101 | 131 | 1.85 |
| WA3 | W-3 | 89 | 132 | 175 | 1.97 |
| WA4 | W-4 | 135 | 195.5 | 256 | 1.90 |
| WA5 | W-5 | 115 | 152 | 189 | 1.64 |
| WA6 | W-6 | 118 | 166.5 | 215 | 1.82 |
| WA7 | W-7 | 74 | 94 | 114 | 1.54 |
| WA8 | W-8 | 89 | 129 | 169 | 1.90 |
| WA9 | W-9 | 102 | 150 | 198 | 1.94 |
| wa10 | | 420 | 700 | 980 | 2.33 |
| wa11 | | 312 | 521 | 730 | 2.34 |
| wa12 | | 470 | 860 | 1250 | 2.66 |

(1) Preparation of Wax Particle Dispersion WA1

FIG. 3 is a schematic view of a stirring/dispersing device 40, and FIG. 4 is a top view of the same. The stirring/dispersing device 40 is water cooling jacket type. The whole device is cooled by introducing cooling water from a line 47 to the inside of an outer tank 41 and discharging it through a line 48. Reference numeral 42 is a shielding board that stops the liquid to be treated flowing. The shielding board 42 has an opening in the central portion, and the treated liquid is drawn from the opening and taken out of the device through a line 45. Reference numeral 43 is a rotating body that is secured to a shaft 46 and rotates at high speed. There are holes (about 1 to 5 mm in size) in the side of the rotating body 43, and the liquid to be treated can move through the holes. The liquid to be treated is put into the tank in an amount of about one-half the capacity (120 ml) of the tank. The maximum rotational speed of the rotating body can be 50 m/s. The rotating body has a diameter of 52 mm, and the tank has an internal diameter of 56 mm. Reference numeral 44 is a material inlet used for a continuous treatment. In the case of a high-pressure treatment or batch treatment, the material inlet 44 is closed.

70 g of ion-exchanged water, 1 g of anionic surfactant (SCF manufactured by Sanyo Chemical Industries, Ltd.), 1 g of nonionic surfactant (Newcol 565C manufactured by Nippon Nyukazai Co., Ltd), and 28 g of wax (W-1) were blended and treated while the rotating body rotated at a rotational speed of 20 m/s for 5 minutes, and then 50 m/s for 2 minutes. The liquid temperature in the tank was increased to 92° C., and the wax was melted by heat thus generated. Moreover, a strong shearing force was exerted on the liquid, thereby providing a fine wax particle dispersion WA1.

(2) Preparation of Wax Particle Dispersion WA2

Under the same conditions as (1), 70 g of ion-exchanged water, 1 g of anionic surfactant (SCF manufactured by Sanyo. Chemical Industries, Ltd.), 1 g of nonionic surfactant (Newcol 565C manufactured by Nippon Nyukazai Co., Ltd), and 28 g of wax (W-2) were blended and treated while the rotating body rotated at a rotational speed of 20 m/s for 3 minutes, and then 45 m/s for 2 minutes. Thus, a wax particle dispersion WA2 was provided.

(3) Preparation of Wax Particle Dispersion WA3

Under the same conditions as (1), the pressure in the tank was increased to 0.4 Mpa, and 70 g of ion-exchanged water, 1 g of anionic surfactant (SCF manufactured by Sanyo Chemical Industries, Ltd.), 1 g of nonionic surfactant (Newcol 565C manufactured by Nippon Nyukazai Co., Ltd), and 28 g of wax (W-3) were blended and treated while the rotating body rotated at a rotational speed of 20 m/s for 3 minutes, and then 50 m/s for 2 minutes. Thus, a wax particle dispersion WA3 was provided.

(4) Preparation of Wax Particle Dispersion WA4

Under the same conditions as (1), 70 g of ion-exchanged water, 1 g of anionic surfactant (SCF manufactured by Sanyo Chemical Industries, Ltd.), 1 g of nonionic surfactant (Newcol 565C manufactured by Nippon Nyukazai Co., Ltd), and 28 g of wax (W-4) were blended and treated while the rotating body rotated at a rotational speed of 20 m/s for 3 minutes, and then 50 m/s for 1 minute. Thus, a wax particle dispersion WA4 was provided.

(5) Preparation of Wax Particle Dispersion WA5

Under the same conditions as (3), 70 g of ion-exchanged water, 1 g of anionic surfactant (SCF manufactured by Sanyo Chemical Industries, Ltd.), 1 g of nonionic surfactant (Newcol 565C manufactured by Nippon Nyukazai Co., Ltd), and 28 g of wax (W-5) were blended and treated while the rotating body rotated at a rotational speed of 20 m/s for 3 minutes, and then 45 m/s for 4 minutes. Thus, a wax particle dispersion WA5 was provided.

(6) Preparation of Wax Particle Dispersion WA6

Under the same conditions as (3), 70 g of ion-exchanged water, 1 g of anionic surfactant (SCF manufactured by Sanyo Chemical Industries, Ltd.), 1 g of nonionic surfactant (Newcol 565C manufactured by Nippon Nyukazai Co., Ltd), and 28 g of wax (W-6) were blended and treated while the rotating body rotated at a rotational speed of 20 m/s for 3 minutes, and then 45 m/s for 4 minutes. Thus, a wax particle dispersion WA6 was provided.

(7) Preparation of Wax Particle Dispersion WA7

Under the same conditions as (3), 70 g of ion-exchanged water, 1 g of anionic surfactant (SCF manufactured by Sanyo Chemical Industries, Ltd.), 1 g of nonionic surfactant (Newcol 565C manufactured by Nippon Nyukazai Co., Ltd), and 28 g of wax (W-7) were blended and treated while the rotating body rotated at a rotational speed of 20 m/s for 3 minutes, and then 45 m/s for 4 minutes. Thus, a wax particle dispersion WA7 was provided.

(8) Preparation of Wax Particle Dispersion WA8

FIG. 5 is a schematic view of a stirring/dispersing device, and FIG. 6 is a top view of the same. Reference numeral 80 is an inlet and 82 is a fixed body with a floating structure. The fixed body 82 is pressed down by springs 81, but pushed up by a force created when a rotating body 83 rotates at high speed. Therefore, a narrow gap of about 1 μm to 10 μm is formed between the fixed body 82 and the rotating body 83. Reference numeral 84 is a shaft connected to a motor (not shown). Materials are fed into the device from the inlet 80, subjected to a strong shearing force in the gap between the fixed body 82 and the rotating body 83, and thus formed into fine particles dispersed in the liquid. The material liquid thus treated is drawn from outlets 86. As shown in FIG. 6, fine particles 85 are released radially and collected in a closed container. The rotating body 83 has an outer diameter of 100 mm.

A material liquid, in which wax and a surfactant were predispersed in a heated aqueous medium, was introduced from the inlet 80 and treated instantaneously to make a fine particle dispersion. The amount of material liquid supplied was 1 kg/h, and the maximum rotational speed of the rotating body 83 was 100 m/s.

70 g of ion-exchanged water, 1 g of anionic surfactant (SCF manufactured by Sanyo Chemical Industries, Ltd.), 1 g of nonionic surfactant (Newcol 565C manufactured by Nippon Nyukazai Co., Ltd), and 28 g of wax (W-8) were blended and treated in an amount supplied of 1 kg/h while the rotating body rotated at a rotational speed of 100 m/s. Thus, a wax particle dispersion WA8 was provided.

(9) Preparation of Wax Particle Dispersion WA9

Under the same conditions as (3), 70 g of ion-exchanged water, 1 g of anionic surfactant (SCF manufactured by Sanyo Chemical Industries, Ltd.), 1 g of nonionic surfactant (Newcol 565C manufactured by Nippon Nyukazai Co., Ltd), and 28 g of wax (W-9) were blended and treated while the rotating body rotated at a rotational speed of 20 m/s for 3 minutes, and then 45 m/s for 4 minutes. Thus, a wax particle dispersion WA9 was provided.

(10) Preparation of Wax Particle Dispersion wa10

70 g of ion-exchanged water, 1 g of anionic surfactant (SCF manufactured by Sanyo Chemical Industries, Ltd.), 1 g of nonionic surfactant (Newcol 565C manufactured by Nippon Nyukazai Co., Ltd), and 28 g of paraffin wax (HNP-10 (melting point: 75° C.) manufactured by Nippon Seiro Co., Ltd.) were blended and treated for 30 minutes by using a homogenizer. Thus, a wax particle dispersion wa10 was provided.

(11) Preparation of Wax Particle Dispersion wa11

70 g of ion-exchanged water, 1 g of anionic surfactant (SCF manufactured by Sanyo Chemical Industries, Ltd.), 1 g of nonionic surfactant (Newcol 565C manufactured by Nippon Nyukazai Co., Ltd), and 28 g of Fischer-Tropsch wax (FT0070 (melting point: 72° C.) manufactured by Nippon Seiro Co., Ltd.) were blended and treated for 30 minutes by using a homogenizer. Thus, a wax particle dispersion wall was provided.

(12) Preparation of Wax Particle Dispersion wa12

70 g of ion-exchanged water, 1 g of anionic surfactant (SCF manufactured by Sanyo Chemical Industries, Ltd.), 1 g of nonionic surfactant (Newcol 565C manufactured by Nippon Nyukazai Co., Ltd), and 28 g of hydrocarbon wax (LUVAX2191 (melting point: 83° C.) manufactured by Nippon Seiro Co., Ltd.) were blended and treated for 30 minutes by using a homogenizer. Thus, a wax particle dispersion wa12 was provided.

Example 4

Toner bases were produced. Table 7 shows the toner compositions.

TABLE 7

| Toner base | First resin particles | Pigment dispersion | First wax | Second particle dispersion | Resin A particle dispersion | Resin B particle dispersion | Fifth particle dispersion | Second wax | Volume-based average particle size (μm) | Volume-based coefficient of variation |
|---|---|---|---|---|---|---|---|---|---|---|
| M1 | RL1 | PM1 | | RL2 | | | | WA2 | 4.2 | 15.5 |
| M2 | RL1 | PM1 | WA1 | RH4 | | | | WA3 | 6.2 | 14.8 |
| M3 | RL3 | PM1 | | RL2 | | | | WA4 | 5.5 | 15.1 |
| M4 | RL3 | PM1 | | RH5 | | | | WA5 | 4.9 | 15.2 |
| M5 | RL1 | PM1 | | RH4 | | | | WA6 | 6.2 | 13.9 |
| M6 | RL2 | PM1 | WA2 | RH5 | | | | WA7 | 5.4 | 13.7 |
| M7 | RL3 | PM1 | | RH4 | | | | WA8 | 5.1 | 14.9 |
| M8 | RL1 | PM1 | WA4 | RH6 | | | | WA9 | 6.4 | 14.9 |
| M9 | RL1 | PM1 | WA2 | | RL2 | RH5 | | | 5 | 15.4 |
| M10 | RL1 | PM1 | WA3 | | RL1 | RH6 | | | 6.3 | 14 |
| M11 | RL3 | PM1 | WA1 | | RL3 | RH6 | | | 5.6 | 14.2 |
| M12 | RL3 | PM1 | WA8 | | RL2 | RH7 | | | 5.6 | 16 |
| M13 | RL3 | PM1 | WA9 | | RL1 | RH6 | | | 6.5 | 15.2 |
| m14 | RL1 | PM1 | WA4 | | | | | | 5.6 | 18.9 |
| m15 | RL2 | PM1 | WA2 | | | | | | 6.2 | 19.8 |
| m16 | RH4 | PM1 | WA2 | RH4 | | | | | 4.8 | 25.1 |
| m17 | RH5 | PM1 | WA8 | RH5 | | | | | 5.2 | 22.5 |
| m18 | RL3 | PM1 | wa10 | RH4 | | | | | 10.8 | 28.8 |
| m19 | RL3 | PM1 | wa11 | RH4 | | | | | 14.8 | 35.1 |
| m20 | RL3 | PM1 | wa12 | RH4 | | | | | 21 | 38.8 |
| M21 | RL1 | PM1 | WA1 | | | | RH8 | | 5.5 | 17.2 |

(1) Preparation of Toner Base M1

In a 2000 ml four-neck flask equipped with a cooling tube and a thermometer were placed 204 g of first resin particle dispersion RL1, 30 g of pigment particle dispersion PM1, and 300 ml of ion-exchanged water, and then mixed for 10 minutes by using a homogenizer (Ultratalax T25 manufactured by IKA CO., LTD.), thus providing a mixed particle dispersion. The pH of the mixed particle dispersion was 5.8.

The pH was increased to 12.0 by adding 1N NaOH to the mixed particle dispersion. Subsequently, 222 g of magnesium sulfate aqueous solution (30% concentration) was added and stirred for 10 minutes. After the temperature was raised from 22° C. to 70° C. at a rate of 3° C./min, the mixture was heat-treated at 70° C. for 2 hours. The temperature was raised to 80° C., and then the mixture further was heat-treated for 5 hours to provide aggregated particles. The resultant aggregated particle dispersion had a pH of 9.3. The volume-average particle size was 3.1 μm, and the coefficient of variation was 16.1.

After the water temperature was reduced to 60° C., 43 g of second resin particle dispersion RL2 and 50 g of wax particle dispersion WA2 were added to the aggregated particle dispersion, and the pH was adjusted to 8.6 by the addition of 1N NaOH. This mixture was heated at 80° C. for 0.5 hour, and the pH was adjusted to 6.6 by the addition of 1N HCl. Then, the mixture further was heated at 80° C. for 2 hours.

After cooling, the reaction product (toner base) was filtered and washed three times with ion-exchanged water. The toner base thus obtained was dried at 40° C. for 6 hours by using a fluid-type dryer, resulting in a toner base M1 with a volume-average particle size of 4.2 μm and a coefficient of variation of 15.5. The toner base M1 had KC of 124, BTs/BTk of 2.01, and a surface roughness index (the proportion of black) of 86.1.

When the pH after adding the second resin particle dispersion RL2 and the wax particle dispersion WA2 was 5.0, the second resin particles and the wax did not adhere to the aggregated particles easily, and the liberated particles were increased. When the pH was 9.0, secondary aggregation of the aggregated particles occurred, and the particle size became larger to about 20 μm.

When the pH after heat treatment was 3.0, the resin particles that once adhered were liberated partially to cause fine particles. When the pH was 7.0, secondary aggregation of the aggregated particles occurred, and the particle size became larger to about 24 μm.

(2) Preparation of Toner Base M2

In a 2000 ml four-neck flask equipped with a cooling tube and a thermometer were placed 204 g of first resin particle dispersion RL1, 30 g of pigment particle dispersion PM1, 25 g of wax particle dispersion WA1, and 300 ml of ion-exchanged water, and then mixed for 10 minutes by using a homogenizer (Ultratalax T25 manufactured by IKA CO., LTD.), thus providing a mixed particle dispersion. The pH of the mixed particle dispersion was 2.8.

The pH was increased to 9.6 by adding 1N NaOH to the mixed particle dispersion. Subsequently, 246 g of magnesium sulfate aqueous solution (30% concentration) was added and stirred for 10 minutes. After the temperature was raised from 22° C. to 70° C. at a rate of 5° C./min, the mixture was heat-treated at 70° C. for 2 hours. The temperature was raised to 80° C., and then the mixture further was heat-treated for 5 hours to provide aggregated particles. The resultant aggregated particle dispersion had a pH of 7.2. The volume-average particle size was 5.2 μm, and the coefficient of variation was 14.9.

After the water temperature was reduced to 60° C., 43 g of second resin particle dispersion RH4 and 25 g of wax particle dispersion WA3 were added to the aggregated particle dispersion, and the pH was adjusted to 8.6 by the addition of 1N NaOH. This mixture was heated at 80° C. for 0.5 hour, and the pH was adjusted to 6.6 by the addition of 1N HCl. Then, the mixture further was heated at 90° C. for 2 hours.

After cooling, the reaction product (toner base) was filtered and washed three times with ion-exchanged water. The toner base thus obtained was dried at 40° C. for 6 hours by using a fluid-type dryer, resulting in a toner base M2 with a volume-average particle size of 6.2 μm and a coefficient of variation of 14.8.

Figure 9A:
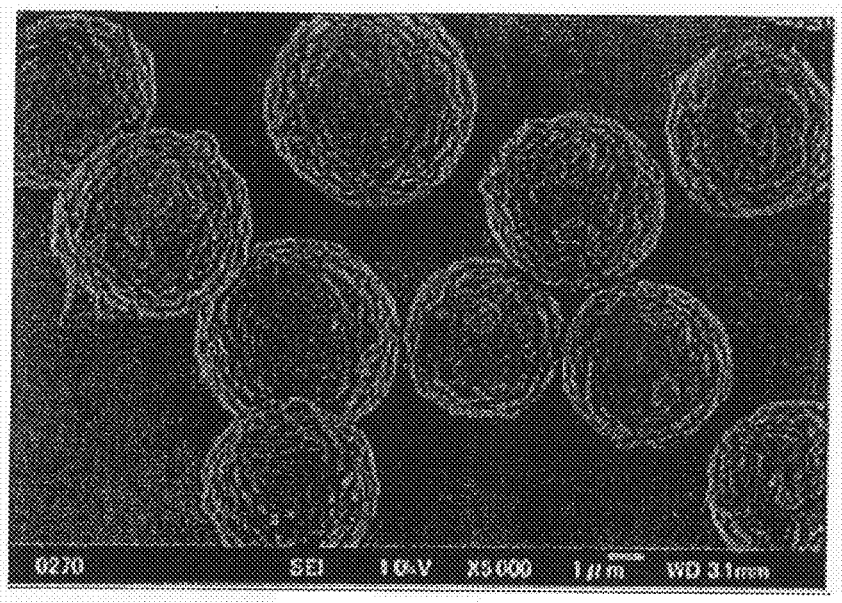
FIG. 9A shows a surface observation image of toner by an electron microscope in an example of the present invention.
Figure 9B:
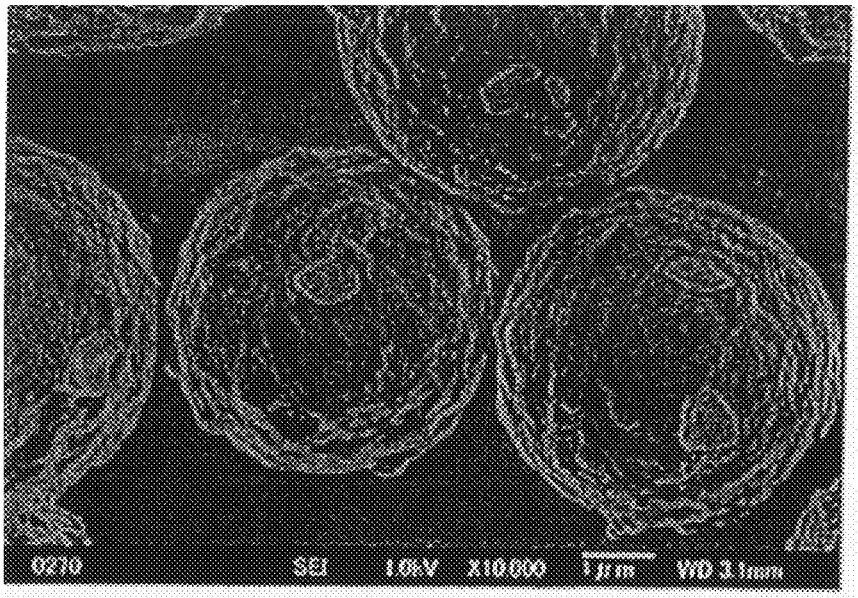
FIG. 9B shows a surface observation image of toner by an electron microscope in an example of the present invention.
Figure 18A:
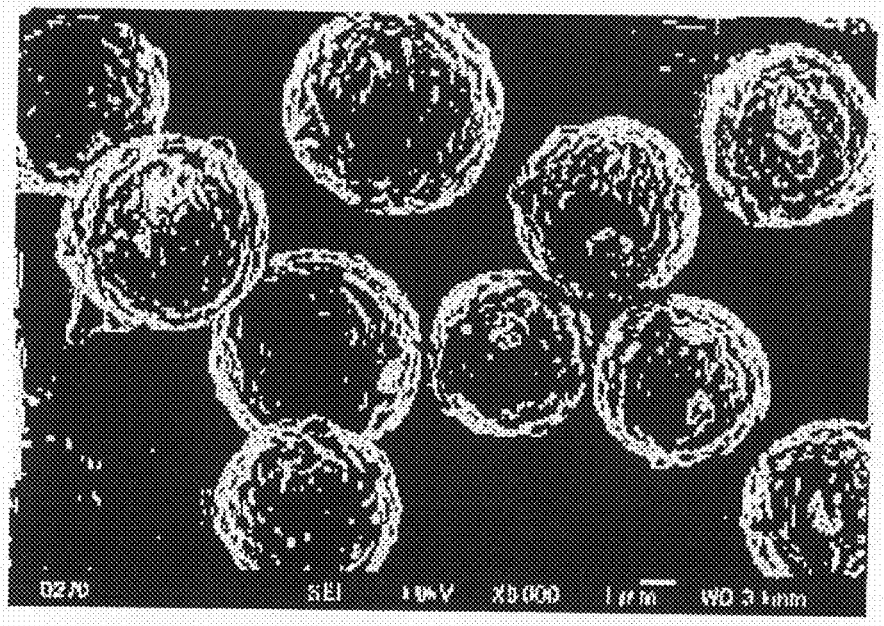
FIG. 18A shows a binary picture of the surface observation image of the toner in FIG. 9A.
Figure 18B:
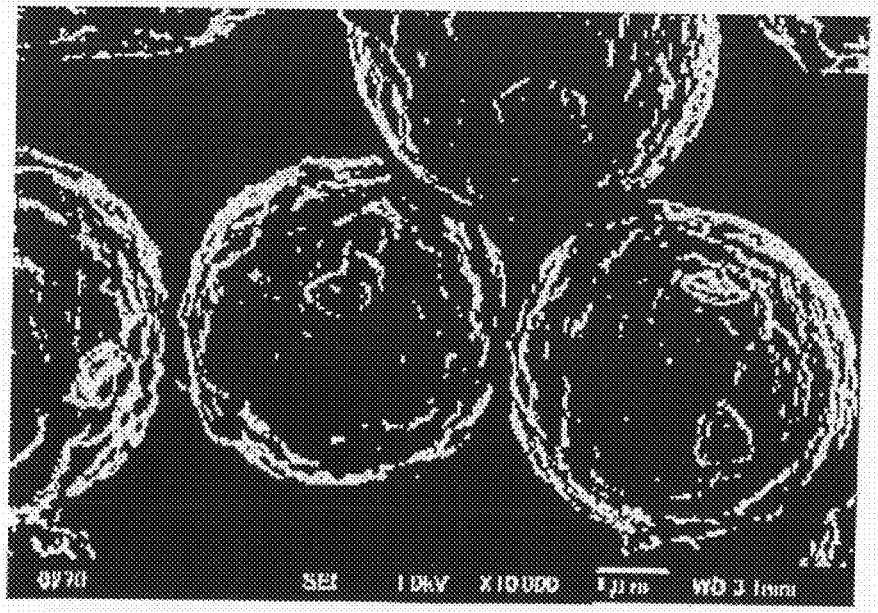
FIG. 18B shows a binary picture of the surface observation image of the toner in FIG. 9B.

FIGS. 9A and 9B show SEM observation images of the toner base M2, and FIGS. 18A and 18B show binary pictures of the SEM observation images. The magnification is 5000 times for the upper figure A and 10000 times for the lower figure B. The observation indicated that fine roughness was formed in the surface of the toner base M2. The toner base M2 had KC of 121, BTs/BTk of 1.61, and a surface roughness index (the proportion of black) of 88.1.

When the pH immediately after preparing the mixed particle dispersion was more than 6.0, the pH fluctuation (pH decrease) was increased during the formation of the aggregated particles by heating the mixed particle dispersion, and the particles became coarser.

When the pH before adding the water-soluble inorganic salt and heating was less than 9.5, the aggregated particles became coarser. When the pH was 9.1, the volume-average particle size of the aggregated particles was increased to 15.5 μm, and the coefficient of variation also was increased to 32.5. However, when the pH was 12.5, the liberated wax was increased, and it was difficult to incorporate the wax uniformly into the resin particles.

When the pH of the liquid at the time of forming the aggregated particles was more than 9.5, the liberated wax was increased due to poor aggregation. When the pH was less than 7.0, the aggregated particles became coarser.

(3) Preparation of Toner Base M3

In a 2000 ml four-neck flask equipped with a cooling tube and a thermometer were placed 204 g of first resin particle dispersion RL3, 30 g of pigment particle dispersion PM1, and 300 ml of ion-exchanged water, and then mixed for 10 minutes by using a homogenizer (Ultratalax T25 manufactured by IKA CO., LTD.), thus providing a mixed particle dispersion. The pH of the mixed particle dispersion was 4.2.

The pH was increased to 11.2 by adding 1N NaOH to the mixed particle dispersion. Subsequently, 222 g of magnesium sulfate aqueous solution (30% concentration) was added and stirred for 10 minutes. After the temperature was raised from 22° C. to 70° C. at a rate of 5° C./min, the mixture was heat-treated at 70° C. for 2 hours. The temperature was raised to 80° C., and then the mixture further was heat-treated for 5 hours to provide aggregated particles. The resultant aggregated particle dispersion had a pH of 8.5. The volume-average particle size was 4.5 μm, and the coefficient of variation was 14.1.

After the water temperature was reduced to 60° C., 43 g of second resin particle dispersion RL2 and 50 g of wax particle dispersion WA4 were added to the aggregated particle dispersion, and the pH was adjusted to 8.6 by the addition of 1N NaOH. This mixture was heated at 80° C. for 0.5 hour, and the pH was adjusted to 6.6 by the addition of 1N HCl. Then, the mixture further was heated at 80° C. for 2 hours.

After cooling, the reaction product (toner base) was filtered and washed three times with ion-exchanged water. The toner base thus obtained was dried at 40° C. for 6 hours by using a fluid-type dryer, resulting in a toner base M3 with a volume-average particle size of 5.5 μm and a coefficient of variation of 15.1. The toner base M3 had KC of 129, BTs/BTk of 2.10, and a surface roughness index (the proportion of black) of 81.4.

(4) Preparation of Toner Base M4

In a 2000 ml four-neck flask equipped with a cooling tube and a thermometer were placed 204 g of first resin particle dispersion RL3, 30 g of pigment particle dispersion PM1, and 300 ml of ion-exchanged water, and then mixed for 10 minutes by using a homogenizer (Ultratalax T25 manufactured by IKA CO., LTD.), thus providing a mixed particle dispersion. The pH of the mixed particle dispersion was 5.8.

The pH was increased to 11.9 by adding 1N NaOH to the mixed particle dispersion. Subsequently, 222 g of magnesium sulfate aqueous solution (30% concentration) was added and stirred for 10 minutes. After the temperature was raised from 22° C. to 70° C. at a rate of 5° C./min, the mixture was heat-treated at 70° C. for 2 hours. The temperature was raised to 85° C., and then the mixture further was heat-treated for 5 hours to provide aggregated particles. The resultant aggregated particle dispersion had a pH of 9.3. The volume-average particle size was 3.7 μm, and the coefficient of variation was 15.0.

After the water temperature was reduced to 60° C., 43 g of second resin particle dispersion RH5 and 50 g of wax particle dispersion WA5 were added to the aggregated particle dispersion, and the pH was adjusted to 8.6 by the addition of 1N NaOH. This mixture was heated at 80° C. for 0.5 hour, and the pH was adjusted to 6.6 by the addition of 1N HCl. Then, the mixture further was heated at 95° C. for 2 hours.

After cooling, the reaction product (toner base) was filtered and washed three times with ion-exchanged water. The toner base thus obtained was dried at 40° C. for 6 hours by using a fluid-type dryer, resulting in a toner base M4 with a volume-average particle size of 4.9 μm and a coefficient of variation of 15.2.

Figure 10A:
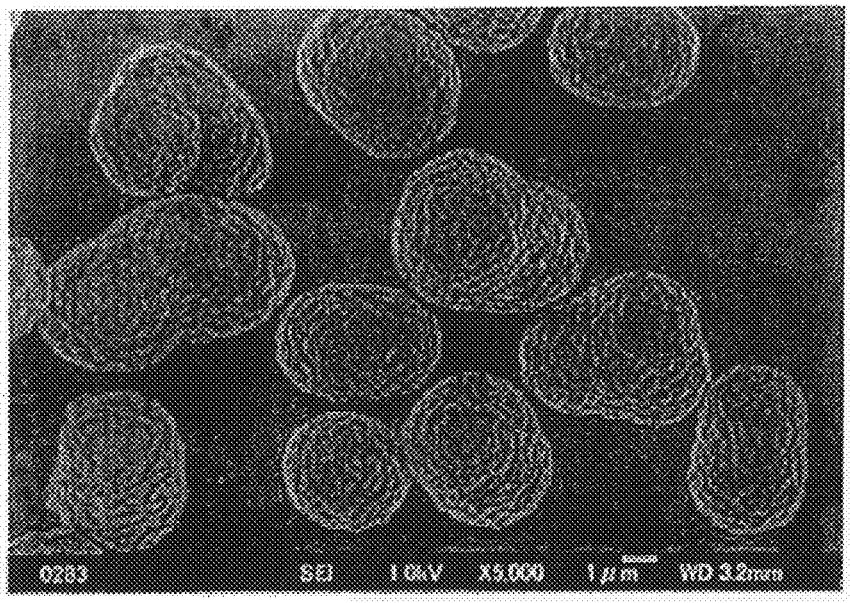
FIG. 10A shows a surface observation image of toner by an electron microscope in another example of the present invention.
Figure 10B:
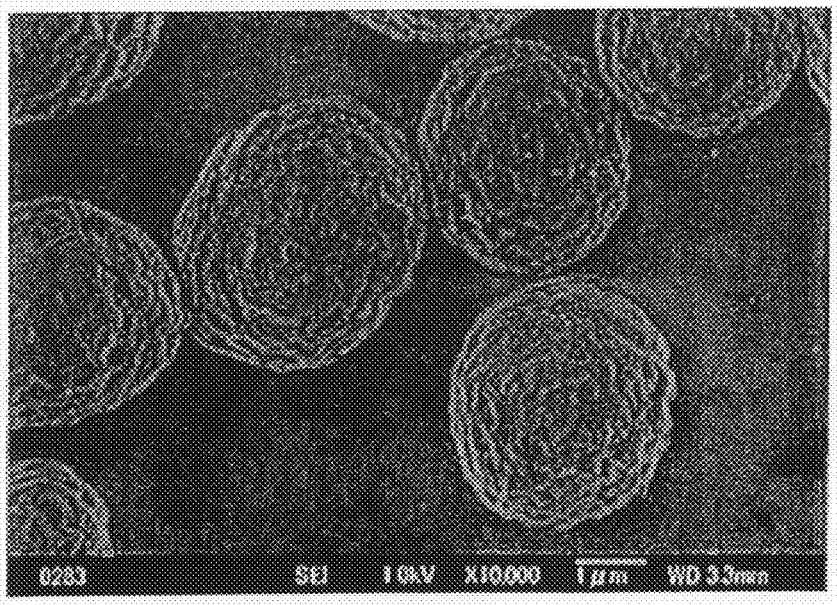
FIG. 10B shows a surface observation image of toner by an electron microscope in another example of the present invention.
Figure 19A:
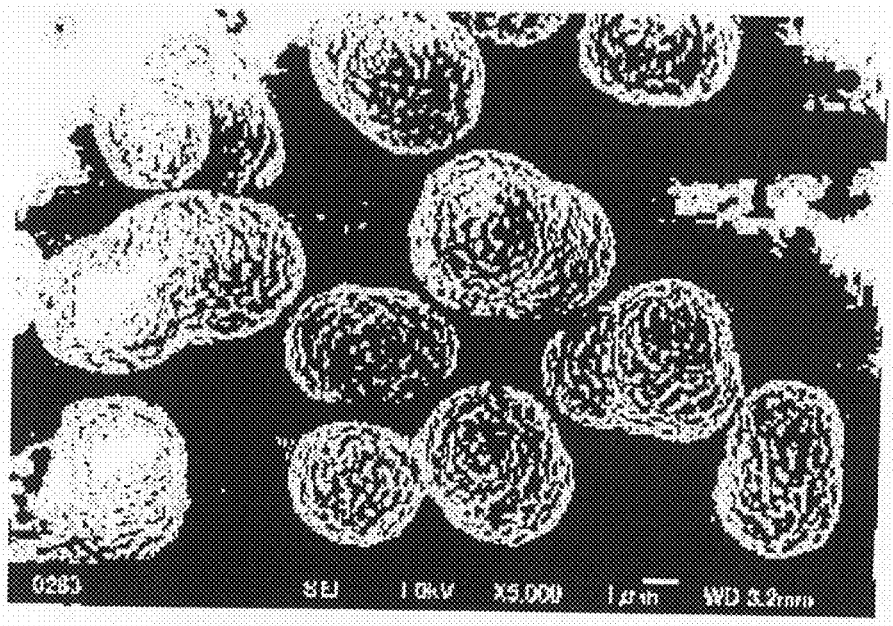
FIG. 19A shows a binary picture of the surface observation image of the toner in FIG. 10A.
Figure 19B:
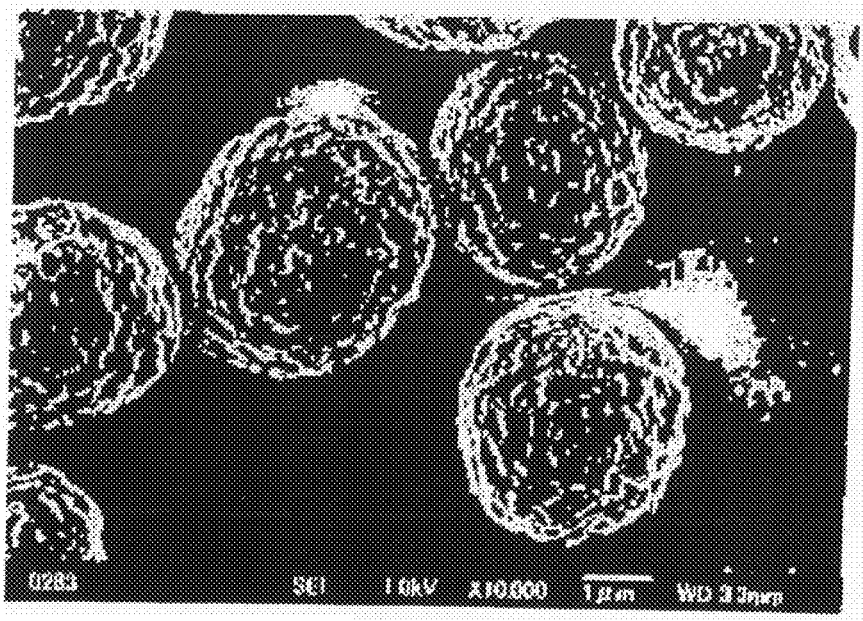
FIG. 19B shows a binary picture of the surface observation image of the toner in FIG. 10B.

FIGS. 10A and 10B show SEM observation images of the toner base M4, and FIGS. 19A and 19B show binary pictures of the SEM observation images. The magnification is 5000 times for the upper figure A and 10000 times for the lower figure B. The observation indicated that fine roughness was formed in the surface of the toner base M4. The toner base M2 had KC of 122, BTs/BTk of 2.21, and a surface roughness index (the proportion of black) of 76.9.

(5) Preparation of Toner Base M5

In a 2000 ml four-neck flask equipped with a cooling tube and a thermometer were placed 204 g of first resin particle dispersion RL1, 30 g of pigment particle dispersion PM1, and 300 ml of ion-exchanged water, and then mixed for 10 minutes by using a homogenizer (Ultratalax T50 manufactured by IKA CO., LTD.), thus providing a mixed particle dispersion. The pH of the mixed particle dispersion was 2.2.

The pH was increased to 9.7 by adding 1N NaOH to the mixed particle dispersion. Subsequently, 222 g of magnesium sulfate aqueous solution (30% concentration) was added and stirred for 10 minutes. After the temperature was raised from 22° C. to 70° C. at a rate of 5° C./min, the mixture was heat-treated at 70° C. for 2 hours. The temperature was raised to 85° C., and then the mixture further was heat-treated for 5 hours to provide aggregated particles. The resultant aggregated particle dispersion had a pH of 7.2. The volume-average particle size was 5.3 μm, and the coefficient of variation was 13.8.

After the water temperature was reduced to 60° C., 43 g of second resin particle dispersion RH4 and 50 g of wax particle dispersion WA6 were added to the aggregated particle dispersion, and the pH was adjusted to 5.0 by the addition of 1N NaOH. This mixture was heated at 80° C. for 2 hours, and the pH was adjusted to 3.4 by the addition of 1N HCl. Then, the mixture further was heated at 90° C. for 2 hours.

After cooling, the reaction product (toner base) was filtered and washed three times with ion-exchanged water. The toner base thus obtained was dried at 40° C. for 6 hours by using a fluid-type dryer, resulting in a toner base M5 with a volume-average particle size of 6.2 μm and a coefficient of variation of 13.9. The toner base M5 had KC of 123, BTs/BTk of 1.94, and a surface roughness index (the proportion of black) of 79.1.

(6) Preparation of Toner Base M6

In a 2000 ml four-neck flask equipped with a cooling tube and a thermometer were placed 204 g of first resin particle dispersion RL2, 30 g of pigment particle dispersion PM1, 25 g of wax particle dispersion WA2, and 300 ml of ion-exchanged water, and then mixed for 10 minutes by using a homogenizer (Ultratalax T50 manufactured by IKA CO., LTD.), thus providing a mixed particle dispersion. The pH of the mixed particle dispersion was 3.8.

The pH was increased to 11.2 by adding 1N NaOH to the mixed particle dispersion. Subsequently, 246 g of magnesium sulfate aqueous solution (30% concentration) was added and stirred for 10 minutes. After the temperature was raised from 22° C. to 70° C. at a rate of 5° C./min, the mixture was heat-treated at 70° C. for 2 hours. The temperature was raised to 85° C., and then the mixture further was heat-treated for 5 hours to provide aggregated particles. The resultant aggregated particle dispersion had a pH of 8.5. The volume-average particle size was 4.3 μm, and the coefficient of variation was 13.6.

After the water temperature was reduced to 60° C., 43 g of second resin particle dispersion RH5 and 50 g of wax particle dispersion WA7 were added to the aggregated particle dispersion, and the pH was adjusted to 6.8 by the addition of 1N NaOH. This mixture was heated at 80° C. for 1 hour, and the pH was adjusted to 5.0 by the addition of 1N HCl. Then, the mixture further was heated at 95° C. for 5 hours.

After cooling, the reaction product (toner base) was filtered and washed three times with ion-exchanged water. The toner base thus obtained was dried at 40° C. for 6 hours by using a fluid-type dryer, resulting in a toner base M6 with a volume-average particle size of 5.4 μm and a coefficient of variation of 13.7. The toner base M6 had KC of 126, BTs/BTk of 2.04, and a surface roughness index (the proportion of black) of 81.1.

(7) Preparation of Toner Base M7

In a 2000 ml four-neck flask equipped with a cooling tube and a thermometer were placed 204 g of first resin particle dispersion RL3, 30 g of pigment particle dispersion PM1, and 300 ml of ion-exchanged water, and then mixed for 10 minutes by using a homogenizer (Ultratalax T25 manufactured by IKA CO., LTD.), thus providing a mixed particle dispersion. The pH of the mixed particle dispersion was 4.2.

The pH was increased to 11.8 by adding 1N NaOH to the mixed particle dispersion. Subsequently, 222 g of magnesium sulfate aqueous solution (30% concentration) was added and stirred for 10 minutes. After the temperature was raised from 22° C. to 70° C. at a rate of 5° C./min, the mixture was heat-treated at 70° C. for 2 hours. The temperature was raised to 85° C., and then the mixture further was heat-treated for 5 hours to provide aggregated particles. The resultant aggregated particle dispersion had a pH of 9.2. The volume-average particle size was 4.1 μm, and the coefficient of variation was 14.2.

After the water temperature was reduced to 60° C., 43 g of second resin particle dispersion RH4 and 50 g of wax particle dispersion WA8 were added to the aggregated particle dispersion, and the pH was adjusted to 8.0 by the addition of 1N NaOH. This mixture was heated at 80° C. for 1 hour, and the pH was adjusted to 6.0 by the addition of 1N HCl. Then, the mixture further was heated at 90° C. for 5 hours.

After cooling, the reaction product (toner base) was filtered and washed three times with ion-exchanged water. The toner base thus obtained was dried at 40° C. for 6 hours by using a fluid-type dryer, resulting in a toner base M7 with a volume-average particle size of 5.1 μm and a coefficient of variation of 14.9.

Figure 11A:
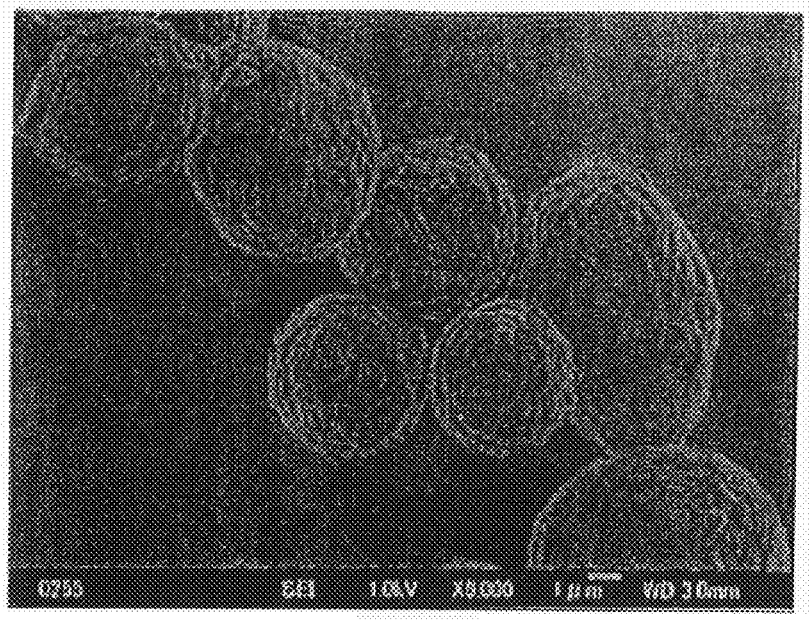
FIG. 11A shows a surface observation image of toner by an electron microscope in another example of the present invention.
Figure 11B:
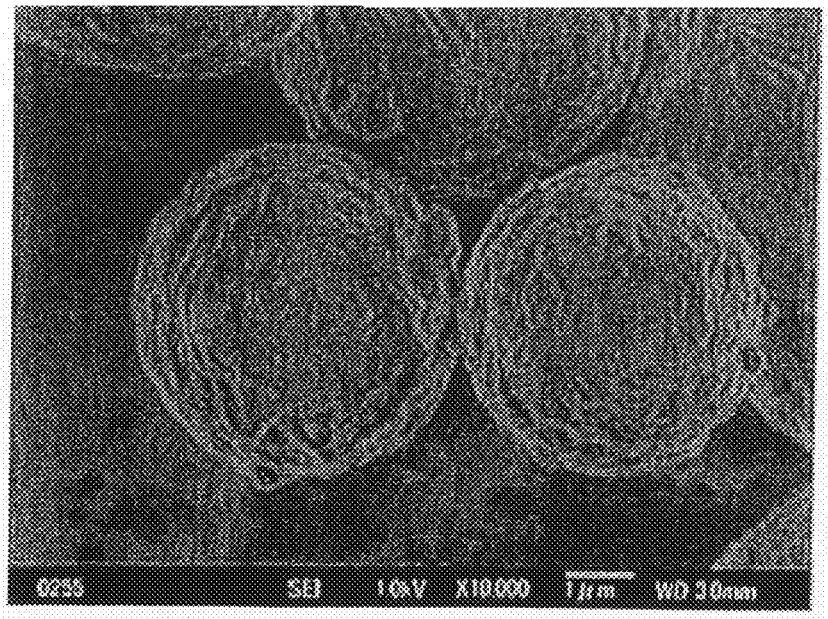
FIG. 11B shows a surface observation image of toner by an electron microscope in another example of the present invention.
Figure 20A:
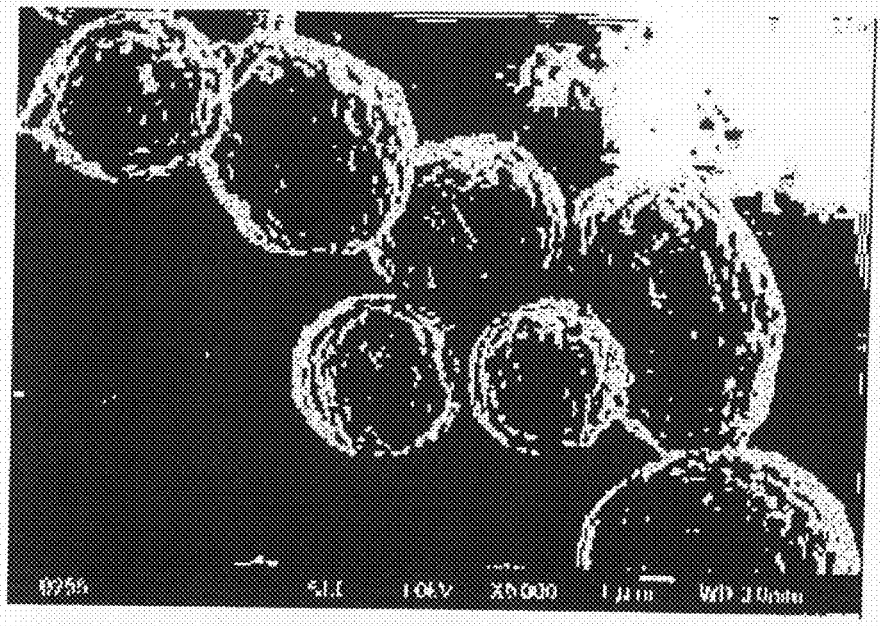
FIG. 20A shows a binary picture of the surface observation image of the toner in FIG. 11A.
Figure 20B:
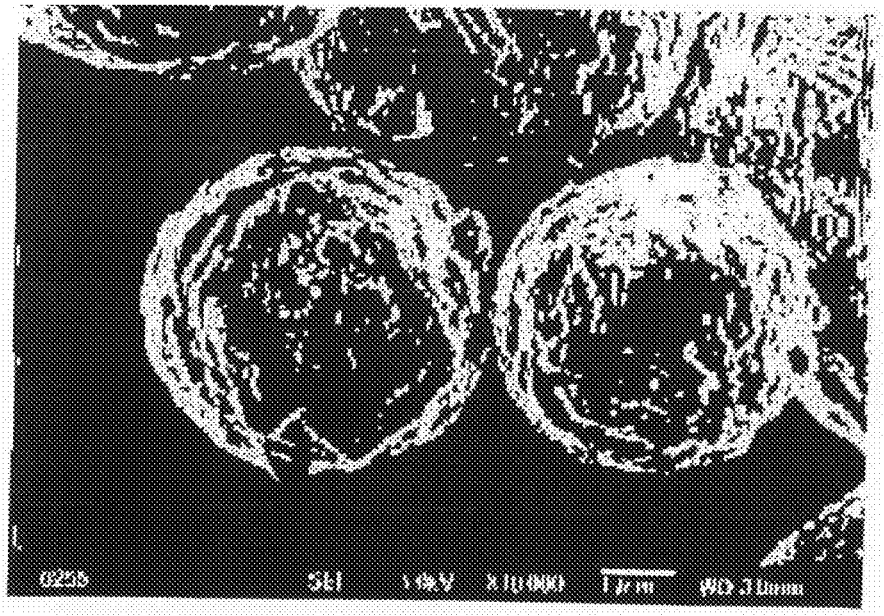
FIG. 20B shows a binary picture of the surface observation image of the toner in FIG. 11B.

FIGS. 11A and 11B show SEM observation images of the toner base M7, and FIGS. 20A and 20B show binary pictures of the SEM observation images. The magnification is 5000 times for the upper figure A and 10000 times for the lower figure B. The observation indicated that fine roughness was formed in the surface of the toner base M7. The toner base M7 had KC of 124, BTs/BTk of 2.81, and a surface roughness index (the proportion of black) of 66.9.

(8) Preparation of Toner Base M8

In a 2000 ml four-neck flask equipped with a cooling tube and a thermometer were placed 204 g of first resin particle dispersion RL1, 30 g of pigment particle dispersion PM1, 25 g of wax particle dispersion WA4, and 300 ml of ion-exchanged water, and then mixed for 10 minutes by using a homogenizer (Ultratalax T25 manufactured by IKA CO., LTD.), thus providing a mixed particle dispersion. The pH of the mixed particle dispersion was 4.3.

The pH was increased to 11.6 by adding 1N NaOH to the mixed particle dispersion. Subsequently, 246 g of magnesium sulfate aqueous solution (30% concentration) was added and stirred for 10 minutes. After the temperature was raised from 22° C. to 70° C. at a rate of 5° C./min, the mixture was heat-treated at 70° C. for 2 hours. The temperature was raised to 85° C., and then the mixture further was heat-treated for 5 hours to provide aggregated particles. The resultant aggregated particle dispersion had a pH of 8.7. The volume-average particle size was 5.2 μm, and the coefficient of variation was 14.9.

After the water temperature was reduced to 60° C., 43 g of second resin particle dispersion RH6 and 25 g of wax particle dispersion WA9 were added to the aggregated particle dispersion, and the pH was adjusted to 7.0 by the addition of 1N NaOH. This mixture was heated at 80° C. for 1 hour, and the pH was adjusted to 5.2 by the addition of 1N HCl. Then, the mixture further was heated at 95° C. for 5 hours.

After cooling, the reaction product (toner base) was filtered and washed three times with ion-exchanged water. The toner base thus obtained was dried at 40° C. for 6 hours by using a fluid-type dryer, resulting in a toner base M8 with a volume-average particle size of 6.4 μm and a coefficient of variation of 14.9. The toner base M8 had KC of 130, BTs/BTk of 2.24, and a surface roughness index (the proportion of black) of 80.2.

(9) Preparation of Toner Base M9

In a 2000 ml four-neck flask equipped with a cooling tube and a thermometer were placed 204 g of first resin particle dispersion RL1, 30 g of pigment particle dispersion PM1, 50 g of wax particle dispersion WA2, and 300 ml of ion-exchanged water, and then mixed for 10 minutes by using a homogenizer (Ultratalax T25 manufactured by IKA CO., LTD.), thus providing a mixed particle dispersion. The pH of the mixed particle dispersion was 5.8.

The pH was increased to 11.9 by adding 1N NaOH to the mixed particle dispersion. Subsequently, 270 g of magnesium sulfate aqueous solution (30% concentration) was added and stirred for 10 minutes. After the temperature was raised from 22° C. to 70° C. at a rate of 5° C./min, the mixture was heat-treated at 70° C. for 2 hours. The temperature was raised to 85° C., and then the mixture further was heat-treated for 5 hours to provide aggregated particles. The resultant aggregated particle dispersion had a pH of 9.3. The volume-average particle size was 3.7 μm, and the coefficient of variation was 15.0.

After the water temperature was reduced to 60° C., 23 g of resin A particle dispersion RL2 and 20 g of resin B particle dispersion RH5 were added to the aggregated particle dispersion, and the pH was adjusted to 8.6 by the addition of 1N NaOH. This mixture was heated at 80° C. for 0.5 hour, and the pH was adjusted to 6.6 by the addition of 1N HCl. Then, the mixture further was heated at 95° C. for 2 hours.

After cooling, the reaction product (toner base) was filtered and washed three times with ion-exchanged water. The toner base thus obtained was dried at 40° C. for 6 hours by using a fluid-type dryer, resulting in a toner base M9 with a volume-average particle size of 5.0 μm and a coefficient of variation of 15.4.

Figure 12A:
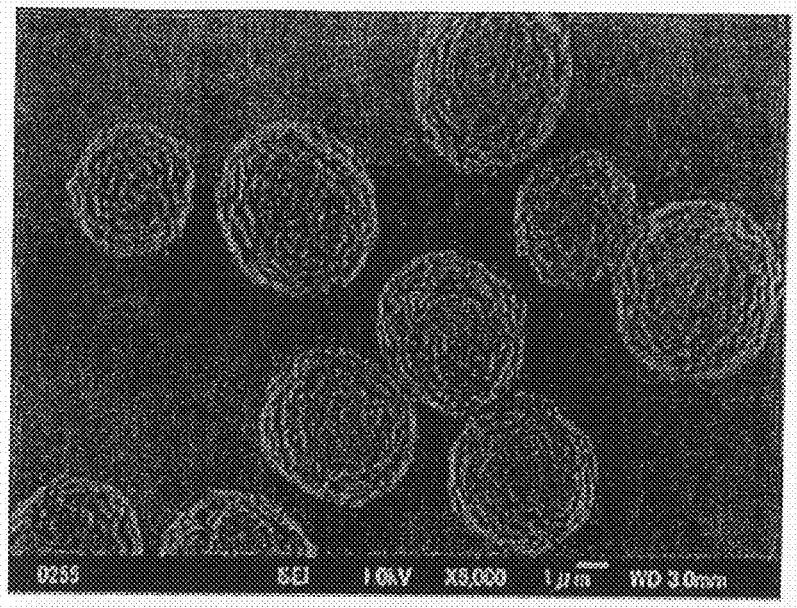
FIG. 12A shows a surface observation image of toner by an electron microscope in another example of the present invention.
Figure 12B:
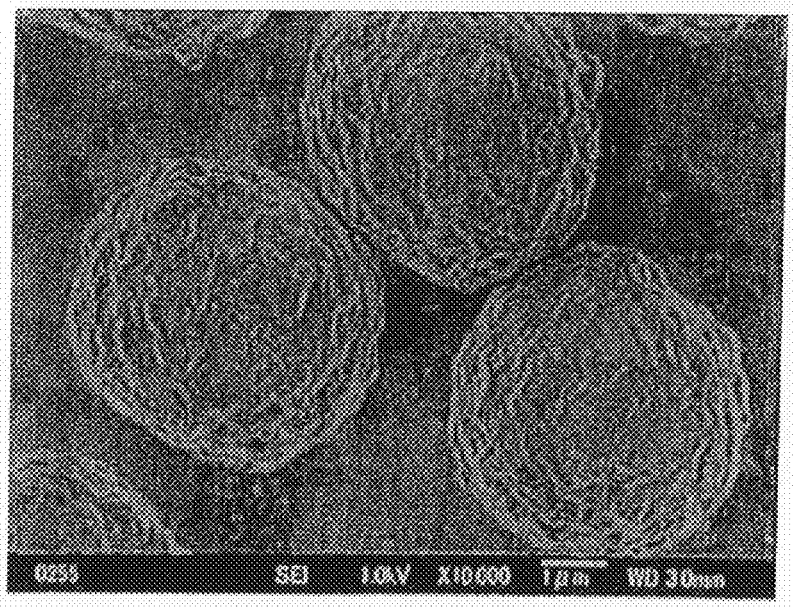
FIG. 12B shows a surface observation image of toner by an electron microscope in another example of the present invention.
Figure 21A:
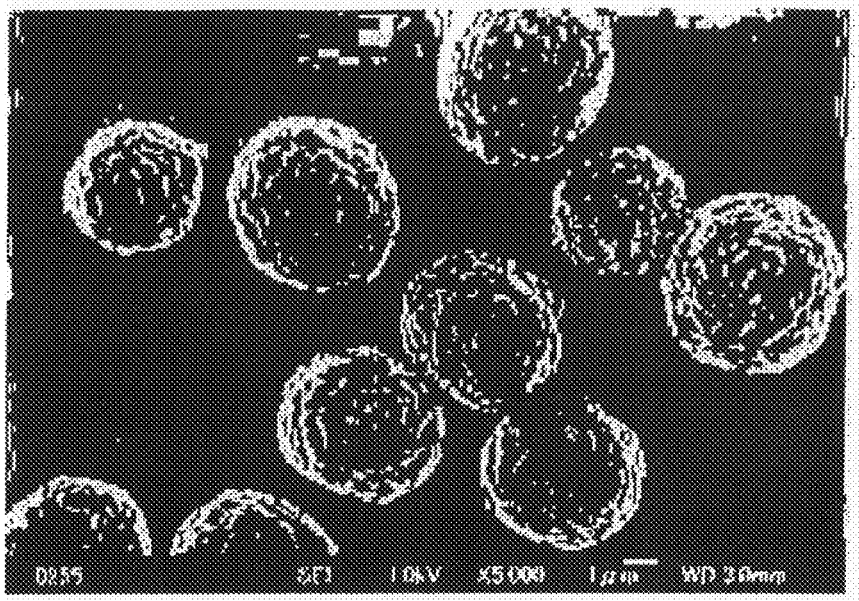
FIG. 21A shows a binary picture of the surface observation image of the toner in FIG. 12A.
Figure 21B:
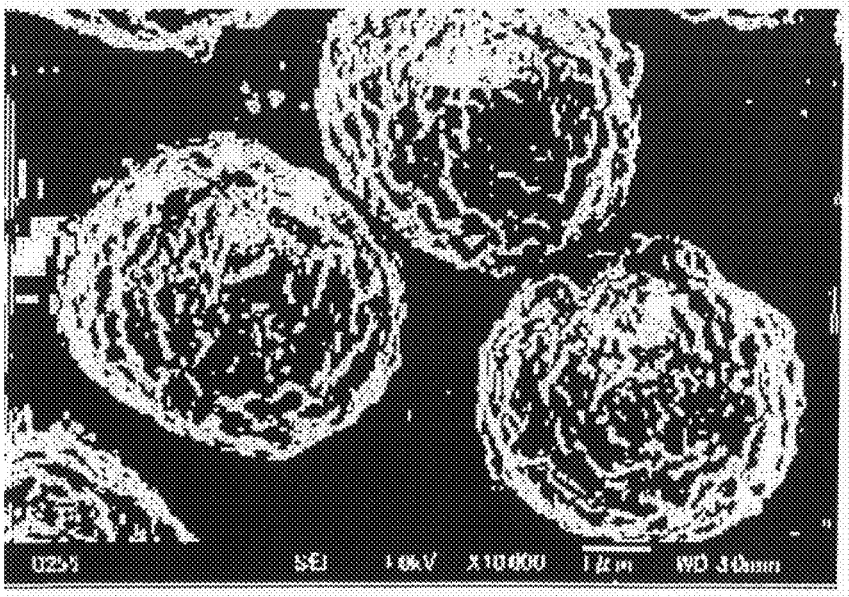
FIG. 21B shows a binary picture of the surface observation image of the toner in FIG. 12B.

FIGS. 12A and 12B show SEM observation images of the toner base M9, and FIGS. 21A and 21B show binary pictures of the SEM observation images. The magnification is 5000 times for the upper figure A and 10000 times for the lower figure B. The observation indicated that fine roughness was formed in the surface of the toner base M9. The toner base M9 had KC of 125, BTs/BTk of 3.05, and a surface roughness index (the proportion of black) of 59.0.

(10) Preparation of Toner Base M10

In a 2000 ml four-neck flask equipped with a cooling tube and a thermometer were placed 204 g of first resin particle dispersion RL1, 30 g of pigment particle dispersion PM1, 50 g of wax particle dispersion WA3, and 300 ml of ion-exchanged water, and then mixed for 10 minutes by using a homogenizer (Ultratalax T50 manufactured by IKA CO., LTD.), thus providing a mixed particle dispersion. The pH of the mixed particle dispersion was 2.2.

The pH was increased to 9.7 by adding 1N NaOH to the mixed particle dispersion. Subsequently, 270 g of magnesium sulfate aqueous solution (30% concentration) was added and stirred for 10 minutes. After the temperature was raised from 22° C. to 70° C. at a rate of 5° C./min, the mixture was heat-treated at 70° C. for 2 hours. The temperature was raised to 85° C., and then the mixture further was heat-treated for 5 hours to provide aggregated particles. The resultant aggregated particle dispersion had a pH of 7.2. The volume-average particle size was 5.2 μm, and the coefficient of variation was 13.4.

After the water temperature was reduced to 60° C., 23 g of resin A particle dispersion RL1 and 20 g of resin B particle dispersion RH6 were added to the aggregated particle dispersion, and the pH was adjusted to 5.0 by the addition of 1N NaOH. This mixture was heated at 80° C. for 2 hours, and the pH was adjusted to 3.4 by the addition of 1N HCl. Then, the mixture further was heated at 95° C. for 2 hours.

After cooling, the reaction product (toner base) was filtered and washed three times with ion-exchanged water. The toner base thus obtained was dried at 40° C. for 6 hours by using a fluid-type dryer, resulting in a toner base M10 with a volume-average particle size of 6.3 μm and a coefficient of variation of 14.0. The toner base M10 had KC of 126, BTs/BTk of 2.55, and a surface roughness index (the proportion of black) of 79.0.

(11) Preparation of Toner Base M11

In a 2000 ml four-neck flask equipped with a cooling tube and a thermometer were placed 204 g of first resin particle dispersion RL3, 30 g of pigment particle dispersion PM1, 50 g of wax particle dispersion WA1, and 300 ml of ion-exchanged water, and then mixed for 10 minutes by using a homogenizer (Ultratalax T50 manufactured by IKA CO., LTD.), thus providing a mixed particle dispersion. The pH of the mixed particle dispersion was 3.8.

The pH was increased to 11.2 by adding 1N NaOH to the mixed particle dispersion. Subsequently, 270 g of magnesium sulfate aqueous solution (30% concentration) was added and stirred for 10 minutes. After the temperature was raised from 22° C. to 70° C. at a rate of 5° C./min, the mixture was heat-treated at 70° C. for 2 hours. The temperature was raised to 85° C., and then the mixture further was heat-treated for 5 hours to provide aggregated particles. The resultant aggregated particle dispersion had a pH of 8.5. The volume-average particle size was 4.5 μm, and the coefficient of variation was 13.6.

After the water temperature was reduced to 60° C., 23 g of resin A particle dispersion RL3 and 20 g of resin B particle dispersion RH6 were added to the aggregated particle dispersion, and the pH was adjusted to 6.8 by the addition of 1N NaOH. This mixture was heated at 80° C. for 1 hour, and the pH was adjusted to 5.0 by the addition of 1N HCl. Then, the mixture further was heated at 90° C. for 5 hours.

After cooling, the reaction product (toner base) was filtered and washed three times with ion-exchanged water. The toner base thus obtained was dried at 40° C. for 6 hours by using a fluid-type dryer, resulting in a toner base M11 with a volume-average particle size of 5.6 μm and a coefficient of variation of 14.2. The toner base M11 had KC of 127, BTs/BTk of 2.62, and a surface roughness index (the proportion of black) of 82.0.

(12) Preparation of Toner Base M12

In a 2000 ml four-neck flask equipped with a cooling tube and a thermometer were placed 204 g of first resin particle dispersion RL3, 30 g of pigment particle dispersion PM1, 50 g of wax particle dispersion WA8, and 300 ml of ion-exchanged water, and then mixed for 10 minutes by using a homogenizer (Ultratalax T25 manufactured by IKA CO., LTD.), thus providing a mixed particle dispersion. The pH of the mixed particle dispersion was 4.2.

The pH was increased to 11.8 by adding 1N NaOH to the mixed particle dispersion. Subsequently, 270 g of magnesium sulfate aqueous solution (30% concentration) was added and stirred for 10 minutes. After the temperature was raised from 22° C. to 70° C. at a rate of 5° C./min, the mixture was heat-treated at 70° C. for 2 hours. The temperature was raised to 85° C., and then the mixture further was heat-treated for 5 hours to provide aggregated particles. The resultant aggregated particle dispersion had a pH of 9.2. The volume-average particle size was 4.5 μm, and the coefficient of variation was 15.8.

After the water temperature was reduced to 60° C. 23 g of resin A particle dispersion RL2 and 20 g of resin B particle dispersion RH7 were added to the aggregated particle dispersion, and the pH was adjusted to 8.0 by the addition of 1N NaOH. This mixture was heated at 80° C. for 1 hour, and the pH was adjusted to 6.0 by the addition of 1N HCl. Then, the mixture further was heated at 90° C. for 5 hours.

After cooling, the reaction product (toner base) was filtered and washed three times with ion-exchanged water. The toner base thus obtained was dried at 40° C. for 6 hours by using a fluid-type dryer, resulting in a toner base M12 with a volume-average particle size of 5.6 μm and a coefficient of variation of 16.0.

Figure 13A:
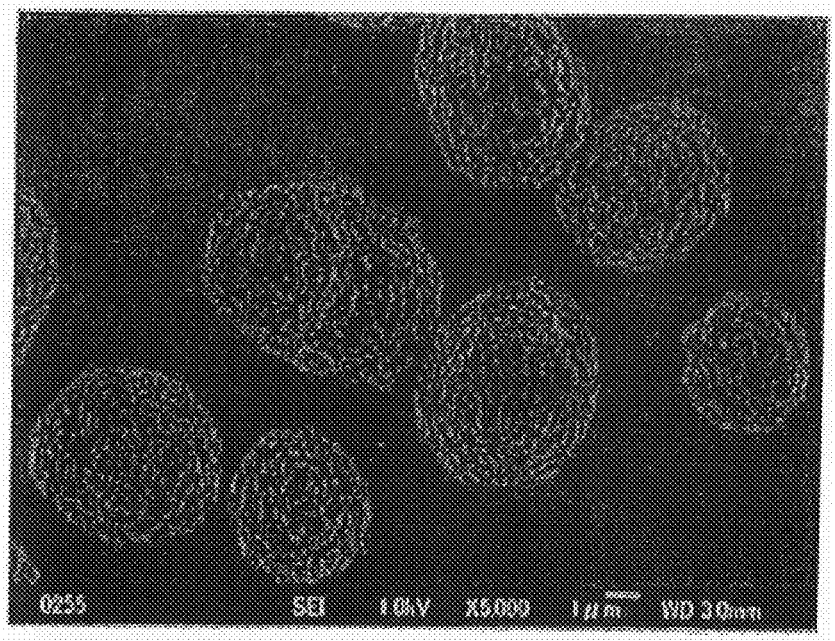
FIG. 13A shows a surface observation image of toner by an electron microscope in another example of the present invention.
Figure 13B:
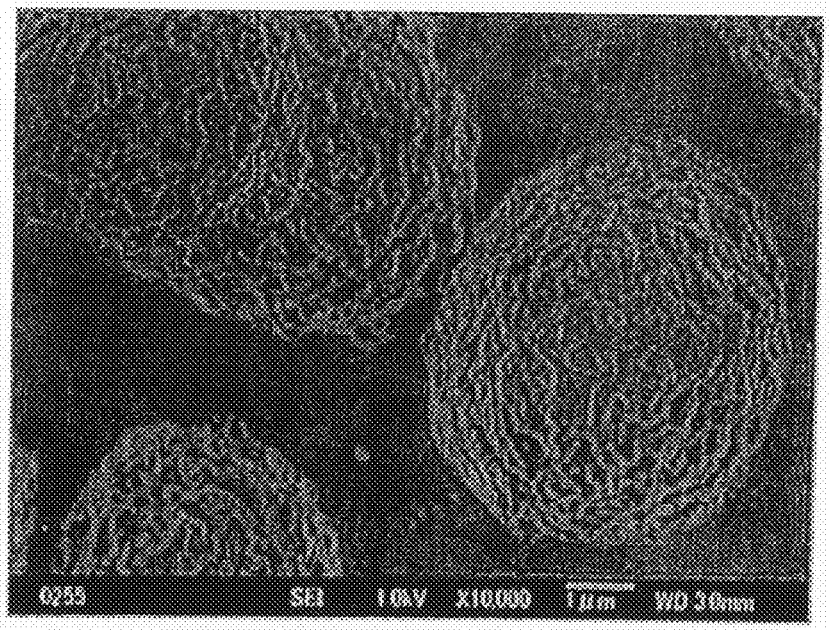
FIG. 13B shows a surface observation image of toner by an electron microscope in another example of the present invention.
Figure 22A:
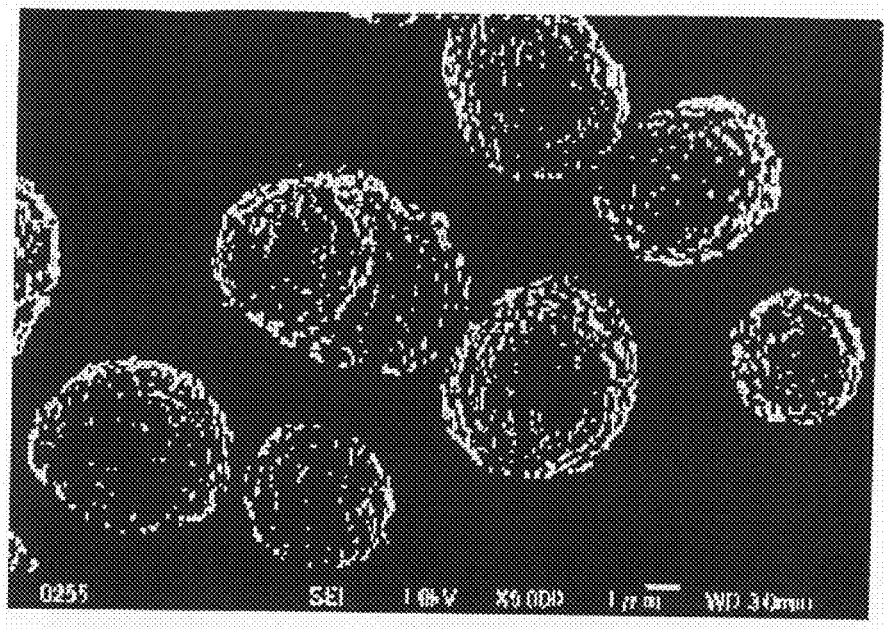
FIG. 22A shows a binary picture of the surface observation image of the toner in FIG. 13A.
Figure 22B:
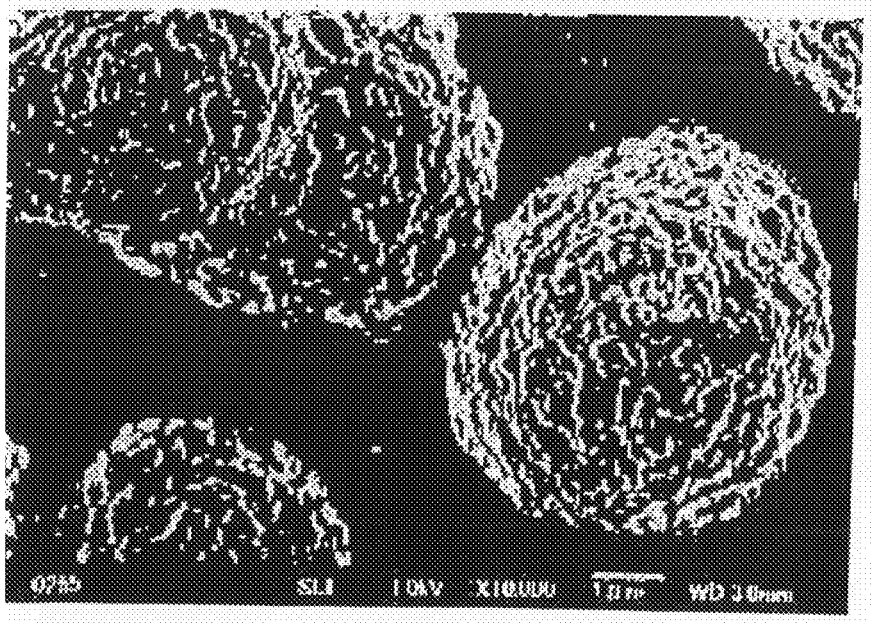
FIG. 22B shows a binary picture of the surface observation image of the toner in FIG. 13B.

FIGS. 13A and 13B show SEM observation images of the toner base M12, and FIGS. 22A and 22B show binary pictures of the SEM observation images. The magnification is 5000 times for the upper figure A and 10000 times for the lower figure B. The observation indicated that fine roughness was formed in the surface of the toner base M12. The toner base M12 had KC of 130, BTs/BTk of 5.50, and a surface roughness index (the proportion of black) of 65.4.

(13) Preparation of Toner Base M13

In a 2000 ml four-neck flask equipped with a cooling tube and a thermometer were placed 204 g of first resin particle dispersion RL3, 30 g of pigment particle dispersion PM1, 50 g of wax particle dispersion WA9, and 300 ml of ion-exchanged water, and then mixed for 10 minutes by using a homogenizer (Ultratalax T25 manufactured by IKA CO., LTD.), thus providing a mixed particle dispersion. The pH of the mixed particle dispersion was 4.3.

The pH was increased to 11.6 by adding 1N NaOH to the mixed particle dispersion. Subsequently, 270 g of magnesium sulfate aqueous solution (30% concentration) was added and stirred for 10 minutes. After the temperature was raised from 22° C. to 70° C. at a rate of 5° C./min, the mixture was heat-treated at 70° C. for 2 hours. The temperature was raised to 85° C., and then the mixture further was heat-treated for 5 hours to provide aggregated particles. The resultant aggregated particle dispersion had a pH of 8.7. The volume-average particle size was 5.4 μm, and the coefficient of variation was 14.9.

After the water temperature was reduced to 60° C., 23 g of resin A particle dispersion RL1 and 20 g of resin B particle dispersion RH6 were added to the aggregated particle dispersion, and the pH was adjusted to 7.0 by the addition of 1N NaOH. This mixture was heated at 80° C. for 1 hour, and the pH was adjusted to 5.2 by the addition of 1N HCl. Then, the mixture further was heated at 90° C. for 5 hours.

After cooling, the reaction product (toner base) was filtered and washed three times with ion-exchanged water. The toner base thus obtained was dried at 40° C. for 6 hours by using a fluid-type dryer, resulting in a toner base M13 with a volume-average particle size of 6.5 μm and a coefficient of variation of 15.2. The toner base M13 had KC of 130, BTs/BTk of 5.12, and a surface roughness index (the proportion of black) of 62.3.

(14) Preparation of Toner Base m14

In a 2000 ml four-neck flask equipped with a cooling tube and a thermometer were placed 204 g of first resin particle dispersion RL1, 25 g of pigment particle dispersion PM1, 40 g of wax particle dispersion WA4, and 250 ml of ion-exchanged water, and then mixed for 10 minutes by using a homogenizer (Ultratalax T25 manufactured by IKA CO., LTD.), thus providing a mixed particle dispersion. The pH of the mixed particle dispersion was 5.8.

The pH was increased to 11.0 by adding 1N NaOH to the mixed particle dispersion. Subsequently, 255 g of magnesium sulfate aqueous solution (30% concentration) was added and stirred for 10 minutes. After the temperature was raised from 22° C. to 70° C. at a rate of 3° C./min, the mixture was heat-treated at 70° C. for 2 hours. The temperature was raised to 80° C., and then the mixture further was heat-treated for 5 hours to provide aggregated particles. The resultant aggregated particle dispersion had a pH of 8.3.

After cooling, the reaction product (toner base) was filtered and washed three times with ion-exchanged water. The toner base thus obtained was dried at 30° C. for 6 hours by using a fluid-type dryer, resulting in a toner base m14 with a volume-average particle size of 5.6 μm and a coefficient of variation of 18.9.

Figure 7A:
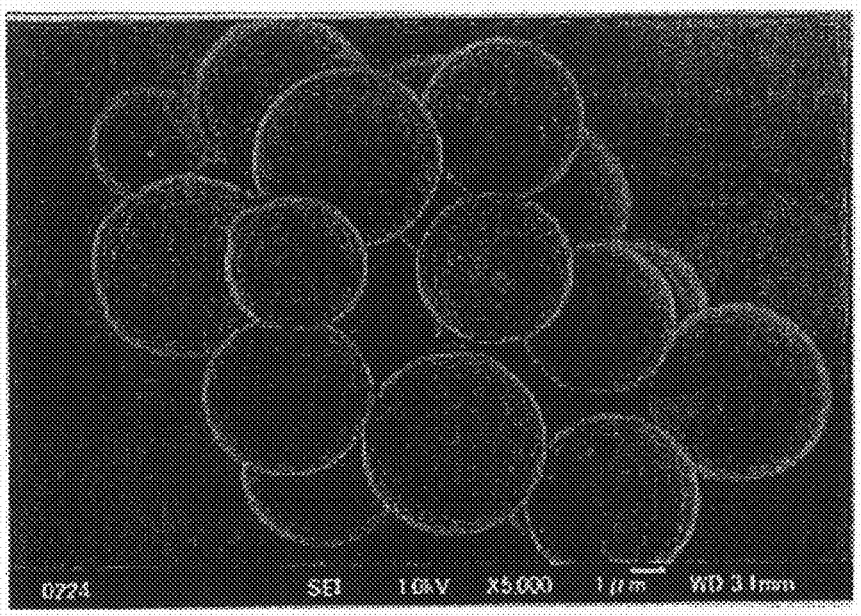
FIG. 7A shows a surface observation image of toner by an electron microscope in a comparative example.
Figure 7B:
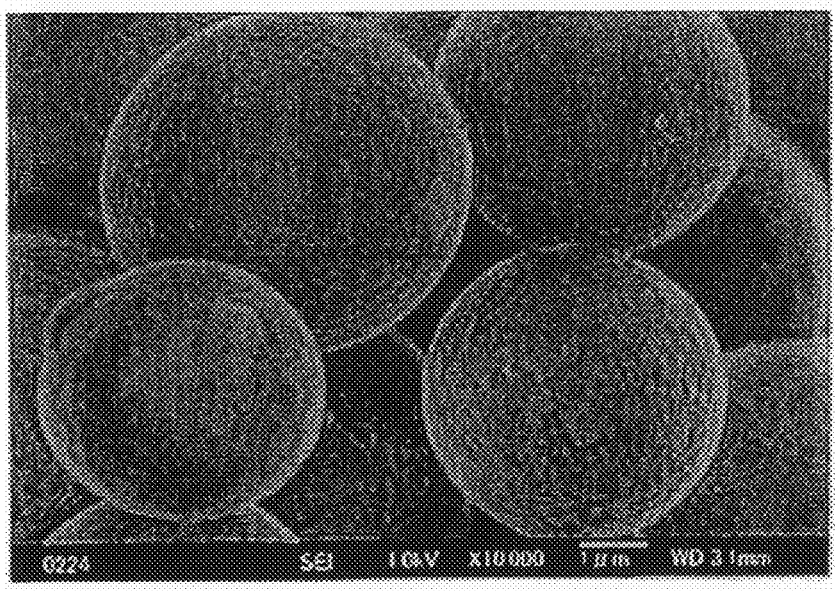
FIG. 7B shows a surface observation image of toner by an electron microscope in a comparative example.
Figure 16A:
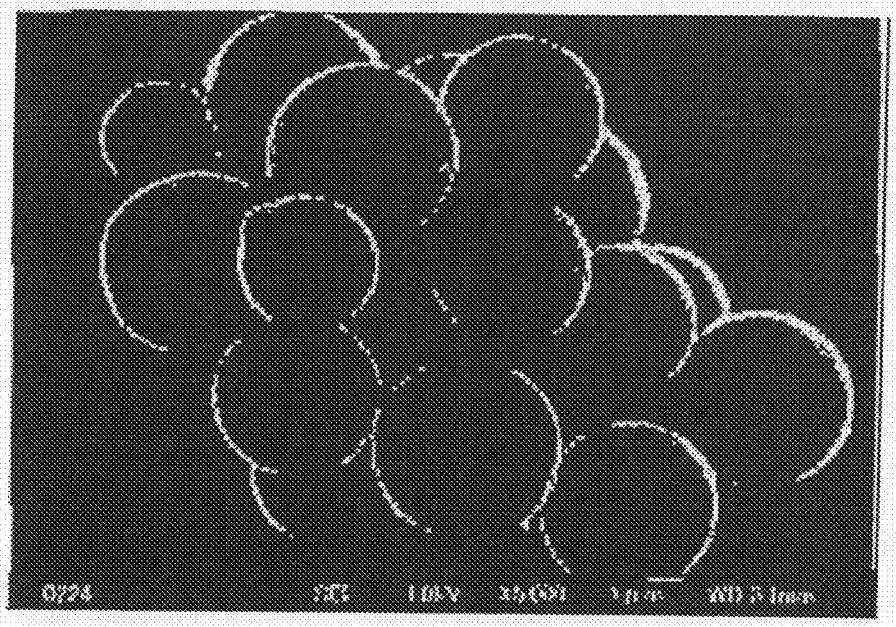
FIG. 16A shows a binary picture of the surface observation image of the toner in FIG. 7A.
Figure 16B:
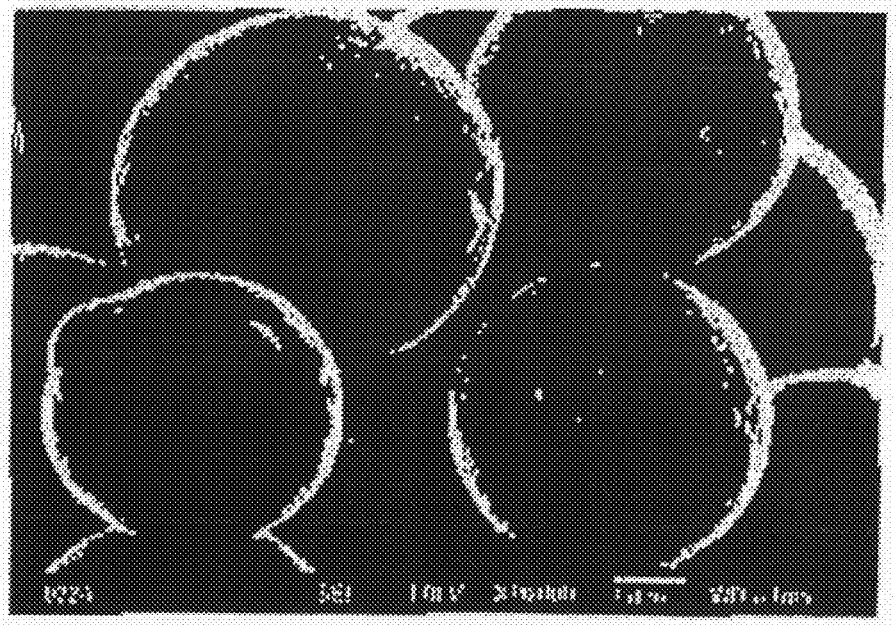
FIG. 16B shows a binary picture of the surface observation image of the toner in FIG. 7B.

FIGS. 7A and 7B show SEM observation images of the toner base m14, and FIGS. 16A and 16B show binary pictures of the SEM observation images. The magnification is 5000 times for the upper figure A and 10000 times for the lower figure B. The observation indicated that the surface of the toner base m14 was substantially smooth and had no roughness. The toner base m14 had KC of 110, BTs/BTk of 0.91, and a surface roughness index (the proportion of black) of 95.4.

(15) Preparation of Toner Base m15

In a 2000 ml four-neck flask equipped with a cooling tube and a thermometer were placed 204 g of first resin particle dispersion RL2, 25 g of pigment particle dispersion PM1, 40 g of wax particle dispersion WA2, and 250 ml of ion-exchanged water, and then mixed for 10 minutes by using a homogenizer (Ultratalax T25 manufactured by IKA CO., LTD.), thus providing a mixed particle dispersion. The pH of the mixed particle dispersion was 5.8.

The pH was increased to 11.0 by adding 1N NaOH to the mixed particle dispersion. Subsequently, 255 g of magnesium sulfate aqueous solution (30% concentration) was added and stirred for 10 minutes. After the temperature was raised from 22° C. to 70° C. at a rate of 3° C./min, the mixture was heat-treated at 70° C. for 2 hours. The temperature was raised to 80° C., and then the mixture further was heat-treated for 5 hours to provide aggregated particles. The resultant aggregated particle dispersion had a pH of 8.3.

After cooling, the reaction product (toner base) was filtered and washed three times with ion-exchanged water. The toner base thus obtained was dried at 30° C. for 6 hours by using a fluid-type dryer, resulting in a toner base m15 with a volume-average particle size of 6.2 μm and a coefficient of variation of 19.8.

Figure 8A:
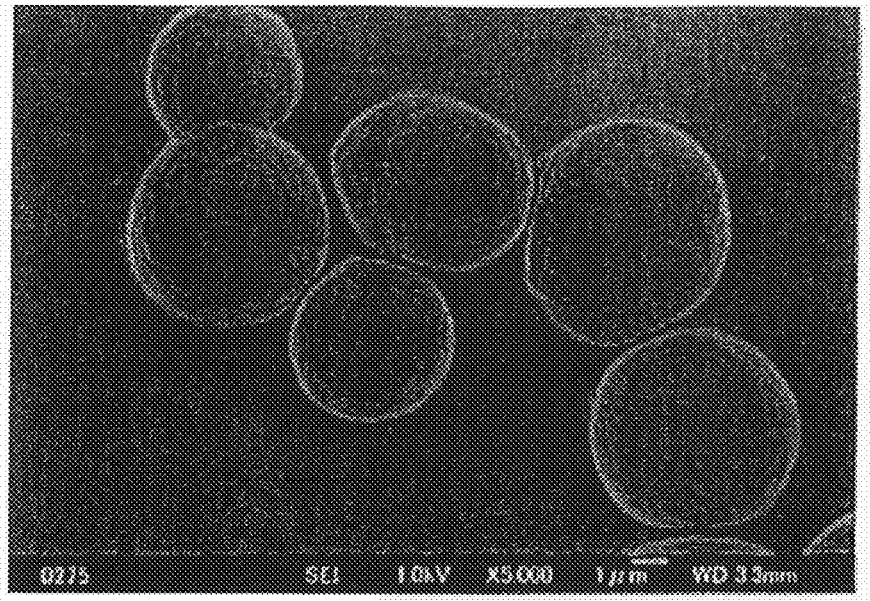
FIG. 8A shows a surface observation image of toner by an electron microscope in a comparative example.
Figure 8B:
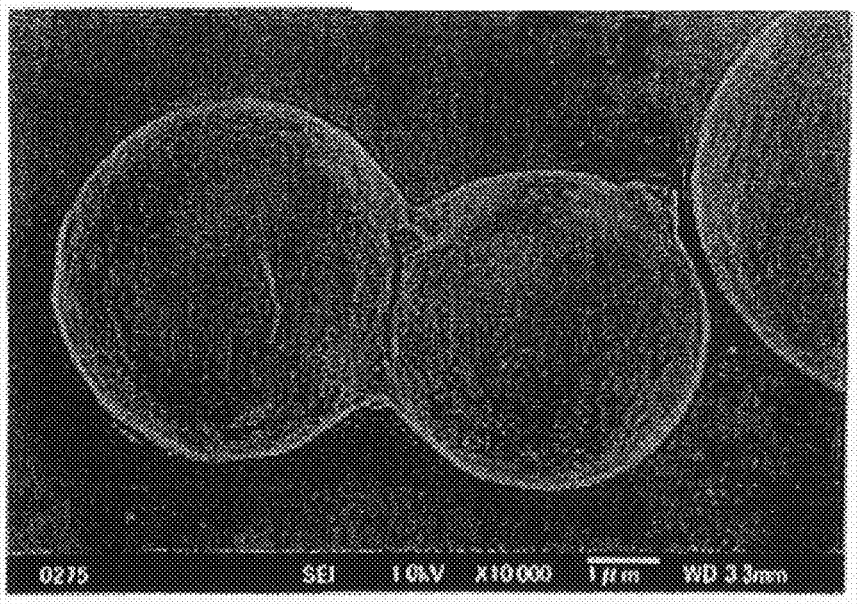
FIG. 8B shows a surface observation image of toner by an electron microscope in a comparative example.
Figure 17A:
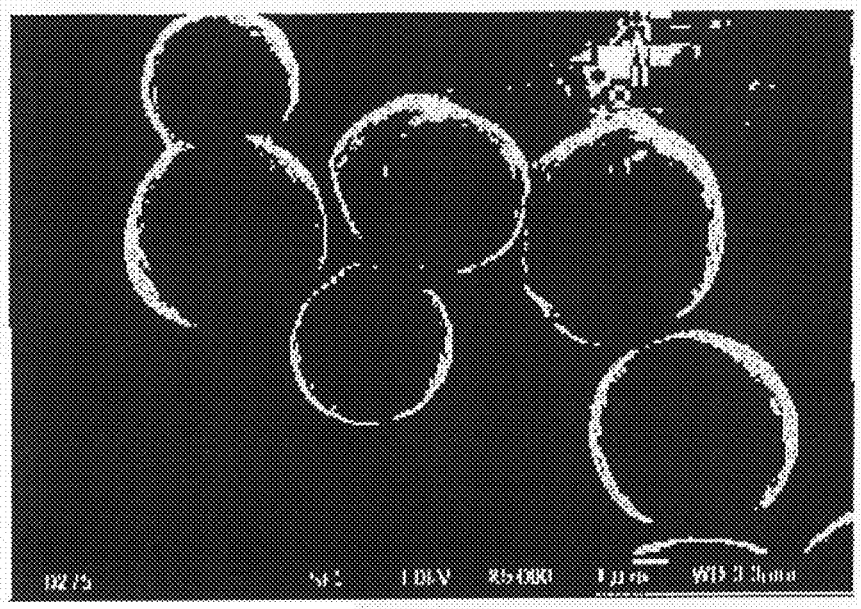
FIG. 17A shows a binary picture of the surface observation image of the toner in FIG. 8A.
Figure 17B:
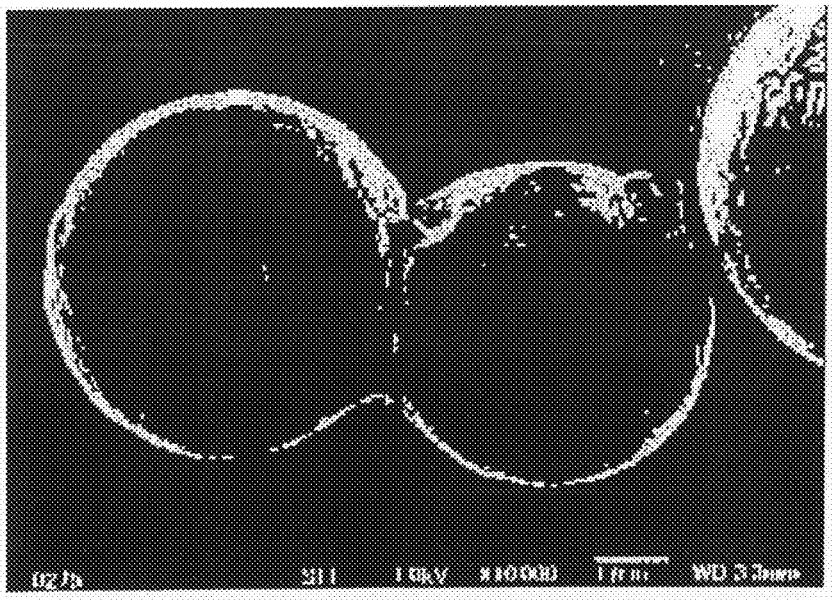
FIG. 17B shows a binary picture of the surface observation image of the toner in FIG. 8B.

FIGS. 8A and 8B show SEM observation images of the toner base m15, and FIGS. 17A and 17B show binary pictures of the SEM observation images. The magnification is 5000 times for the upper figure A and 10000 times for the lower figure B. The observation indicated that the surface of the toner base m15 was substantially smooth and had no roughness. The toner base m15 had KC of 115, BTs/BTk of 1.09, and a surface roughness index (the proportion of black) of 98.4.

(16) Preparation of Toner Base m16

In a 2000 ml four-neck flask equipped with a cooling tube and a thermometer were placed 204 g of first resin particle dispersion RH4, 30 g of pigment particle dispersion PM1, 25 g of wax particle dispersion WA2, and 300 ml of ion-exchanged water, and then mixed for 10 minutes by using a homogenizer (Ultratalax T25 manufactured by IKA CO., LTD.), thus providing a mixed particle dispersion. The pH of the mixed particle dispersion was 3.8.

The pH was increased to 10.6 by adding 1N NaOH to the mixed particle dispersion. Subsequently, 246 g of magnesium sulfate aqueous solution (30% concentration) was added and stirred for 10 minutes. After the temperature was raised from 22° C. to 80° C. at a rate of 5° C./min, the mixture was heat-treated at 80° C. for 2 hours. The temperature was raised to 90° C., and then the mixture further was heat-treated for 2 hours to provide aggregated particles. The resultant aggregated particle dispersion had a pH of 8.2. The volume-average particle size was 4.0 μm, and the coefficient of variation was 24.1.

After the water temperature was reduced to 60° C., 43 g of second resin particle dispersion RH4 was added to the aggregated particle dispersion, and the pH was adjusted to 8.6 by the addition of 1N NaOH. This mixture was heated at 85° C. for 0.5 hour, and the pH was adjusted to 6.6 by the addition of 1N HCl. Then, the mixture further was heated at 90° C. for 2 hours.

After cooling, the reaction product (toner base) was filtered and washed three times with ion-exchanged water. The toner base thus obtained was dried at 40° C. for 6 hours by using a fluid-type dryer, resulting in a toner base m16 with a volume-average particle size of 4.8 μm and a coefficient of variation of 25.1.

Figure 14A:
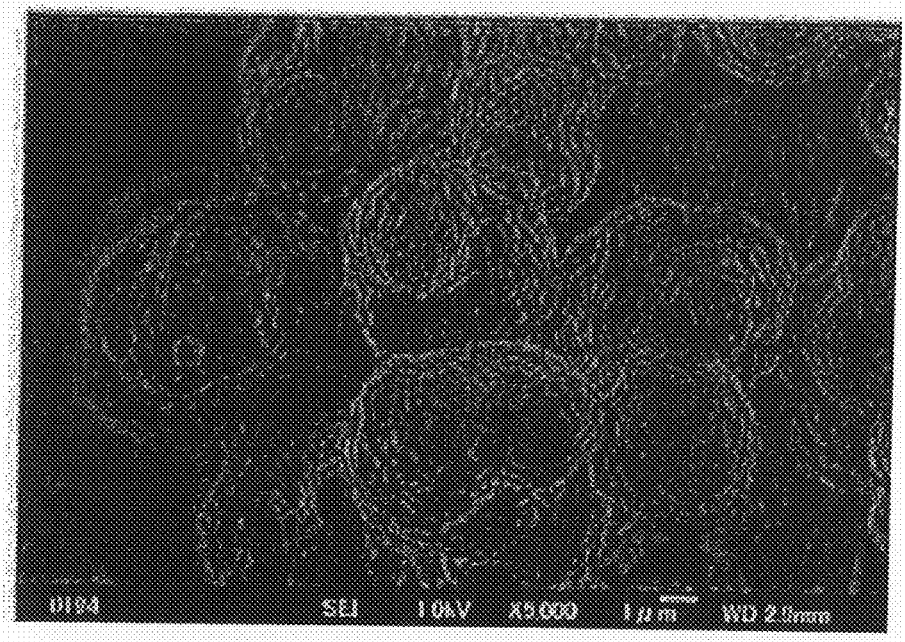
FIG. 14A shows a surface observation image of toner by an electron microscope in a comparative example.
Figure 14B:
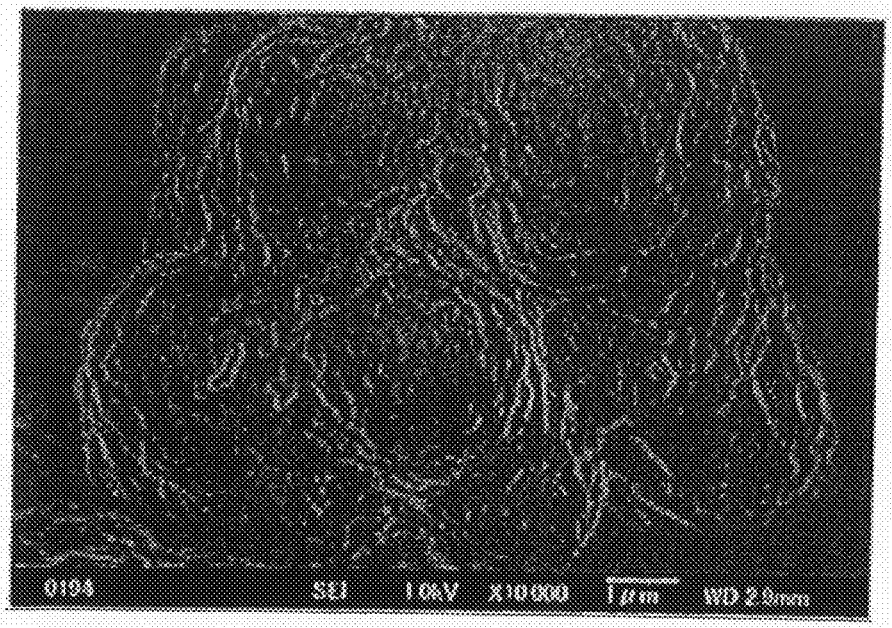
FIG. 14B shows a surface observation image of toner by an electron microscope in a comparative example.

FIGS. 14A and 14B show SEM observation images. The magnification is 5000 times for the upper figure A and 10000 times for the lower figure B. The observation indicated that the toner base m16 had fine surface roughness, but almost no definite shape. The toner base m16 had KC of 138 and BTs/BTk of 6.28.

(17) Preparation of Toner Base m17

In a 2000 ml four-neck flask equipped with a cooling tube and a thermometer were placed 204 g of first resin particle dispersion RH5, 30 g of pigment particle dispersion PM1, 25 g of wax particle dispersion WA8, and 300 ml of ion-exchanged water, and then mixed for 10 minutes by using a homogenizer (Ultratalax T25 manufactured by IKA CO., LTD.), thus providing a mixed particle dispersion. The pH of the mixed particle dispersion was 3.8.

The pH was increased to 10.6 by adding 1N NaOH to the mixed particle dispersion. Subsequently, 246 g of magnesium sulfate aqueous solution (30% concentration) was added and stirred for 10 minutes. After the temperature was raised from 22° C. to 80° C. at a rate of 5° C./min, the mixture was heat-treated at 80° C. for 2 hours. The temperature was raised to 90° C., and then the mixture further was heat-treated for 2 hours to provide aggregated particles. The resultant aggregated particle dispersion had a pH of 8.2. The volume-average particle size was 4.3 μm, and the coefficient of variation was 21.1.

After the water temperature was reduced to 60° C., 43 g of second resin particle dispersion RH5 was added to the aggregated particle dispersion, and the pH was adjusted to 8.6 by the addition of 1N NaOH. This mixture was heated at 85° C. for 0.5 hour, and the pH was adjusted to 6.6 by the addition of 1N HCl. Then, the mixture further was heated at 90° C. for 2 hours.

After cooling, the reaction product (toner base) was filtered and washed three times with ion-exchanged water. The toner base thus obtained was dried at 40° C. for 6 hours by using a fluid-type dryer, resulting in a toner base m17 with a volume-average particle size of 5.2 μm and a coefficient of variation of 22.5.

Figure 15A:
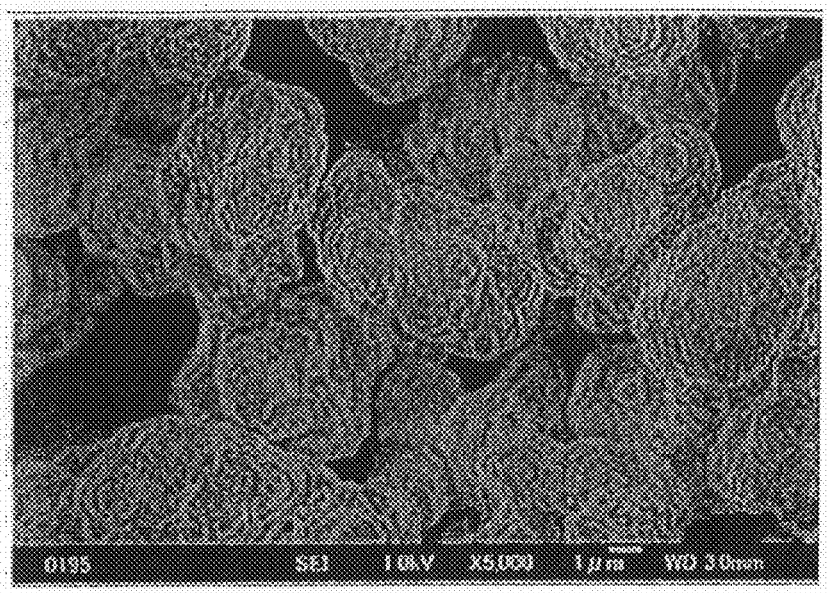
FIG. 15A shows a surface observation image of toner by an electron microscope in a comparative example.
Figure 15B:
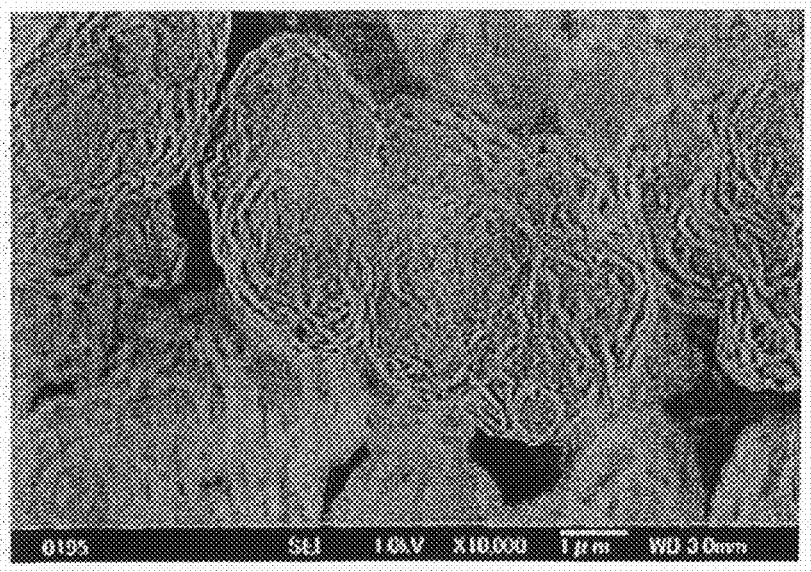
FIG. 15B shows a surface observation image of toner by an electron microscope in a comparative example.

FIGS. 15A and 15B show SEM observation images. The magnification is 5000 times for the upper figure A and 10000 times for the lower figure B. The observation indicated that the toner base m17 had fine surface roughness, but almost no definite shape. The toner base m17 had KC of 141 and BTs/BTk of 7.20.

(18) Preparation of Toner Base m18

In a 2000 ml four-neck flask equipped with a cooling tube and a thermometer were placed 204 g of first resin particle dispersion RL3, 30 g of pigment particle dispersion PM1, 50 g of wax particle dispersion wa11, and 300 ml of ion-exchanged water, and then mixed for 10 minutes by using a homogenizer (Ultratalax T25 manufactured by IKA CO., LTD.), thus providing a mixed particle dispersion.

The pH was adjusted to 10.0 by adding 1N NaOH to the mixed particle dispersion. Subsequently, 270 g of magnesium sulfate aqueous solution (30% concentration) was added and stirred for 10 minutes. After the temperature was raised from 22° C. to 70° C. at a rate of 5° C./min, the mixture was heat-treated at 70° C. for 2 hours. The temperature was raised to 90° C., and then the mixture further was heat-treated for 5 hours to provide aggregated particles. The resultant aggregated particle dispersion had a pH of 7.5. The volume-average particle size was 9.8 μm, and the coefficient of variation was 24.1.

After the water temperature was reduced to 60° C., 43 g of second resin particle dispersion RH4 was added to the aggregated particle dispersion, and the pH was adjusted to 6.0 by the addition of 1N NaOH. This mixture was heated at 80° C. for 1 hour, and the pH was adjusted to 5.5 by the addition of 1N HCl. Then, the mixture further was heated at 90° C. for 5 hours.

After cooling, the reaction product (toner base) was filtered and washed three times with ion-exchanged water. The toner base thus obtained was dried at 40° C. for 6 hours by using a fluid-type dryer, resulting in a toner base m18 with a volume-average particle size of 10.8 μm and a coefficient of variation of 28.8. The toner base m18 involved a large number of secondary aggregated particles, showed almost no definite shape, and had KC of 142.

(19) Preparation of Toner Base m19

In a 2000 m1 four-neck flask equipped with a cooling tube and a thermometer were placed 204 g of first resin particle dispersion RL3, 30 g of pigment particle dispersion PM1, 50 g of wax particle dispersion wall, and 300 ml of ion-exchanged water, and then mixed for 10 minutes by using a homogenizer (Ultratalax T25 manufactured by IKA CO., LTD.), thus providing a mixed particle dispersion.

The pH was adjusted to 9.0 by adding 1N NaOH to the mixed particle dispersion. Subsequently, 270 g of magnesium sulfate aqueous solution (30% concentration) was added and stirred for 10 minutes. After the temperature was raised from 22° C. to 90° C. at a rate of 5° C./min, the mixture was heat-treated at 90° C. for 6 hours to provide aggregated particles. The resultant aggregated particle dispersion had a pH of 6.5. The volume-average particle size was 13.5 μm, and the coefficient of variation was 33.8.

After the water temperature was reduced to 60° C., 43 g of second resin particle dispersion RH4 was added to the aggregated particle dispersion, and the pH was adjusted to 4.8 by the addition of 1N NaOH. This mixture was heated at 90° C. for 1 hour, and the pH was adjusted to 3.0 by the addition of 1N HCl. Then, the mixture further was heated at 90° C. for 5 hours.

After cooling, the reaction product (toner base) was filtered and washed three times with ion-exchanged water. The toner base thus obtained was dried at 40° C. for 6 hours by using a fluid-type dryer, resulting in a toner base m19 with a broad particle size distribution represented by a volume-average particle size of 14.8 μm and a coefficient of variation of 35.1. The toner base m19 involved a large number of secondary aggregated particles, showed almost no definite shape, and had KC of 145.

(20) Preparation of Toner Base m20

In a 2000 ml four-neck flask equipped with a cooling tube and a thermometer were placed 204 g of first resin particle dispersion RL3, 30 g of pigment particle dispersion PM1(20 wt % concentration), 50 g of wax particle dispersion wa12 (30 wt % concentration), and 300 ml of ion-exchanged water, and then mixed for 10 minutes by using a homogenizer (Ultratalax T50 manufactured by IKA CO., LTD.), thus providing a mixed particle dispersion.

The pH was adjusted to 9.2 by adding 1N NaOH to the mixed particle dispersion. Subsequently, 270 g of magnesium sulfate aqueous solution (30% concentration) was added and stirred for 10 minutes. After the temperature was raised from 22° C. to 85° C. at a rate of 5° C./min, the mixture was heat-treated at 85° C. for 5 hours to provide aggregated particles. The resultant aggregated particle dispersion had a pH of 6.5. The volume-average particle size was 19.5 μm, and the coefficient of variation was 35.1.

After the water temperature was reduced to 60° C., 43 g of second resin particle dispersion RH4 was added to the aggregated particle dispersion, and the pH was adjusted to 4.8 by the addition of 1N NaOH. This mixture was heated at 90° C. for 1 hour, and the pH was adjusted to 3.0 by the addition of 1N HCl. Then, the mixture further was heated at 90° C. for 5 hours.

After cooling, the reaction product (toner base) was filtered and washed three times with ion-exchanged water. The toner base thus obtained was dried at 40° C. for 6 hours by using a fluid-type dryer, resulting in a toner base m20 with a broad particle size distribution represented by a volume-average particle size of 21.0 μm and a coefficient of variation of 38.8.

(21) Preparation of Toner Base M21

In a 2000 ml four-neck flask equipped with a cooling tube and a thermometer were placed 204 g of first resin particle dispersion RL1, 30 g of pigment particle dispersion PM1, 25 g of wax particle dispersion WA1, and 300 ml of ion-exchanged water, and then mixed for 10 minutes by using a homogenizer (Ultratalax T25 manufactured by IKA CO., LTD.), thus providing a mixed particle dispersion. The pH of the mixed particle dispersion was 3.3.

The pH was increased to 11.5 by adding 1N NaOH to the mixed particle dispersion. Subsequently, 246 g of magnesium sulfate aqueous solution (30% concentration) was added and stirred for 10 minutes. After the temperature was raised from 22° C. to 70° C. at a rate of 3° C./min, the mixture was heat-treated at 70° C. for 2 hours. The temperature was raised to 85° C., and then the mixture further was heat-treated for 5 hours to provide aggregated particles. While maintaining this temperature, 53 g of fifth resin particle dispersion RH8 was added to the aggregated particle dispersion. Then, the mixture was heated at 85° C. for 1 hour, and further heated at 90° C. for 3 hours.

After cooling, the reaction product (toner base) was filtered and washed three times with ion-exchanged water. The toner base thus obtained was dried at 40° C. for 6 hours by using a fluid-type dryer, resulting in a toner base M21 with a volume-average particle size of 5.5 μm and a coefficient of variation of 17.2. The toner base M21 had KC of 128, BTs/BTk of 4.50, and a surface roughness index (the proportion of black) of 79.4.

Table 8 shows the external additives used in this example. The amount of charge (μC/g) was measured by a blow-off method using frictional charge with an uncoated ferrite carrier. Under the environmental conditions of 25° C. and 45% RH, 50 g of carrier and 0.1 g of silica or the like were mixed in a 100 ml polyethylene container, and then stirred by vertical rotation at a speed of 100 $min^{-1}$ for 5 minutes and 30 minutes, respectively. Thereafter, 0.3 g of sample was taken for each stirring time, and a nitrogen gas was blown on the samples at $1.96\times10^4$ (Pa) for 1 minute.

It is preferable that the 5-minute value is −100 to −800 μC/g and the 30-minute value is −50 to −600 μC/g for the negative chargeability. Silica having a high charge amount can function well in a small quantity.

TABLE 8

| Inorganic fine powder | Material | Treatment material A | Treatment material B | Particle size (nm) | Methanol titration (%) | Moisture absorption | Ignition loss (wt %) | Drying loss (wt %) | 5-min value (μC/g) | 30-min value (μC/g) | 5-min/ 30-min value |
|---|---|---|---|---|---|---|---|---|---|---|---|
| S1 | Silica | Silica treated with dimethylpolysiloxane | | 6 | 88 | 0.1 | 10.5 | 0.2 | −820 | −710 | 86.6 |
| S2 | Silica | Silica treated with methyl hydrogen polysiloxane | | 16 | 88 | 0.1 | 5.5 | 0.2 | −560 | −450 | 80.4 |
| S3 | Silica | Methyl hydrogen polysiloxane (1) | | 40 | 88 | 0.1 | 10.8 | 0.2 | −580 | −480 | 82.8 |
| S4 | Silica | Dimethylpolysiloxane (20) | Zinc octoate (1) | 40 | 84 | 0.09 | 24.5 | 0.2 | −740 | −580 | 78.4 |
| S5 | Silica | Methyl hydrogen polysiloxane (1) | Aluminium distearate (2) | 40 | 88 | 0.1 | 10.8 | 0.2 | −580 | −480 | 82.8 |
| S6 | Silica | Dimethylpolysiloxan (2) | Stearic acid amide (1) | 80 | 88 | 0.12 | 15.8 | 0.2 | −620 | −475 | 76.6 |
| S7 | Silica | Methyl hydrogen polysiloxane (1) | Fatty acid pentaerythritol monoester (1) | 150 | 88 | 0.1 | 5.8 | 0.2 | −510 | −420 | 82.3 |
| S8 | Titanium oxide | Diphenylpolysiloxan (10) | Sodium stearate (1) | 80 | 88 | 0.1 | 18.5 | 0.2 | −750 | −850 | 86.7 |
| S9 | Silica | Silica treated with hexamethyldisilazane | | 16 | 68 | 0.6 | 1.6 | 0.2 | −800 | −620 | 77.5 |

Table 9 shows the toner material compositions used in this example. The compositions of black toner, cyan toner, and yellow toner were the same as the composition of magenta toner except for pigment, i.e., PB1, PC1, and PY1 were used for the black toner, the cyan toner, and the yellow toner, respectively.

TABLE 9

| Toner | Toner base | External additive A | External additive B |
|---|---|---|---|
| TM1 | M1 | S1(0.6) | S3(1.5) |
| TM2 | M2 | S2(1.8) | S4(1.5) |
| TM3 | M3 | S1(1.8) | S5(1.2) |
| TM4 | M4 | S2(2.5) | |
| TM5 | M5 | S1(2.0) | S6(2.0) |
| TM6 | M6 | S2(1.8) | S7(3.5) |
| TM7 | M7 | S1(0.3) | S6(1.0) |
| TM8 | M8 | S2(1.8) | S7(1.5) |
| TM9 | M9 | S1(3.0) | |
| TM10 | M10 | S2(1.8) | S3(1.5) |
| TM11 | M11 | S1(0.3) | S4(1.5) |
| TM12 | M12 | S2(1.8) | S5(1.2) |
| TM13 | M13 | S1(0.3) | S7(3.5) |
| tm14 | m14 | S9(0.5) | |
| tm15 | m15 | S9(0.5) | |

TABLE 9-continued

| Toner | Toner base | External additive A | External additive B |
|---|---|---|---|
| tm16 | m16 | S9(0.5) | |
| tm17 | m17 | S9(0.5) | |
| tm18 | m18 | S9(0.5) | |
| tm19 | m19 | S9(0.5) | |
| tm20 | m20 | S9(0.5) | |
| TM21 | M21 | S2(1.8) | S5(1.2) |

The number in the parentheses is the amount (parts by weight) of the external additive added per 100 parts by weight of the toner base. The external addition treatment was performed by using FM20B (manufactured by Mitsui Mining Co., Ltd.) with a Z0S0-type mixer blade, an input amount of 1 kg, a number of revolutions of 2000 $min^{-1}$, and a treating time of 5 minutes.

FIG. 1 is a cross-sectional view showing the configuration of a full color image forming apparatus for full color images used in this example. In FIG. 1, the outer housing of a color electrophotographic printer is not shown.

A transfer belt unit 17 includes a transfer belt 12, a first color (yellow) transfer roller 10Y, a second color (magenta) transfer roller 10M, a third color (cyan) transfer roller 10C, a fourth color (black) transfer roller 10K, a driving roller 11 made of aluminum, a second transfer roller 14 made of an elastic body, a second transfer follower roller 13, a belt cleaner blade 16 for cleaning a toner image that remains on the transfer belt 12, and a roller 15 located opposite to the belt cleaner blade 16. The first to fourth color transfer rollers 10Y, 10M, 10C, and 10K are made of an elastic body.

A distance between the first color (Y) transfer position and the second color (M) transfer position is 70 mm (which is the same as a distance between the second color (M) transfer position and the third color (C) transfer position and a distance between the third color (C) transfer position and the fourth color (K) transfer position). The circumferential velocity of a photoconductive member is 125 mm/s.

The transfer belt 12 can be obtained by kneading a conductive filler in an insulating resin and making a film with an extruder. In this example, polycarbonate resin (e.g., European Z300 manufactured by Mitsubishi Gas Kagaku Co., Ltd.) was used as the insulating resin, and 5 parts by weight of conductive carbon (e.g., "KETJENBLACK") were added to 95 parts by weight of the polycarbonate resin to form a film. The surface of the film was coated with a fluorocarbon resin. The film had a thickness of about 100 μm, a volume resistance of $10^7$ to $10^{12}\Omega\cdot cm$, and a surface resistance of $10^7$ to $10^{12}\Omega/\square$. The use of this film can improve the dot reproducibility and prevent slack of the transfer belt 12 over a long period of use or charge accumulation effectively. By coating the film surface with a fluorocarbon resin, the filming of toner on the surface of the transfer belt 12 caused by a long period of use also can be suppressed effectively. When the volume resistance is less than $10^7\Omega\cdot cm$, retransfer is likely to occur. When the volume resistance is more than $10^{12}\Omega\cdot cm$, the transfer efficiency is degraded.

A first transfer roller 10 is a urethane foam roller of conductive carbon and has an outer diameter of 8 mm. The resistance value is $10^2$ to $10^6\Omega$. In the first transfer operation, the first transfer roller 10 is pressed against a photoconductive member 1 by a force of about 1.0 to 9.8 (N) via the transfer belt 12, so that toner on the photoconductive member 1 is transferred onto the transfer belt 12. When the resistance value is less than $10^2\Omega$, reverse transfer is likely to occur. When the resistance value is more than $10^6\Omega$, a transfer failure is likely to occur. The force less than 1.0 (N) may cause a transfer failure, and the force more than 9.8 (N) may cause thinning in letters during transfer.

The second transfer roller 14 is a urethane foam roller of conductive carbon and has an outer diameter of 10 mm. The resistance value is $10^2$ to $10^6\Omega$. The second transfer roller 14 is pressed against the follower roller 13 via the transfer belt 12 and a transfer medium 19 such as paper or OHP sheet. The follower roller 13 is rotated in accordance with the movement of the transfer belt 12. In the second transfer operation, the second transfer roller 14 is pressed against the follower roller 13 by a force of 5.0 to 21.8 (N), so that toner is transferred from the transfer belt 12 to the transfer medium 19. When the resistance value is less than $10^2\Omega$, reverse transfer is likely to occur. When the resistance value is more than $10^6\Omega$, a transfer failure is likely to occur. The force less than 5.0 (N) may cause a transfer failure, and the force more than 21.8 (N) may increase the load and generate jitter easily.

Four image forming units 18Y, 18M, 18C, and 18K for yellow (Y), magenta CM, cyan (C), and black (K) are arranged in series, as shown in FIG. 1.

The image forming units 18Y, 18M, 18C, and 18K have the same components except for a developer contained therein. For simplification, only the image forming unit 18Y for yellow (Y) will be described, and an explanation of the other units will not be repeated.

In the configuration of the image forming unit, reference numeral 1 is a photoconductive member, 3 is pixel laser signal light, and 4 is a developing roller of aluminum that has an outer diameter of 10 mm and includes a magnet with a magnetic force of 1200 gauss. The developing roller 4 is located opposite to the photoconductive member 1 with a gap of 0.3 mm between them, and rotates in the direction of the arrow. A stirring roller 6 stirs toner and a carrier in a developing unit and supplies the toner to the developing roller 4. The mixing ratio of the toner to the carrier is read from a permeability sensor (not shown), and the toner is supplied timely from a toner hopper (not shown). A magnetic blade 5 is made of metal and controls a magnetic brush layer of a developer on the developing roller 4. In this example, 150 g of developer was introduced, and the gap was 0.4 mm. Although a power supply is not shown in FIG. 1, a direct voltage of −500 V and an alternating voltage of 1.5 kV (p-p) at 6 kHz were applied to the developing roller 4. The circumferential velocity ratio of the photoconductive member 1 to the developing roller 4 was 1:1.6. The mixing ratio of the toner to the carrier was 93:7.

A charging roller 2 is made of epichlorohydrin rubber and has an outer diameter of 10 mm. A direct-current bias of −1.2 kV is applied to the charging roller 2 for charging the surface of the photoconductive member 1 to −600 V. Reference numeral 8 is a cleaner, 9 is a waste toner box, and 7 is a developer.

Paper is conveyed from the lower side of the transfer belt unit 17, and a paper conveying path is formed so that paper 19 is transported by a paper feed roller (not shown) to a nip portion where the transfer belt 12 and the second transfer roller 14 are pressed against each other.

Toner on the transfer belt 12 is transferred to the paper 19 by +1000 V applied to the second transfer roller 14, and then is conveyed to a fixing portion in which the toner is fixed. The fixing portion includes a fixing roller 201, a pressure roller 202, a fixing belt 203, a heat roller 204, and an induction heater 205.

Figure 2:
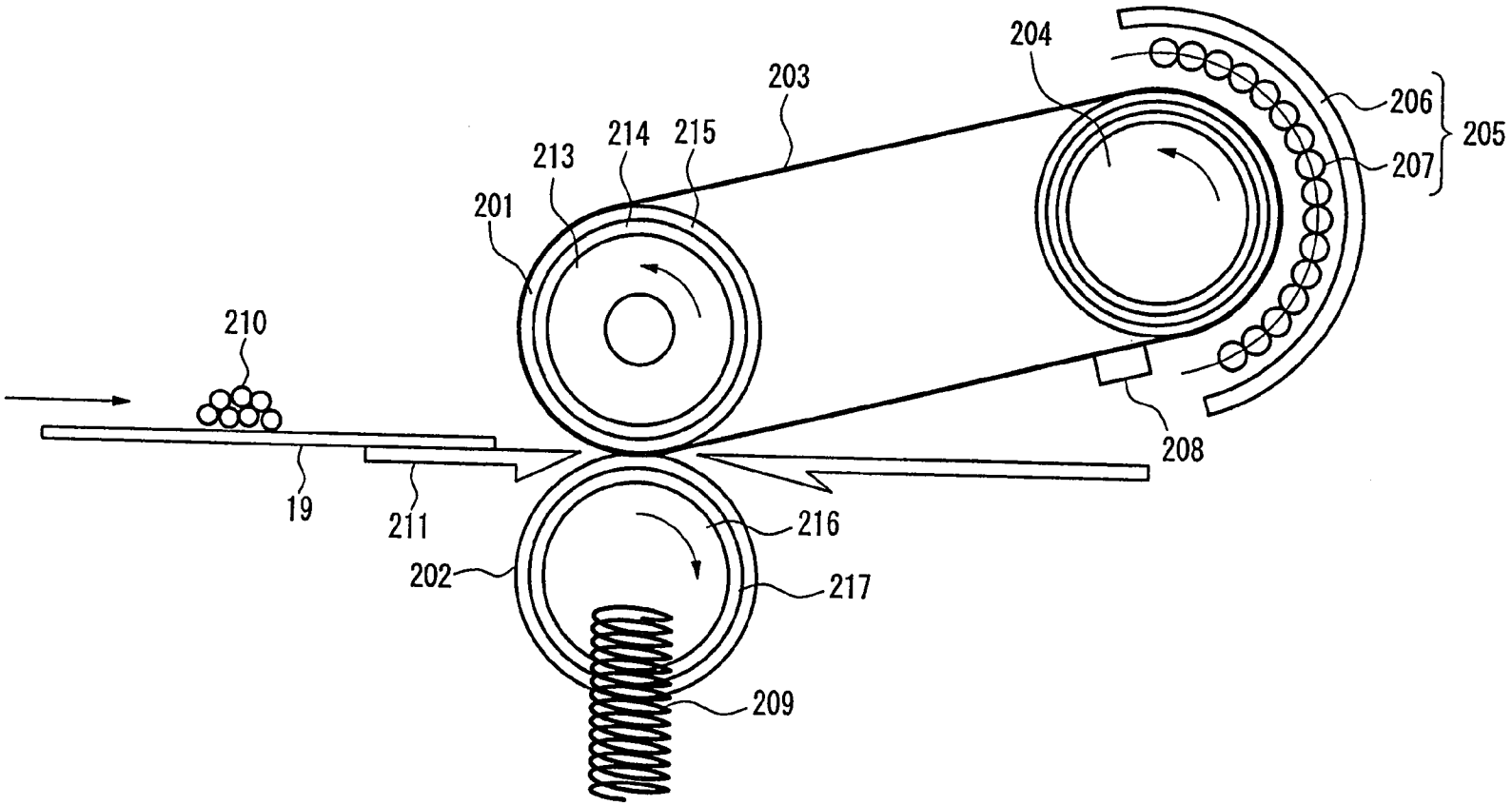
FIG. 2 is a cross-sectional view showing the configuration of a fixing unit used in an example of the present invention.

FIG. 2 shows a fixing process. A belt 203 runs between the fixing roller 201 and the heat roller 204. A predetermined load is applied between the fixing roller 201 and the pressure roller 202 so that a nip is formed between the belt 203 and the pressure roller 202. The induction heater 205 including a ferrite core 206 and a coil 207 is provided on the periphery of the heat roller 204, and a temperature sensor 208 is arranged on the outer surface.

The belt 203 is formed by arranging a Ni substrate (30 μm), silicone rubber (150 μm), and PFA (tetrafluoroethylene-perfluoroalkyl vinyl ether copolymer) (30 μm) in layers.

The pressure roller 202 is pressed against the fixing roller 201 by a spring 209. A recording material 19 with toner 210 is moved along a guide plate 211.

The fixing roller 201 (fixing member) includes a hollow core 213, an elastic layer 214 formed on the hollow core 213, and a silicone rubber layer 215 formed on the elastic layer 214. The hollow core 213 is made of aluminum and has a length of 250 mm, an outer diameter of 14 mm, and a thickness of 1 mm. The elastic layer 214 is made of silicone rubber with a rubber hardness (JIS-A) of 20 degrees based on the JIS standard and has a thickness of 3 mm. The silicone rubber layer 215 has a thickness of 3 mm. Therefore, the outer diameter of the fixing roller 201 is about 20 mm. The fixing roller 201 is rotated at 125 mm/s by receiving a driving force from a driving motor (not shown).

The heat roller 204 includes a hollow pipe having a thickness of 1 mm and an outer diameter of 20 mm. The surface temperature of the fixing belt is controlled to 170° C. by using a thermistor.

The pressure roller 202 (pressure member) has a length of 250 mm and an outer diameter of 20 mm, and includes a hollow core 216 and an elastic layer 217 formed on the hollow core 216. The hollow core 216 is made of aluminum and has an outer diameter of 16 mm and a thickness of 1 mm. The elastic layer 217 is made of silicone rubber with a rubber hardness (JIS-A) of 55 degrees based on the JIS standard and has a thickness of 2 mm. The pressure roller 202 is mounted rotatably, and a 5.0 mm width nip is formed between the pressure roller 202 and the fixing roller 201 under a one-sided load of 147N given by the spring 209.

The operations will be described below. In the full color mode, all the first transfer rollers 10 of Y, M, C, and K are lifted and pressed against the respective photoconductive members 1 of the image forming units via the transfer belt 12. At this time, a direct-current bias of +800 V is applied to each of the first transfer rollers 10. An image signal is transmitted through the laser beam 3 and enters the photoconductive member 1 whose surface has been charged by the charging roller 2, thus forming an electrostatic latent image. The electrostatic latent image formed on the photoconductive member 1 is made visible by toner on the developing roller 4 that is rotated in contact with the photoconductive member 1.

In this case, the image formation rate (125 mm/s, which is equal to the circumferential velocity of the photoconductive member) of the image forming unit 18Y is set so that the speed of the photoconductive member is 0.5 to 1.5% slower than the traveling speed of the transfer belt 12.

In the image forming process, signal light 3Y is input to the image forming unit 18Y, and an image is formed with Y toner. At the same time as the image formation, the Y toner image is transferred from the photoconductive member 1Y to the transfer belt 12 by the action of the first transfer roller 10Y, to which a direct voltage of +800V is applied.

There is a time lag between the first transfer of the first color (Y) and the first transfer of the second color (M). Then, signal light 3M is input to the image forming unit 18M, and an image is formed with M toner. At the same time as the image formation, the M toner image is transferred from the photoconductive member 1M to the transfer belt 12 by the action of the first transfer roller 10M. In this case, the M toner is transferred onto the first color (Y) toner that has been formed on the transfer belt 12. Subsequently, the C toner and K toner images are formed in the same manner and transferred by the action of the first transfer rollers 10C, 10K. Thus, YMCK toner images are formed on the transfer belt 12. This is a so-called tandem process.

A color image is formed on the transfer belt 12 by superimposing the four color toner images in registration. After the last transfer of the K toner image, the four color toner images are transferred collectively to the paper 19 fed by a feeding cassette (not shown) at matched timing by the action of the second transfer roller 14. In this case, the follower roller 13 is grounded, and a direct voltage of +1 kV is applied to the second transfer roller 14. The toner images transferred to the paper 19 are fixed by a pair of fixing rollers 201 and 202. Then, the paper 19 is ejected through a pair of ejecting rollers (not shown) to the outside of the apparatus. The toner that is not transferred and remains on the transfer belt 12 is cleaned by the belt cleaner blade 16 for the next image formation.

Table 10 shows evaluations of the image density, fog, transfer property, and cleaning property of full color images formed by the electrophotographic apparatus in FIG. 1. The amount of charge was measured by a blow-off method using frictional charge with a ferrite carrier. Under the environmental conditions of 25° C. and 45% RH, 0.3 g of sample was taken to evaluate the durability, and a nitrogen gas was blown on the sample at $1.96\times10^4$ (Pa) for 1 minute.

TABLE 10

| Developer | Toner | Carrier | Filming on photoconductive member | Image density (ID) initial/after test | | Fog | Uniformity of solid image | Transfer skipping in letters | Reverse transfer | Transfer thinning in letters | Cleaning property |
|---|---|---|---|---|---|---|---|---|---|---|---|
| DM11 | TM1 | A1 | Not occur | 1.46 | 1.46 | ○ | ○ | ○ | ○ | ○ | ○ |
| DM12 | TM2 | A2 | Not occur | 1.45 | 1.47 | ○ | ○ | ○ | ○ | ○ | ○ |
| DM13 | TM3 | A3 | Not occur | 1.50 | 1.54 | ○ | ○ | ○ | ○ | ○ | ○ |
| DM14 | TM4 | A4 | Not occur | 1.39 | 1.40 | ○ | ○ | ○ | ○ | ○ | ○ |
| DM15 | TM5 | A1 | Not occur | 1.45 | 1.42 | ○ | ○ | ○ | ○ | ○ | ○ |
| DM16 | TM6 | A2 | Not occur | 1.48 | 1.45 | ○ | ○ | ○ | ○ | ○ | ○ |
| DM17 | TM7 | A3 | Not occur | 1.52 | 1.53 | ○ | ○ | ○ | ○ | ○ | ○ |
| DM18 | TM8 | A4 | Not occur | 1.34 | 1.32 | ○ | ○ | ○ | ○ | ○ | ○ |
| DM19 | TM9 | A1 | Not occur | 1.31 | 1.28 | ○ | ○ | ○ | ○ | ○ | ○ |
| DM20 | TM10 | A2 | Not occur | 1.41 | 1.31 | ○ | ○ | ○ | ○ | ○ | ○ |
| DM21 | TM11 | A3 | Not occur | 1.12 | 1.02 | ○ | ○ | ○ | ○ | ○ | ○ |
| DM22 | TM12 | A4 | Not occur | 1.42 | 1.34 | ○ | ○ | ○ | ○ | ○ | ○ |
| DM23 | TM13 | A1 | Not occur | 1.44 | 1.35 | ○ | ○ | ○ | ○ | ○ | ○ |

TABLE 10-continued

| Developer | Toner | Carrier | Filming on photoconductive member | Image density (ID) initial/after test | | Fog | Uniformity of solid image | Transfer skipping in letters | Reverse transfer | Transfer thinning in letters | Cleaning property |
|---|---|---|---|---|---|---|---|---|---|---|---|
| cm1 | tm14 | b1 | Occur | 1.41 | 1.44 | X | X | X | ○ | ○ | X |
| cm2 | tm15 | b2 | Occur | 1.32 | 1.34 | X | X | X | ○ | ○ | X |
| cm3 | tm16 | b3 | Not occur | 1.35 | 1.25 | X | X | X | X | X | ○ |
| cm4 | tm17 | b4 | Not occur | 1.34 | 1.24 | X | X | X | X | X | ○ |
| cm5 | tm18 | b1 | Occur | 1.29 | 1.08 | X | X | X | X | X | ○ |
| cm6 | tm19 | b2 | Occur | 1.21 | 1.08 | X | X | X | X | X | ○ |
| cm7 | tm20 | b3 | Occur | 1.21 | 1.04 | X | X | X | X | X | ○ |
| DM24 | TM21 | A1 | Not occur | 1.42 | 1.41 | ○ | ○ | ○ | ○ | ○ | ○ |

When visual images were formed by using a developer, there was no disturbance in horizontal lines, no scattering toner, and no thinning in letters. The black solid images were uniform, images with significantly high resolution and high quality were reproduced at 16 lines per mm, and further high density images having an image density of not less than 1.3 were obtained. There was no background fog in the non-image portions. In the long period durability test after 1,000,000 copies of A4 paper, the fixability and the image density were not changed very much, and the characteristics were stable. The solid images in development also had favorable uniformity. No developing memory was generated. Moreover, unusual images with vertical strips did not occur during continuous use. There was almost no spent of toner components on the carrier. A change in carrier resistance was reduced, a decrease in charge amount was suppressed, and no fog was generated. The charge rising property was good even after quick supply of toner. No phenomenon was observed that increased fog under high humidity conditions. Moreover, high saturation charge was maintained over a long period of use. There was almost no variation in charge amount under low temperature and low humidity. The thinning during transfer was not a problem for practical use, and the transfer efficiency was 95%. The residual toner on the photoconductive member was cleaned well with a rubber blade under low temperature and low humidity. The failure in cleaning the transfer belt did not occur. The filming of toner on the photoconductive member or the transfer belt also was not a problem for practical use. There is almost no disturbance or scattering of toner during fixing. When a full color image was formed by superimposing three colors, a transfer failure did not occur, and paper was not wound around the fixing belt.

For cm1 and cm2, although the transfer property was good, the residual toner on the photoconductive member was not cleaned with a rubber blade under low temperature and low humidity.

For cm3, and cm4, although the cleaning property was good, reverse transfer and thinning in letters during transfer were increased.

For cm1, cm2, cm3, cm4, cm5, cm6, and cm7, the image density was reduced, and fog was generated considerably. When the solid images were developed continuously by two-component development, and then toner was supplied quickly, the charge amount was reduced, so that fog was increased. This phenomenon became worse, particularly under high humidity conditions.

Table 11 shows evaluations of the fixability of toner or the winding of paper around a fixing belt of full color images for three colors (magenta, cyan, and yellow).

TABLE 11

| Toner | OHP transmittance (%) | High-temperature offset generation (° C.) | Storage stability test | Winding around fixing belt | Toner disturbance during fixing |
|---|---|---|---|---|---|
| TM1 | 95.2 | 240 | ○ | Not occur | None |
| TM2 | 90.2 | 240 | ○ | Not occur | None |
| TM3 | 93.4 | 240 | ○ | Not occur | None |
| TM4 | 88.7 | 240 | ○ | Not occur | None |
| TM5 | 86.8 | 240 | ○ | Not occur | None |
| TM6 | 89.5 | 240 | ○ | Not occur | None |
| TM7 | 86.4 | 240 | ○ | Not occur | None |
| TM8 | 84.9 | 240 | ○ | Not occur | None |
| TM9 | 86.5 | 240 | ○ | Not occur | None |
| TM10 | 90.2 | 240 | ○ | Not occur | None |
| TM11 | 88.9 | 240 | ○ | Not occur | None |
| TM12 | 86.8 | 240 | ○ | Not occur | None |
| TM13 | 89.7 | 240 | ○ | Not occur | None |
| tm14 | 92.5 | 170 | X | Occur | scattering |
| tm15 | 93.7 | 170 | X | Occur | scattering |
| tm16 | 65.8 | 240 | ○ | Not occur | scattering |
| tm17 | 52.1 | 240 | ○ | Not occur | scattering |
| tm18 | 69.8 | 190 | X | Occur | scattering |
| tm19 | 67.8 | 180 | X | Occur | scattering |
| tm20 | 61.2 | 200 | X | Occur | scattering |
| TM21 | 83.5 | 240 | ○ | Not occur | None |

The solid image was fixed in an amount of 1.2 mg/cm$^2$ at a process speed of 125 mm/s by using a fixing device provided with an oilless belt, and the OHP transmittance (fixing temperature: 160° C.) and the high-temperature offset resistance were evaluated. The OHP transmittance was measured with 700 nm light by using a spectrophotometer (U-3200 manufactured by Hitachi, Ltd.).

The storage stability was evaluated after being left standing at 50° C. for 24 hours. Paper jam did not occur in the nip portion. In the case of green solid images formed on plain paper, no offset was caused until 200,000 copies. Even if a silicone or fluorine-based fixing belt was used without oil, the surface of the belt did not wear. The OHP transmittance was not less than 80%. The temperature range of offset resistance was increased by using the fixing roller without oil. Moreover, no agglomeration was observed after being left standing at 50° C. for 24 hours (indicated by ○).

The present invention is useful not only for an electrophotographic system including a photoconductive member, but also for a printing system in which toner adheres directly on paper.

The invention may be embodied in other forms without departing from the spirit or essential characteristics thereof. The embodiments disclosed in this application are to be considered in all respects as illustrative and not limiting. The scope of the invention is indicated by the appended claims rather than by the foregoing description, and all changes which come within the meaning and range of equivalency of the claims are intended to be embraced therein.

What is claimed is:

1. A method for producing toner in an aqueous medium by heating and aggregating a mixture that includes at least a first resin particle dispersion in which first resin particles are dispersed and a pigment particle dispersion in which pigment particles are dispersed, the method comprising steps of:

A. adjusting a pH of the mixture of at least the first resin particle dispersion and the pigment particle dispersion in a range of 9.5 to 12.2;

B. adding a water-soluble inorganic salt to the mixture;

C. heat-treating the mixture so that at least the first resin particles and the pigment particles are aggregated to form aggregated particles, and at least part of the aggregated particles is melted;

D. adjusting a pH of the mixture at the time of forming the aggregated particles in a range of 7.0 to 9.5;

E. adding a second resin particle dispersion in which second resin particles are dispersed and a wax particle dispersion in which wax is dispersed to an aggregated particle dispersion in which the aggregated particles are dispersed and adjusting a pH of the resultant mixture in a range of 5.2 to 8.8;

F. heat-treating the mixture at temperatures not less than a glass transition point of the second resin particles for 0.5 to 2 hours;

G. adjusting a pH of the mixture in a range of 3.2 to 6.8; and

H. fusing the second resin particles and the wax with the aggregated particles by further heat-treating the mixture at temperatures not less than the glass transition point of the second resin particles for 0.5 to 5 hours, wherein colored particles produced have a finely roughened surface.

2. A method for producing toner in an aqueous medium by heating and aggregating a mixture that includes at least a first resin particle dispersion in which first resin particles are dispersed and a pigment particle dispersion in which pigment particles are dispersed, the method comprising steps of A. adjusting a pH of the mixture of at least the first resin particle dispersion and the pigment particle dispersion in a range of 9.5 to 12.2;

B. adding a water-soluble inorganic salt to the mixture;

C. heat-treating the mixture so that at least the first resin particles and the pigment particles are aggregated to form aggregated particles, and at least part of the aggregated particles is melted;

D. adjusting a pH of the mixture at the time of forming the aggregated particles in a range of 7.0 to 9.5;

E. adding a resin A particle dispersion in which resin A particles are dispersed and a resin B particle dispersion in which resin B particles are dispersed to an aggregated particle dispersion in which the aggregated particles are dispersed and adjusting a pH of the resultant mixture in a range of 5.2 to 8.8;

F. heat-treating the mixture at temperatures not less than a glass transition point of the resin A particles for 0.5 to 2 hours;

G. adjusting a pH of the mixture in a range of 3.2 to 6.8; and

H. fusing the resin A particles and the resin B particles with the aggregated particles by further heat-treating the mixture at temperatures not less than the glass transition point of the resin A particles for 0.5 to 5 hours, wherein the resin A particles have a glass transition point (Tg) of 40° C. to 60° C., a softening point (Tm) of 110° C. to 130° C., and a melting start temperature (Tfb) of 80° C. to 110° C., wherein based on a measurement of the resin A particles by gel permeation chromatography (GPC) using THF as an eluent, a number-average molecular weight (Mn) is 3000 to 10000, a weight-average molecular weight (Mw) is 10000 to 100000, a Z average molecular weight (Mz) is 30000 to 500000, a ratio Mw/Mn of the weight-average molecular weight (Mw) to the number-average molecular weight (Mn) is 2 to 15, and a ratio Mz/Mn of the Z average molecular weight (Mz) to the number-average molecular weight (Mn) is 5 to 50, wherein the resin B particles have the glass transition point (Tg) of 60° C. to 80° C., the softening point (Tm) of 140° C. to 200° C., and the melting start temperature (Tfb) of 125° C. to 180° C., wherein based on a measurement of the resin B particles by gel permeation chromatography (GPC) using THF as an eluent, the number-average molecular weight (Mn) is 5000 to 50000, the weight-average molecular weight (Mw) is 50000 to 300000; the Z average molecular weight (Mz) is 200000 to 800000, the ratio Mw/Mn of the weight-average molecular weight (Mw) to the number-average molecular weight (Mn) is 4 to 10, and the ratio Mz/Mn of the Z average molecular weight (Mz) to the number-average molecular weight (Mn) is 10 to 50, and wherein colored particles produced have a finely roughened surface.

3. A method for producing toner comprising:

forming colored particles having a finely roughened surface by fusing at least part of resin A particles and at least part of resin B particles on a surface of aggregated particles that include at least first resin particles and pigment particles, wherein the resin A particles have a glass transition point (Tg) of 40° C. to 60° C., a softening point (Tm) of 110° C. to 130° C., and a melting start temperature (Tfb) of 80° C. to 110° C., wherein based on a measurement of the resin A particles by gel permeation chromatography (GPC) using THF as an eluent, a number-average molecular weight (Mn) is 3000 to 10000, a weight-average molecular weight (Mw) is 10000 to 100000, a Z average molecular weight (Mz) is 30000 to 500000, a ratio Mw/Mn of the weight-average molecular weight (Mw) to the number-average molecular weight (Mn) is 2 to 15, and a ratio Mz/Mn of the Z average molecular weight (Mz) to the number-average molecular weight (Mn) is 5 to 50, wherein the resin B particles have the glass transition point (Tg) of 60° C. to 80° C., the softening point (Tm) of 140° C. to 200° C., and the melting start temperature (Tfb) of 125° C. to 180° C., and wherein based on a measurement of the resin B particles by gel permeation chromatography (GPC) using THF as an eluent, the number-average molecular weight (Mn) is 5000 to 50000, the weight-average molecular weight (Mw) is 50000 to 300000, the Z average molecular weight (Mz) is 200000 to 800000, the ratio Mw/Mn of the weight-average molecular weight (Mw) to the number-average molecular weight (Mn) is 4 to 10, and the ratio Mz/Mn of the Z average molecular weight (Mz) to the number-average molecular weight (Mn) is 10 to 50.

4. The method according to claim 3, wherein the colored particles are substantially spherical in shape.

5. The method according to claim 3, wherein a surface roughness index of the colored particles is not more than 95%.

6. The method according to claim 3, satisfying a relationship expressed by $$100 \leqq KC \leqq 130 \text{ and}$$

$$1.1 \leqq BTs/BTk \leqq 6.0,$$

where KC is a shape factor of the colored particles, BTs is a BET specific surface area by nitrogen adsorption of the colored particles, and BTk is a specific surface area calculated from a particle size of the colored particles.

7. The method according to claim 3, wherein the melting start temperature of the resin B particles is at least 15° C. higher than that of the resin A particles.

8. The method according to claim 3, wherein the weight-average molecular weight of the resin B particles is at least 10% larger than that of the resin A particles.

* * * * *